US008038329B2

(12) United States Patent
Takahasi et al.

(10) Patent No.: US 8,038,329 B2
(45) Date of Patent: Oct. 18, 2011

(54) BULB-SHAPED LAMP AND LIGHTING DEVICE

(75) Inventors: Kenzi Takahasi, Osaka (JP); Yasushige Tomiyoshi, Osaka (JP); Takaari Uemoto, Osaka (JP); Hideo Nagai, Osaka (JP); Mamoru Takeda, Kyoto (JP); Yoshio Manabe, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/994,741

(22) PCT Filed: Feb. 3, 2010

(86) PCT No.: PCT/JP2010/000653

§ 371 (c)(1), (2), (4) Date: Nov. 24, 2010

(87) PCT Pub. No.: WO2010/090012

PCT Pub. Date: Aug. 12, 2010

(65) Prior Publication Data

US 2011/0068687 A1 Mar. 24, 2011

(30) Foreign Application Priority Data

| | | |
|---|---|---|
| Feb. 4, 2009 | (JP) | 2009-023994 |
| May 27, 2009 | (JP) | 2009-127450 |
| Sep. 9, 2009 | (JP) | 2009-208249 |
| Dec. 1, 2009 | (JP) | 2009-273524 |

(51) Int. Cl.
*F21V 29/00* (2006.01)

(52) U.S. Cl. ..... 362/373; 362/294; 362/264

(58) Field of Classification Search ..... 361/679.46, 361/679.52, 688; 362/264
See application file for complete search history.

(56) References Cited

U.S. PATENT DOCUMENTS

| | | | | |
|---|---|---|---|---|
| 6,061,235 | A * | 5/2000 | Cromwell et al. | 361/690 |
| 6,626,556 | B2 * | 9/2003 | Galli | 362/205 |
| 2006/0227558 | A1 | 10/2006 | Osawa et al. | |
| 2010/0096992 | A1 | 4/2010 | Yamamoto et al. | |
| 2010/0237761 | A1 | 9/2010 | Osawa et al. | |
| 2010/0237779 | A1 | 9/2010 | Osawa et al. | |

FOREIGN PATENT DOCUMENTS

| | | |
|---|---|---|
| JP | 2006-202612 | 8/2006 |
| JP | 2006-313718 | 11/2006 |
| JP | 2007-317431 | 12/2007 |
| JP | 3142963 | 7/2008 |
| JP | 2008-293753 | 12/2008 |

* cited by examiner

*Primary Examiner* — Sharon Payne

(57) ABSTRACT

A bulb-type lamp having both heat dissipation and size/weight reduction properties with a lower thermal load on a lighting circuit. An LED module is mounted in a case with a base member to allow dissipation of heat. An LED mount member closes another end of the case and allows conduction of heat to the case. A lighting circuit receives power via the base member. The lighting circuit is disposed inside a circuit holder. An air space exists between the circuit holder and both the case and the mount member. The lighting circuit is isolated from the air space by the circuit holder. A relationship $0.5 \leqq S1/S2$, is satisfied where S1 denotes an area of a portion of the mount member in contact with the case and S2 denotes an area of the portion of the mount member in contact with a substrate of the LED module.

21 Claims, 29 Drawing Sheets

Unit: mm

| | φD1 | L1 | L2 | φD2 | φD3 |
|---|---|---|---|---|---|
| Equivalent of 40-watt bulb | 39.5 | 38.7 | 4.5 | 32 | 23 |
| Equivalent of 60-watt bulb | 54.5 | 51.9 | 7 | 43.4 | 33.4 |

Equivalent of 40-watt bulb Unit: mm

| y | 5mm | 10mm | 15mm | 20mm | 25mm | 30mm | Bent portion |
|---|---|---|---|---|---|---|---|
| Sample 1 | 0.335 | 0.329 | 0.320 | 0.320 | 0.314 | 0.343 | 0.330 |
| Sample 2 | 0.340 | 0.331 | 0.321 | 0.310 | 0.320 | 0.348 | 0.328 |

Sample 3

Data of measured temperatures

| Measured location | Sample 1 | Sample 2 | Sample 3 |
|---|---|---|---|
| Tj (estimated) | 93.9 | 90.1 | 83.2 |
| A | 85.5 | 81.7 | 74.8 |
| B | 77.4 | 77.0 | 73.9 |
| C | 46.4 | 45.3 | 45.4 |
| D | 72.0 | 71.4 | 70.2 |
| E | 69.3 | 67.3 | 65.4 |
| F | 66.8 | 65.2 | 63.9 |
| G | 40.0 | - | 45.0 |

BULB-SHAPED LAMP AND LIGHTING DEVICE

Related Applications

This is a §371 application of PCT/JP 2010/000653 filed on Feb. 3, 2010, which claims priority from Japanese Application No. 2009-023994 filed on Feb. 4, 2009, Japanese Application No. 2009-127450 filed on May 27, 2009, Japanese Application No. 2009-208249 filed on Sep. 9, 2009 and Japanese Application No. 2009-273524 filed on Jan. 12, 2009.

TECHNICAL FIELD

The present invention relates to a bulb-type lamp that uses semiconductor light emitting elements and can replace another light bulb, and to a lighting device.

BACKGROUND ART

In recent years, for the purpose of energy conservation and prevention of further global warming, research and development of lighting devices employing light emitting diodes (LEDs) have been conducted in the field of lighting. LEDs can achieve higher energy efficiency than conventional incandescent light bulbs and the like.

For example, a conventional incandescent light bulb offers an energy efficiency of tens of [lm/W]. In contrast, LEDs, when used as a light source, achieve higher energy efficiency—more specifically, an energy efficiency of 100 [lm/W] or higher (hereinafter, a lamp equipped with the LEDs and designed to replace another light bulb is referred to as an "LED light bulb").

Patent Literature 1 and the like introduce an LED light bulb that can replace a conventional incandescent light bulb. The LED light bulb disclosed in Patent Literature 1 is structured as follows. A substrate, on which a plurality of LEDs have been mounted, is mounted on and secured to an edge surface of an outer shell, inside which a lighting circuit for lighting the LEDs (causing the LEDs to emit light) is disposed. The LEDs are covered by a dome-shaped globe. The LED light bulb is lit when the lighting circuit causes the LEDs to emit light.

This LED light bulb has a similar external shape to a conventional incandescent light bulb and comprises an Edison screw as a power supply terminal. Therefore, this LED light bulb can be attached to a socket of a lighting device to which a conventional incandescent light bulb is customarily attached.

CITATION LIST

Patent Literature

[Patent Literature 1]
Japanese Patent Application Publication No. 2006-313718

SUMMARY OF INVENTION

Technical Problem

However, the problem with conventional lighting devices using LEDs as light sources, such as the above-described LED light bulb, is that it is difficult to simultaneously achieve (i) improvement in the heat dissipation properties while the LEDs are emitting light, and (ii) reduction in size and weight of the lighting devices.

To be more specific, with the conventional structure, the heat generated in the LEDs is dissipated from the LEDs to the substrate, from the substrate to the outer shell on which the substrate has been mounted, and from the outer shell and a housing member, which is in contact with the outer shell, to the outside (the open air) via a heat dissipation path connecting between the outer shell and the housing member.

With the aforementioned conventional structure, the outer shell and the housing member function as so-called heat sinks.

When the aforementioned conventional structure is used, in order to improve the heat dissipation properties, it is necessary to raise the heat capacity by increasing the sizes of the heat sinks, namely the outer shell (on which the substrate has been mounted) and the like. However, increasing the sizes of the outer shell and the like makes it difficult to reduce the size and weight of the lighting device.

Meanwhile, reduction in size and weight of the outer shell and the like leads to deterioration in their functions as heat sinks, i.e., decrease in the heat dissipation properties. This increases the amount of heat stored in the outer shell and the like. Furthermore, reduction in size and weight of the outer shell and the like also makes it difficult to provide sufficient clearance between the outer shell and the lighting circuit. As a result, the heat generated in the LEDs is easily conducted to the lighting circuit, possibly posing an adverse effect on the electronic components of the lighting circuit.

It should be noted that the above problem occurs not only in a case where an LED light bulb is to replace a conventional incandescent light bulb, but also in a case where an LED bulb is to replace other types of light bulbs (e.g., a halogen lamp).

The present invention has been made to solve the above problem. It is an object of the present invention to provide a bulb-type lamp and a lighting device that can lighten thermal load on the lighting circuit even when improvement in the heat dissipation properties and reduction in size and weight of the lighting device have been simultaneously achieved.

Solution to Problem

A bulb-type lamp of the present invention comprises: a light emitting module including a substrate on which at least one light emitting element is mounted; a cylindrically-shaped heat sink that allows dissipation of heat therefrom, the heat being generated by the at least one light emitting element emitting light; a base attached to one end portion of the heat sink; a heat conduction member on a front surface of which the light emitting module is mounted, the heat conduction member closing an opening of the other end portion of the heat sink and allowing conduction of the heat therefrom to the heat sink; a circuit that, upon receiving power via the base, causes the at least one light emitting element to emit the light; and a circuit holder member positioned inside the heat sink, with the circuit disposed inside the circuit holder member, wherein an air space exists (i) between the circuit holder member and the heat sink, and/or (ii) between the circuit holder member and the heat conduction member, and the circuit is isolated from the air space by the circuit holder member, and a fraction S1/S2 satisfies a relationship $0.5 \leqq S1/S2$, where S1 denotes an area of a portion of the heat conduction member that is in contact with the heat sink, and S2 denotes an area of a portion of the heat conduction member that is in contact with the substrate of the light emitting module.

The heat sink denotes a member that has a heat dissipation function, which is the function of allowing dissipation of heat to the open air. The heat conduction member has the function of allowing conduction of the heat from the light emitting module to the heat sink. The heat sink has a superior heat dissipation function than the heat conduction member.

The heat conduction member may close an entirety or part of the opening of the other end portion of the heat sink.

It has been described above that the air space exists between the circuit holder member and the heat sink, and/or between the circuit holder member and the heat conduction member. Here, the air space may exist between an entirety of the inner circumferential surface of the heat sink and the circuit holder member, or between part of the inner circumferential surface of the heat sink and the circuit holder member. Similarly, the air space may exist between an entirety of a back surface of the heat conduction member and the circuit holder member, or between part of the back surface of the heat conduction member and the circuit holder member.

It suffices for the circuit to be substantially isolated from the air space. For example, at the time of disposing the circuit into the circuit holder member, the air inside the circuit holder member naturally flows to the outside of the circuit holder member, and vice versa. Such airflow also occurs via, for example, the clearance that is naturally provided between the circuit holder member and one or more power supply paths that connect between the circuit and the light emitting module. The concept of isolation pertaining to the present invention permits such airflow.

When the substrate of the light emitting module and the heat conduction member are in contact with each other via a separate member such as thermal grease, S2 denotes the smaller one of (i) a portion of the separate member that is in contact with the substrate of the light emitting module and (ii) a portion of the separate member that is in contact with the heat conduction member.

Advantageous Effects of Invention

With the above structure, the air space exists between the circuit holder member and the heat sink, and/or between the circuit holder member and the heat conduction member, with the result that the lighting circuit is isolated from the air space by the circuit holder member. This reduces the amount of heat conducted from the heat sink to the lighting circuit, and lightens thermal load on the electronic components of the lighting circuit.

Because the air space exists between the circuit holder member and the heat sink, and/or between the circuit holder member and the heat conduction member, the heat generated in the light emitting module and the lighting circuit is not easily stored inside the light emitting module and the lighting circuit.

With the above structure, the fraction S1/S2 satisfies the relationship $0.5 \leqq S1/S2$, where S1 denotes an area of a portion of the heat conduction member that is in contact with the heat sink, and S2 denotes an area of a portion of the heat conduction member that is in contact with the substrate of the light emitting module. This way, the heat can be efficiently conducted from the light emitting module to the heat sink.

As the heat conduction member allows efficient conduction of heat to the heat sink, it is possible to suppress the heat from being stored in the heat conduction member. The above structure not only improves the heat dissipation properties of a lighting device as a whole, but also allows making the heat conduction member thin. As a result, size and weight of the lighting device itself can be reduced.

In the bulb-type lamp, the fraction S1/S2 satisfies a relationship $1.0 \leqq S1/S2 \leqq 2.5$. This structure allows efficient conduction of heat from the light emitting module to the heat sink. As a result, size and weight of the lighting device itself can be reduced.

In the bulb-type lamp, the heat conduction member has a recess at the front surface thereof, and the substrate of the light emitting module is mounted in the recess. The above structure makes it easy to position the light emitting module on the heat conduction member.

In the bulb-type lamp, (i) the heat conduction member has a shape of a circular plate, (ii) an outer circumferential surface of the heat conduction member and an inner circumferential surface of the heat sink are in contact with each other, and (iii) an entirety of the outer circumferential surface of the heat conduction member is in contact with the inner circumferential surface of the heat sink. The above structure makes it easy for the heat of the light emitting module to be uniformly conducted to the heat sink. Consequently, the heat conducted from the heat conduction member can be efficiently dissipated from the heat sink.

Although the heat sink needs to have the function of allowing efficient dissipation of the heat conducted from the heat conduction member, the heat sink does not need to have the function of storing the heat therein. Therefore, there is no need to make the heat sink with a thick wall thickness. The heat sink may have any wall thickness, as long as the heat is efficiently conducted to an entirety of the heat sink. For example, the heat sink may have a wall thickness of 1 mm or less. As a result, the weight of the lighting device can be reduced.

In the bulb-type lamp, a thickness of the portion of the heat conduction member that is in contact with the substrate is greater than or equal to a thickness of the substrate, and is smaller than or equal to a thickness that is three times the thickness of the substrate. With this structure, the heat conduction member can be made thin, and sufficient clearance can be provided between the lighting circuit (circuit holder) and the heat conduction member. Accordingly, the heat poses no detrimental effect on the electronic components of the lighting circuit.

In the bulb-type lamp, a thickness of a portion of the heat conduction member on which the light emitting module is mounted is greater than a wall thickness of the heat sink. This structure allows effective conduction of heat from the light emitting module to the heat sink. As a result, both of the heat sink and the heat conduction member can be made thin.

Alternatively, in the bulb-type lamp, at least one through hole is provided in the heat sink. According to this structure, the air inside the heat sink and the air outside the heat sink are linked to each other, and therefore the heat of the heat sink can be conducted to the air that flows between the inside and outside of the heat sink. As a result, the heat dissipation properties of the heat sink are further improved.

In the bulb-type lamp, a surface of the substrate on which the at least one light emitting element is mounted is positioned farther from the base than a virtual edge surface of the heat sink is, the virtual edge surface of the heat sink being a virtual surface that is flush with a tip of the other end portion of the heat sink. Alternatively, in the bulb-type lamp, of all portions of the heat conduction member, at least the front surface thereof on which the light emitting module is mounted is positioned farther from the base than a virtual edge surface of the heat sink is, the virtual edge surface of the heat sink being a virtual surface that is flush with a tip of the other end portion of the heat sink. With the above structures, light can be output toward the rear side of the light emitting module (toward the base).

In the bulb-type lamp, a surface of the substrate on which the at least one light emitting element is mounted is positioned closer to the base than a virtual edge surface of the heat sink is, the virtual edge surface of the heat sink being a virtual surface that is flush with a tip of the other end portion of the heat sink. Alternatively, in the bulb-type lamp, (i) the heat conduction member has a recess, and the light emitting module is mounted in the recess, and (ii) the front surface of the heat conduction member in the recess, on which the light emitting module is mounted, is positioned closer to the base than a virtual edge surface of the heat sink is, the virtual edge surface of the heat sink being a virtual surface that is flush with a tip of the other end portion of the heat sink. With the above structures, the beam angle of light emitted from the lighting device can be made small. As a result, for example, illuminance of light that is emitted from the lighting device directly toward the front side of the lighting device can be improved.

In the bulb-type lamp, an inner circumferential surface of the recess is reflective. The above structure allows collecting light emitted from the LED module, and improves the lamp efficiency.

In the bulb-type lamp, (i) the circuit holder member is attached to the heat sink, and (ii) the heat conduction member is connected to the circuit holder member. With the above structure, the heat conduction member is indirectly attached to the heat sink. This prevents the heat conduction member from falling off the heat sink.

In the bulb-type lamp, (i) the circuit holder member includes: a holder body that has an opening in at least one end thereof and is attached to the heat sink; and a cap that closes the opening of the holder body and is connected to the heat conduction member, (ii) the heat conduction member is inserted into the heat sink through the other end portion of the heat sink, and (iii) the cap is attached to the holder body in such a manner that the cap is movable in a direction along which the heat conduction member is inserted into the heat sink. With the above structure, the cap and the body of the circuit holder member are attached to each other in such a manner that the cap is movable in the direction along which the heat conduction member is inserted into the heat sink. Thus, changes in the position of the heat conduction member within the heat sink are permissible. In other words, the position of the heat conduction member within the heat sink may vary in different lamps.

In the bulb-type lamp, (i) the heat sink has a multilayer structure composed of at least the following two layers: (a) an outermost layer forming an outer circumferential surface of the heat sink; and (b) an innermost layer forming the inner circumferential surface of the heat sink, and (ii) an outer surface of the outermost layer has higher emissivity than an inner surface of the innermost layer. With the above structure, there is a different between the emissivity of the outermost layer and the emissivity of the innermost layer. This fosters radiation of heat from the outer surface of the outermost layer, and suppresses radiation of heat from the inner surface of the innermost layer.

In the bulb-type lamp, the heat sink and the base are thermally connected to each other via a filler in the base. The above structure allows the heat conducted from the light emitting module to be efficiently conducted to the base member.

A lighting device of the present invention comprises: a bulb-type lamp; and a lighting fixture to/from which the bulb-type lamp is attachable/detachable, wherein the bulb-type lamp is the above-described bulb-type lamp.

BRIEF DESCRIPTION OF DRAWINGS

FIG. 4A is a cross-sectional view of the circuit holder, and FIG. 4B shows a cross section taken along a line Y-Y of FIG. 4A when viewed in a direction of arrows B.

FIG. 6A illustrates one example of the mount members used in the test, and FIG. 6B shows measurement results obtained from the test.

FIG. 12A shows data of the measured temperatures, and FIG. 12B is a bar graph showing measurement results.

FIG. 17A is a cross-sectional view of such a mount member, and FIG. 17B is a cross-sectional view of part of an LED light bulb comprising such a mount member.

DESCRIPTION OF EMBODIMENTS

The following describes bulb-type lamps pertaining to exemplary embodiments of the present invention with reference to the drawings.

First Embodiment

1. Structure

Figure 1:
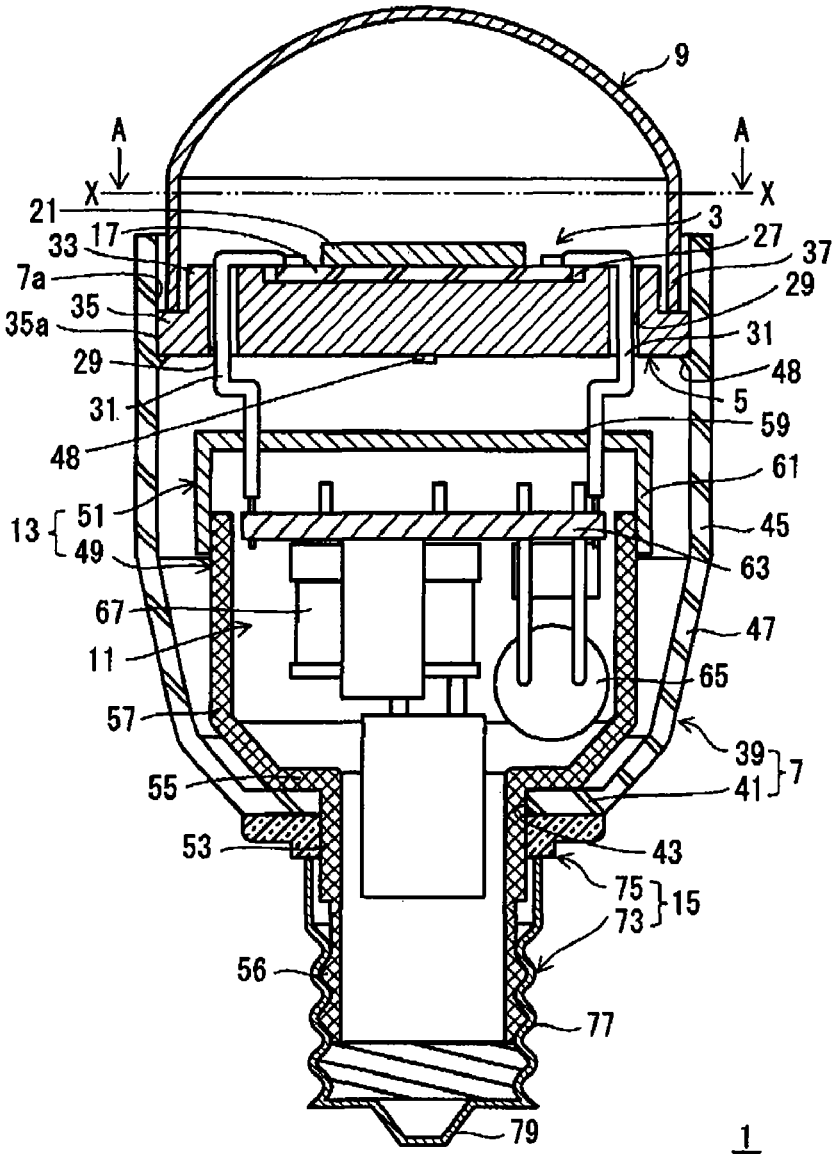
FIG. 1 is a longitudinal cross-sectional view of a bulb-type lamp pertaining to First Embodiment of the present invention.
Figure 2:
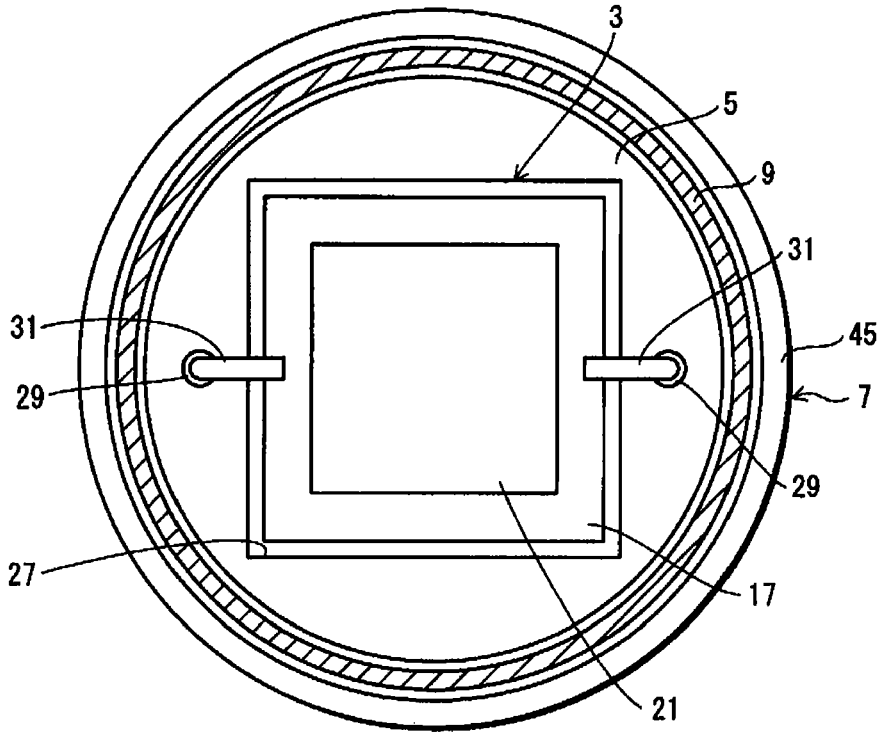
FIG. 2 shows a cross section taken along a line X-X of FIG. 1 when viewed in a direction of arrows A.

FIG. 1 is a longitudinal cross-sectional view of a bulb-type lamp pertaining to First Embodiment of the present invention. FIG. 2 shows a cross section taken along a line X-X of FIG. 1 when viewed in a direction of arrows A.

As shown in FIG. 1, a bulb-type lamp (hereinafter referred to as an "LED light bulb") 1 is composed of (i) an LED module 3 comprising a plurality of LEDs 19 as a light source, (ii) a mount member 5 on which the LED module 3 has been mounted, (iii) a case 7, to a first end portion thereof the mount member 5 is attached, (iv) a globe 9 that covers the LED module 3, (v) a lighting circuit 11 that lights the LEDs (19) (causes the LEDs (19) to emit light), (vi) a circuit holder 13 positioned inside the case 7, with the lighting circuit 11 disposed inside the circuit holder 13, and (vii) a base member 15 attached to a second end portion of the case 7. The LEDs 19, the LED module 3, the mount member 5, the case 7, the lighting circuit 11, the circuit holder 13, and the base member 15 correspond to the "light emitting elements", "light emitting module", "heat conduction member", "heat sink", "circuit", "circuit holder member", and "base" of the present invention, respectively.

(1) LED Module 3

Figure 3:
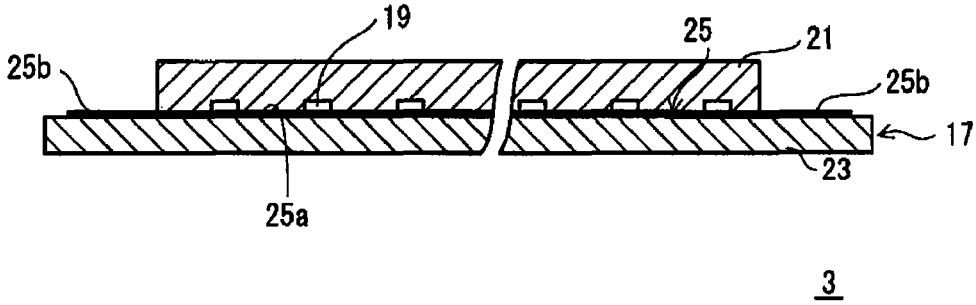
FIG. 3 is a cross-sectional view of an LED module.

FIG. 3 is a cross-sectional view of the LED module.

The LED module 3 is composed of a substrate 17, a plurality of LEDs 19 mounted on a main surface of the substrate 17, and a sealing member 21 for covering the LEDs 19. Note that the number of the LEDs 19, the method for connecting the LEDs 19 with one another (series connection or parallel connection), etc. are determined depending on, for example, desired luminous flux of the LED light bulb 1. The main surface of the substrate 17, on which the LEDs 19 have been mounted, is also referred to as an "LED-mounted surface".

The substrate 17 is composed of a substrate body 23 made of an insulation material, and a wiring pattern 25 formed on a main surface of the substrate body 23. The wiring pattern 25 includes (i) a connecting portion 25*a* that connects between the LEDs 19 using a predetermined connection method, and (ii) terminal portions 25*b* that connect to power supply paths (lead wires) connected to the lighting circuit 11.

The LEDs 19 are semiconductor light emitting elements that each emit light of a certain color.

The sealing member 21 seals the LEDs 19 so that the LEDs 19 are not exposed to the open air. The sealing member 21 is made of, for example, a translucent material and a conversion material that converts the wavelength of the light emitted by the LEDs 19 to a predetermined wavelength.

As specific examples, the substrate 17 is made of a resin material, a ceramic material, or the like. It is preferable that the substrate 17 be made of a material having high thermal conductivity. In a case where the LED light bulb 1 is intended to replace another incandescent light bulb, GaN LEDs that emit blue light are used as the LEDs 19, for example. Also, in this case, a silicone resin and silicate phosphors ($(Sr,Ba)_2SiO_4:Eu^{2+}$,$Sr_3SiO_5:Eu^{2+}$) are respectively used as the translucent material and the conversion material, for example. Consequently, the LED module 3 emits white light.

The LEDs 19 are mounted on the substrate 17 so they are arrayed, for example, in a matrix. There are a total of forty-eight LEDs 19, arrayed with eight rows and six columns. The LEDs 19 are electrically connected to one another.

(2) Mount Member 5

The LED module 3 is mounted on the mount member 5. The mount member 5 closes the first end portion of the case 7, which has a cylindrical shape as described later (herein, the terms "cylinder" and "cylindrical" refer to any tubular or columnar shape, and are not limited to referring to a circular cylindrical shape). As shown in FIGS. 1 and 2, the mount member 5 has a shape of a circular plate, for example, and is fit inside the first end portion of the case 7. The LED module 3 is mounted on a surface of the mount member 5 facing the outside (in FIG. 1, the upper side) of the case 7 (this surface of the mount member 5 is regarded a front surface thereof). In the present embodiment, the mount member 5 has a shape of a circular plate because the case 7 has a cylindrical shape.

A recess 27, in which the LED module 3 is mounted, is formed in the front surface of the mount member 5. The LED module 3 is mounted on the mount member 5 with the bottom surface of the recess 27 and the substrate 17 of the LED module 3 in surface contact with each other. Here, the LED module 3 may be mounted on the mount member 5 by, for example, directly securing the LED module 3 to the mount member 5 with the use of fixing screws, or attaching the LED module 3 to the mount member 5 with the aid of a leaf spring and the like. Presence of the recess 27 enables easy and accurate positioning of the LED module 3.

The mount member 5 has through holes 29 that penetrate through the mount member 5 in a thickness direction thereof. Power supply paths 31 from the lighting circuit 11 pass through the through holes 29 and are electrically connected to the terminal portions 25*b* of the substrate 17, respectively. Note that there should be at least one through hole 29. In a case where there is only one through hole 29, the two power supply paths (31) pass through one through hole (29). On the other hand, in a case where there are two through holes 29, each of the two power supply paths 31 passes through a different one of the through holes 29.

The mount member 5 is made up of a small diameter portion 33 that has a small outer diameter, and a large diameter portion 35 that has a greater outer diameter than the small diameter portion 33. An outer circumferential surface 35*a* of the large diameter portion 35 is in contact with an inner circumferential surface 7*a* of the case 7. A tip 37 of the globe 9 at an opening of the globe 9 is inserted in a space between the inner circumferential surface 7*a* of the case 7 and the small diameter portion 33, and secured in this space by using an adhesive material or the like.

(3) Case 7

The case 7 has a cylindrical shape as shown in FIG. 1. The outer diameter of the case 7 gradually decreases from the first end portion toward the second end portion of the case 7. The mount member 5 and the base member 15 are attached to the first end portion and the second end portion of the case 7, respectively. The circuit holder 13 is positioned inside the case 7. The lighting circuit 11 is held (disposed) inside the circuit holder 13.

In the present embodiment, the case 7 is made up of a cylindrical wall 39 and a bottom wall 41 that is contiguous with one end of the cylindrical wall 39. A through hole 43 is provided in a central portion of the bottom wall 41 (including the central axis of the cylindrical wall 39).

The cylindrical wall 39 is made up of a straight portion 45 and a tapered portion 47. The straight portion 45 has a substantially uniform inner diameter from one end to the other end thereof along the central axis of the cylindrical wall 39. An inner diameter of the tapered portion 47 gradually decreases from one end toward the other end of the tapered portion 47 along the central axis of the cylindrical wall 39.

The heat generated while the LEDs 19 are being lit is conducted from the substrate 17 of the LED module 3 to the mount member 5, and from the mount member 5 to the case 7. After the heat has been conducted to the case 7, the heat is primarily dissipated to the open air. As such, the case 7 functions as a heat sink because it has a heat dissipation function, which allows dissipation of the heat generated while the LEDs 19 are being lit to the open air. The mount member 5 functions as a heat conduction member because it has a heat conduction function, which allows conduction of the heat from the LED module 3 to the case 7.

The mount member 5 is attached to the case 7 by, for example, pressing the mount member 5 into the first end portion of the case 7. When pressing the mount member 5, the position of the mount member 5 is determined due to stoppers 48 formed on the inner circumferential surface of the case 7. There are a plurality of (for example, three) stoppers 48. The stoppers 48 are formed at equal intervals in the circumferential direction of the case 7.

The mount member 5 and the case 7 maintain the following positional relationship: a surface of a portion of the mount member 5 on which the LED module 3 is mounted is positioned more inward (closer to the base member 15 along the direction in which the central axis of the case 7 extends) than an edge surface of the first end portion of the case 7 is. Here, the edge surface of the first end portion of the case 7 is a virtual edge surface that is flush with a tip of the case 7 at the opening of the case 7, and corresponds to a virtual edge surface pertaining to the invention of the present application.

The LED-mounted surface of the substrate 17 of the LED module 3, on which the LEDs 19 have been mounted, is also positioned more inward than the edge surface of the first end portion of the case 7 is. In the above manner, for example, only part of the light emitted from the LED module 3 that is not shielded by the tip of the case 7 at the opening of the case 7 is output from the LED light bulb 1. This way, the LED light bulb 1 can be used in a lighting device that emits spotlight.

(4) Circuit Holder 13

The lighting circuit 11 is disposed inside the circuit holder 13. The circuit holder 13 is made up of a holder body 49 and a cap 51 that closes an opening of the holder body 49.

As shown in FIG. 1, the holder body 49 is made up of a protruding cylindrical portion 53, a bottom portion 55, and a large diameter cylindrical portion 57. The protruding cylindrical portion 53 protrudes from the inside toward the outside of the case 7 via the through hole 43 provided in the bottom wall 41 of the case 7. The bottom portion 55 is in contact with an inner surface of the bottom wall 41 of the case 7. The large diameter cylindrical portion 57 extends from an outer circumferential rim of the bottom portion 55 toward a direction opposite from the direction toward which the protruding cylindrical portion 53 protrudes. The cap 51 closes an opening of the large diameter cylindrical portion 57. The protruding cylindrical portion 53 includes a thread 56 on the outer circumferential surface thereof (herein, the term "thread" refers to a screw thread wrapped around a screw). The thread 56 is to be screwed and fit into a base portion 73 of the base member 15.

As shown in FIG. 1, the cap 51 has a shape of a cylinder with a bottom, and is made up of a cap portion 59 and a cylindrical portion 61. For example, the cylindrical portion 61 is fit around the large diameter cylindrical portion 57 of the holder body 49. In other words, the inner diameter of the cylindrical portion 61 of the cap 51 fits the outer diameter of the large diameter cylindrical portion 57 of the holder body 49. Once the cap 51 and the holder body 40 have been assembled together, the inner circumferential surface of the cylindrical portion 61 of the cap 51 and the outer circumferential surface of the large diameter cylindrical portion 57 of the holder body 49 are brought in contact with each other.

Note that the cap 51 and the holder body 49 may be, for example, (i) secured to each other by an adhesive material, (ii) secured to each other by a latch unit, which is a combination of a latching part and a latched part, (iii) screwed and fit to each other by using a screw provided therein, or (iv) secured to each other by fitting the cylindrical portion 61 of the cap 51 around the large diameter cylindrical portion 57 of the holder body 49 (press fitting), with the inner diameter of the cylindrical portion 61 of the cap 51 made smaller than the outer diameter of the large diameter cylindrical portion 57 of the holder body 49.

Figure 4A:
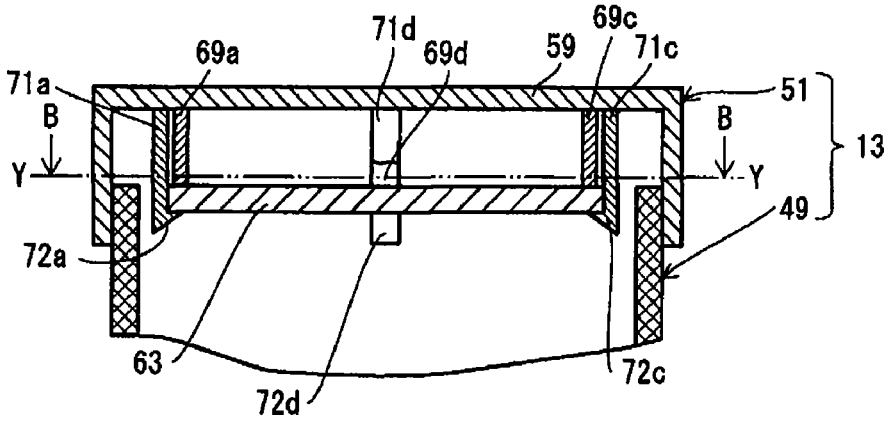
FIGS. 4A and 4B illustrate how a substrate of a circuit holder is attached.
Figure 4B:
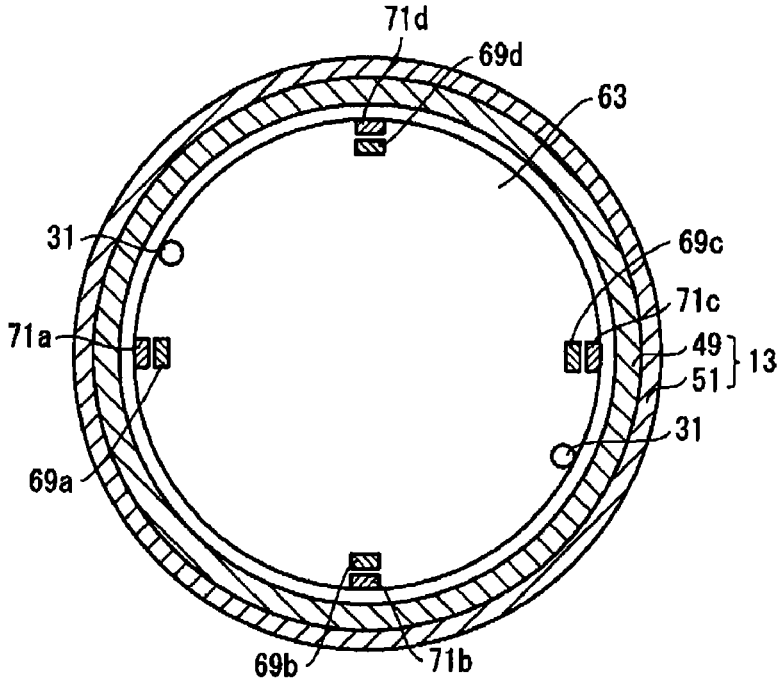

FIGS. 4A and 4B illustrate how the substrate of the circuit holder is attached. FIG. 4A is a cross section of the circuit holder, and FIG. 4B shows a cross section taken along a line Y-Y in FIG. 4A when viewed in a direction of arrows B.

Note that electronic components 65 and the like mounted on the substrate are omitted from the illustration of FIG. 4A, so that a mounting method for the substrate can easily be understood.

A substrate 63, on which the electronic components 65 and the like have been mounted, is held by a clamp mechanism of the circuit holder 13, the clamp mechanism being composed of adjustment arms and latching pawls.

More specifically, two or more (e.g., four) adjustment arms 69*a*, 69*b*, 69*c* and 69*d* and two or more (e.g., four) latching pawls 71*a*, 71*b*, 71*c* and 71*d* are provided in such a manner that they protrude from the cap portion 59 of the cap 51 toward the lighting circuit 11.

As shown in FIG. 4A, tip portions (end portions) of the latching pawls 71*a*, 71*b*, 71*c* and 71*d* facing the lighting circuit 11 include sloped surfaces 72*a*, 72*b*, 72*c* and 72*d*. The farther the sloped surfaces 72*a*, (72*b*) 72*c* and 72*d* are from the lighting circuit 11 (i.e., the closer the sloped surfaces 72*a*, (72*b*) 72*c* and 72*d* are to the cap portion 59), the closer they become to the central axis of the circuit holder 13.

The substrate 63 is pressed toward the cap portion 59 with the substrate 63 in contact with the sloped surfaces 72*a*, 72*b*, 72*c* and 72*d* at the tip portions of the latching pawls 71*a*, 71*b*, 71*c* and 71*d*. As a result, the latching pawls 71*a*, 71*b*, 71*c* and 71*d* are stretched outward along the diameter direction of the circuit holder 13, and the circumferential rim of the substrate 63 eventually latches with the latching pawls 71*a*, 71*b*, 71*c* and 71*d*. At this time, the adjustment arms 69*a*, 69*b*, 69*c* and 69*d* determine (support) the position of a surface of the substrate 63 facing the cap portion 59.

Note that the adjustment arms 69*a*, 69*b*, 69*c* and 69*d* and the two or more (e.g., four) latching pawls 71*a*, 71*b*, 71*c* and 71*d* are formed at equal intervals in the circumferential direction.

The details of how the circuit holder 13 is attached to the case 7 will be described later. Briefly speaking, the circuit holder 13 is attached to the case 7 by causing the bottom portion 55 of the holder body 49 and the base member 15 to hold the bottom wall 41 of the case 7 therebetween. Consequently, clearance is provided (i) between (a) (outer surfaces of) portions of the circuit holder 13 other than the bottom portion 55 and the protruding cylindrical portion 53 and (b) the inner circumferential surface of the case 7, and (ii) between (a) (the outer surfaces of) the portions of the circuit holder 13 other than the bottom portion 55 and the protruding cylindrical portion 53 and (b) a back surface of the mount member 5. An air space exists in such clearance.

(5) Lighting Circuit 11

The lighting circuit 11 lights the LEDs 19 by using commercial electric power supplied via the base member 15. The lighting circuit 11 is composed of a plurality of electronic components 65 and 67, etc. mounted on the substrate 63. For example, the lighting circuit 11 is composed of a rectifying/smoothing circuit, a DC/DC converter, and the like. Note that the plurality of electronic components are assigned the reference numbers "65" and "67" for convenience.

The electronic components 65 and 67 are mounted on one of main surfaces of the substrate 63. The substrate 63 is held by the circuit holder 13 with the electronic components 65 and 67 opposing the protruding cylindrical portion 53 of the holder body 49. The power supply paths 31 connected to the LED module 3 are attached to the other one of the main surfaces of the substrate 63.

(6) Globe 9

The globe 9 has a shape of, for example, a dome. The globe 9 is attached to the case 7 and the like in such a manner that the globe 9 covers the LED module 3. In the present embodiment, the tip 37 of the globe 9 at the opening of the globe 9 is inserted in the space between the inner circumferential surface of the case 7 and the small diameter portion 33 of the mount member 5. The globe 9 is secured to the case 7 by an adhesive material (not illustrated) disposed in the space between the case 7 and the small diameter portion 33, with the tip 37 of the globe 9 in contact with the large diameter portion 35.

(7) Base Member 15

The base member 15 is attached to a socket of a lighting fixture (see FIG. 33) to receive power supply via the socket. In the present embodiment, the base member 15 is made up of (i) the base portion 73, which is an Edison screw, and (ii) a flange portion 75 that extends outward in the diameter direction of the case 7, from a rim of the base portion 73 at an opening of the base portion 73. Note that the illustration of a connector line that electrically connects between the lighting circuit 11 and the base portion 73 is omitted from FIG. 1.

The base portion 73 is made up of (i) a shell 77 with a thread and (ii) an electrical contact (eyelet) 79 positioned at a tip of the base portion 73. The thread 56 of the circuit holder 13 is screwed and fit into the shell 77.

2. Assembly

Figure 5C:
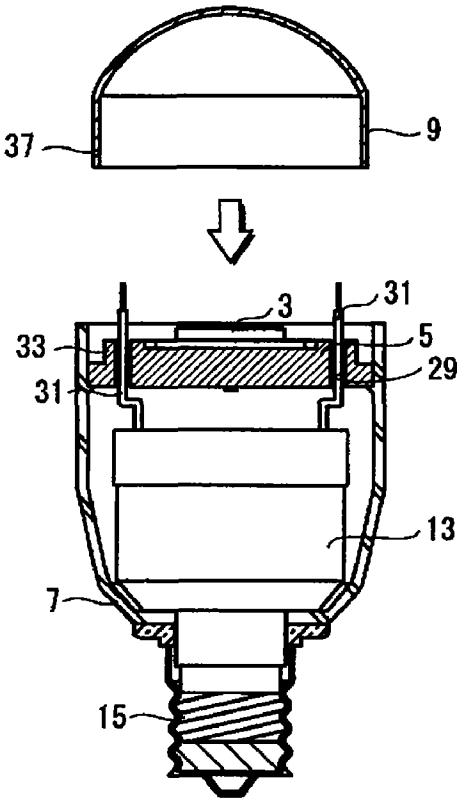
FIGS. 5A, 5B and 5C show a method for assembling an LED light bulb pertaining to First Embodiment.
Figure 5B:
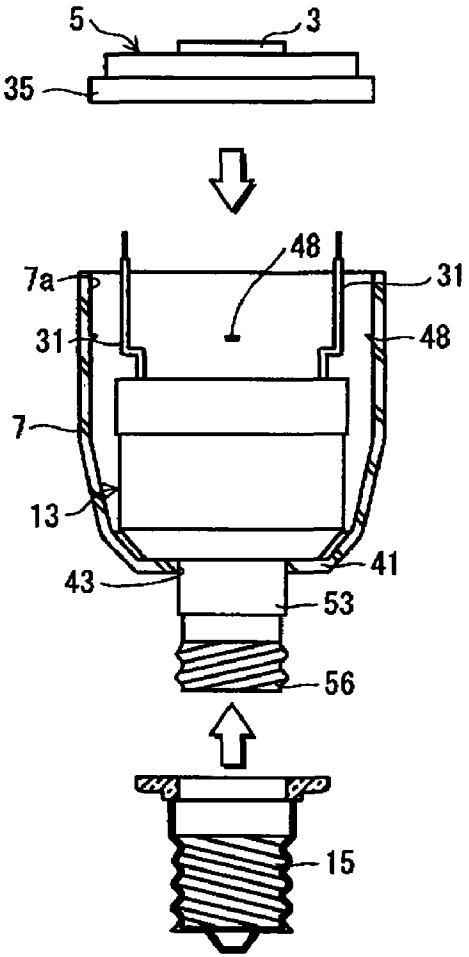
Figure 5A:
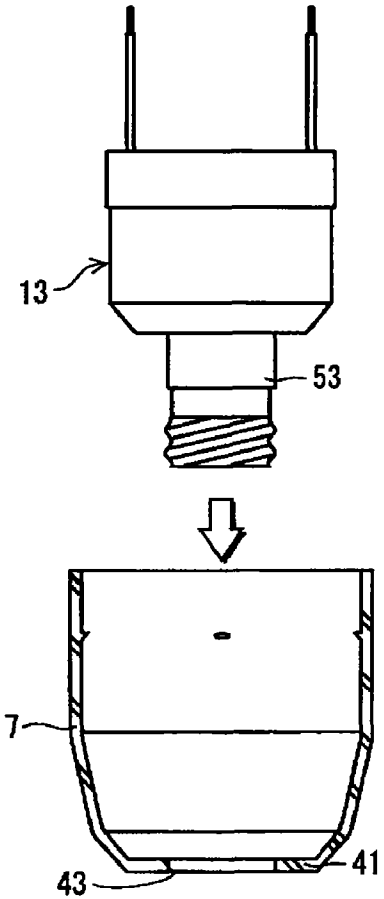

FIGS. 5A, 5B and 5C show a method for assembling the LED light bulb pertaining to First Embodiment.

First, the circuit holder 13, inside which the lighting circuit 11 is disposed, and the case 7 are prepared. Next, as shown in FIG. 5A, the circuit holder 13 is inserted into the case 7, so that the protruding cylindrical portion 53 thereof penetrates through the through hole 43 of the bottom wall 41 and protrudes from the inside toward the outside of the case 7.

Then, as shown in FIG. 5B, the protruding cylindrical portion 53 of the circuit holder 13 that protrudes via the through hole 43 of the case 7 is covered by the base member 15. With the protruding cylindrical portion 53 thus covered by the base member 15, the base member 15 is rotated along the thread 56 on the outer circumferential surface of the protruding cylindrical portion 53. It goes without saying that alternatively, the circuit holder 13 may be rotated instead of the base member 15, or the base member 15 and the circuit holder 13 may be rotated simultaneously.

As the thread 56 is screwed and fit into the base member 15, the base member 15 approaches the bottom wall 41 of the case 7. By further rotating the base member 15, the bottom wall 41 of the case 7 is held between (the bottom portion 55 of) the holder body 49 of the circuit holder 13 and the flange portion 75 of the base member 15. Consequently, the case 7, the circuit holder 13 and the base member 15 are assembled into a single integrated component.

When assembling together the case 7, the circuit holder 13 and the base member 15, the above-described method allows holding the bottom wall 41 of the case 7 between the circuit holder 13 and the base member 15, which approach each other by the former being screwed and fit into the latter. As the above-described method does not require an adhesive material or the like, it allows for an efficient and low-cost assembly.

Next, the mount member 5 on which the LED module 3 has been mounted (attached) is prepared. As shown in FIG. 5B, with the LED module 3 positioned at a front side of the mount member 5, the power supply paths 31 extending from the circuit holder 13 are inserted through the through holes 29 of the mount member 5, and thereafter the mount member 5 is pushed through the opening of the case 7 toward the circuit holder 13 (the front side of the mount member 5 is opposite from a side of the mount member 5 that faces the circuit holder 13).

The stoppers 48 are provided on the inner circumferential surface 7*a* of the case 7 to restrict the mount member 5 from proceeding past the stoppers 48. Therefore, the mount member 5 is pushed into the case 7 until it comes in contact with the stoppers 48.

The inner diameter of the first end portion of the case 7 at the opening of the case 7 and the outer diameter of the large diameter portion 35 of the mount member 5 have the following relationship: the case 7 and the large diameter portion 35 are press-fit to each other with the mount member 5 set inside the case 7. Therefore, an adhesive material or the like is not required to attach the case 7 and the mount member 5 to each other. This not only allows for efficient and low-cost assembly of the case 7 and the mount member 5, but also improves adhesion between the inner circumferential surface 7*a* of the case 7 and the outer circumferential surface of the mount member 5. Consequently, the heat can be efficiently conducted from the mount member 5 to the case 7.

As shown in FIG. 5C, once the mount member 5 has been attached to the case 7, the power supply paths 31 that pass through the through holes 29 of the mount member 5 and run above the mount member 5 are electrically connected to the terminal portions (25*b*) of the LED module 3. Thereafter, the tip 37 of the globe 9 at the opening of the globe 9 is inserted in the space between the inner circumferential surface 7*a* of the case 7 and the outer circumferential surface of the small diameter portion 33 of the mount member 5, and secured by the adhesive material or the like.

Once the globe 9 has been attached to the case 7, manufacture of the LED light bulb 1 is completed.

3. Heat Characteristics (1) Thermal Conductivity

In the LED light bulb 1 pertaining to First Embodiment, the heat generated in the LED module 3 while the LED module 3 is being lit (while the LED module 3 is emitting light) is conducted from the LED module 3 to the mount member 5, and further from the mount member 5 to the case 7.

The following describes the relationship between the thickness and thermal conductivity of the mount member.

To be more specific, the inventors of the present invention created different sample LED light bulbs. Each of the sample LED light bulbs had the same contact area at which the mount member and the case were in contact with each other, and the same contact area at which the LED module and the mount member were in contact with each other. However, portions of the mount members on which the LED modules were mounted were different in thickness between the sample LED light bulbs (see FIG. 6A). The inventors supplied power of different watts to the sample LED light bulbs, and measured the temperature (junction temperature) of the LEDs for each watt.

Figure 6A:
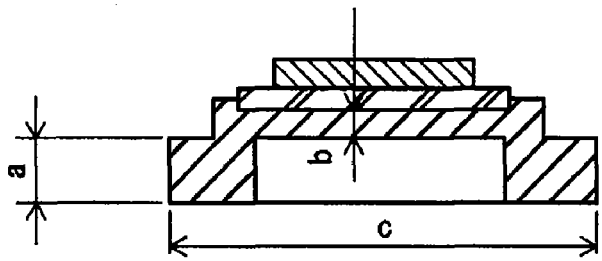
FIGS. 6A and 6B illustrate the relationship between the thickness and thermal conductivity of a mount member.
Figure 6B:
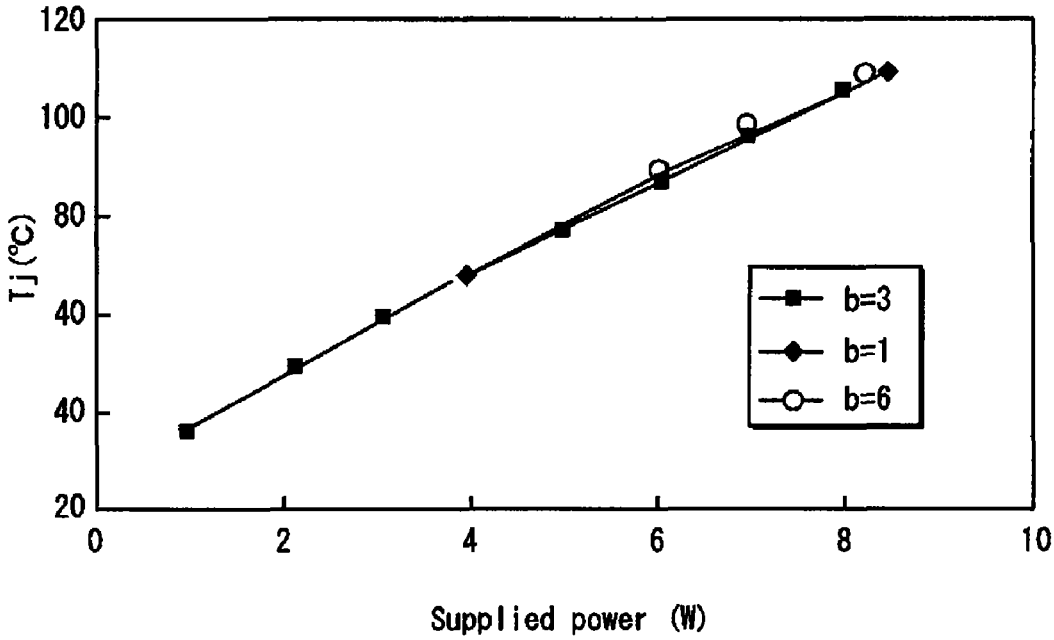

FIGS. 6A and 6B illustrate the relationship between the thickness and thermal conductivity of the mount member. FIG. 6A illustrates one example of the mount members used in the test, and FIG. 6B shows measurement results obtained from the test.

Each of the mount members used in the test had a shape of a circular plate having an outer diameter of 38 [mm] and was made of aluminum (the outer diameter is denoted as "c" in FIG. 6A). Also, the cases used in the test had the following measurements. Portions of the cases at which the mount members were attached had an inner diameter of 38 [mm], an outer diameter of 40 [mm], a wall thickness of 1 [mm], and an envelope volume of approximately 42 [cc]. The cases were made of aluminum.

The inventors prepared three types of mount members. The portions of these mount members on which the LED modules were mounted had thicknesses "b" of 1 [mm], 3 [mm] and 6 [mm], respectively (see FIG. 6A). In each of the mount members, an area of a portion of the mount member that was in contact with the case (i) had a height "a" of 4 [mm] in the central axis direction of the case, and (ii) was 480 [$mm^2$]. In each of the mount members, an area of a portion of the mount member that was in contact with the LED module was 440 [$mm^2$].

Each of the LED modules (to be exact, substrates) had a shape of a square with each of its sides being 21 [mm]. Each of the substrates had a thickness of 1 [mm].

As shown in FIG. 6B, in each of the three mount members 5, the temperature of the LEDs measured while the sample LED light bulb was being lit had a tendency to rise as the power supplied to the sample LED light bulb increased, regardless of the thicknesses "b" of the mount members 5. It is presumed that the actual power to be supplied to the sample LED light bulbs used in the test is in a range of 4 [W] to 8 [W].

Furthermore, the measurement results show that when the same power is supplied to the sample LED light bulbs, the difference in the thicknesses of the mount members 5 causes almost no difference in the temperatures of the LEDs.

For the above reasons, in order to reduce weight of the lighting device, it is preferable that the mount member 5 be as thin as possible (the specifics of the thickness of the mount member 5 will be described later).

Hence, the mount member 5 should have a thickness that (i) allows the LED module to be mounted thereon, and (ii) in a case where a press-in method is employed to attach the mount member 5 to the case 7, gives the mount member 5 mechanical properties to resist the load applied by the press-in.

(2) Heat Dissipation Properties

According to the LED light bulb pertaining to First Embodiment, the heat generated in the LED module while the LED module is being lit (while the LED module is emitting light) is conducted from the LED module to the mount member, and from the mount member to the case. Thereafter, the heat is dissipated from the case to the open air.

In view of the heat dissipation properties—i.e., dissipation of the heat generated in the LED module from the case, it is preferable for the fraction S1/S2 to be larger than or equal to 0.5, where S1 denotes an area of a portion of the mount member that is in contact with the case, and S2 denotes an area of a portion of the mount member that is in contact with the LED module (hereinafter the fraction S1/S2 may be referred to as a "contact area fraction S1/S2").

Figure 7:
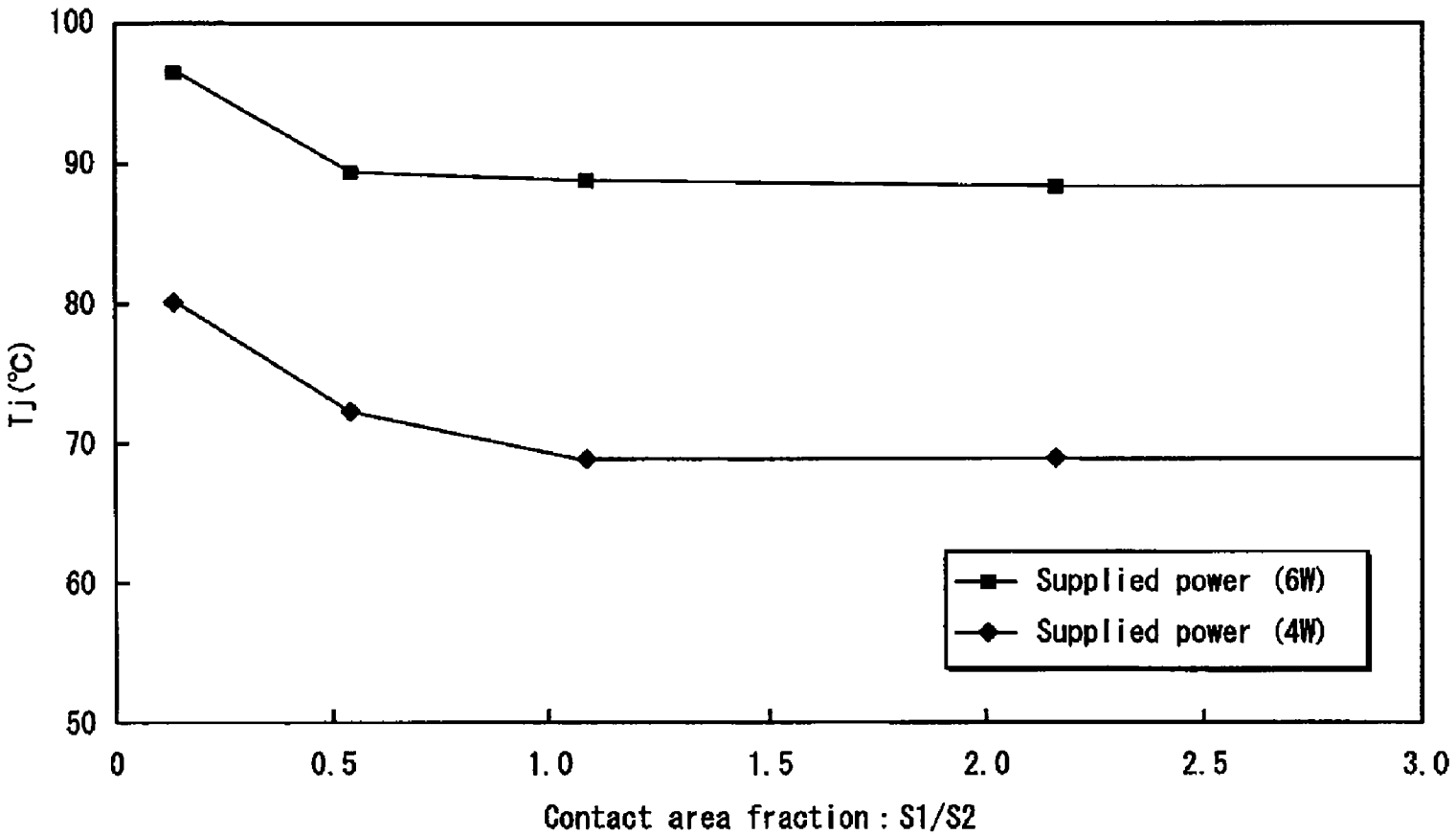
FIG. 7 shows how the temperature of LEDs is affected by the fraction of (i) an area of a portion of the mount member that is in contact with a case, to (ii) an area of a portion of the mount member that is in contact with the LED module.

FIG. 7 shows how the temperature of the LEDs is affected by the ratio of the area of the portion of the mount member that is in contact with the case to the area of the portion of the mount member that is in contact with the LED module.

In the test, the inventors lit the LED light bulb with two predetermined types of power supply, and measured/evaluated the temperature (junction temperature: Tj) of the LEDs in the LED module for each type of power supply.

Four LED light bulbs were used in the test. The contact area fractions S1/S2 of the four LED light bulbs were 0.1, 0.5, 1.1 and 2.2, respectively. The two types of power supplied to the four LED light bulbs were 6-watt power and 4-watt power.

It is apparent from FIG. 7 that, both when the LED light bulbs were lit with a power supply of 6 [W] and when the LED light bulbs were lit with a power supply of 4 [W] (that is, regardless of the power supply), the temperature of the LEDs decreases as the contact area fraction S1/S2 increases.

It is also apparent from FIG. 7 that (i) when the contact area fraction S1/S2 is smaller than 0.5, the temperature of the LEDs decreases to a great extent as the contact area fraction S1/S2 changes, and (ii) when the contact area fraction S1/S2 is larger than or equal to 0.5, the decrease in the temperature of the LEDs is moderate despite of the increase in the contact area fraction S1/S2.

FIG. 7 further shows that when the contact area fraction S1/S2 is larger than or equal to 1.0, the temperature of the LEDs barely decreases even if the contact area fraction S1/S2 increases. The temperature of the LEDs barely decreases especially when the contact area fraction S1/S2 is large. The temperature of the LEDs measured when the contact area fraction S1/S2 is 1.0, and the temperature of the LEDs measured when the contact area fraction S1/S2 is 2.2, have a difference of 1° C. or lower—i.e., there is almost no difference in these temperatures.

There is almost no change in the temperature of the LEDs when the contact area fraction S1/S2 is larger than or equal to 2.5. It is assumed that there is no decrease in the temperature of the LEDs when the contact area fraction S1/S2 is larger than 3.0.

Regarding the heat dissipation properties, the above test results indicate that the contact area fraction S1/S2 is preferably 0.5 or larger (in a case where the mount member has a sufficient capacity with respect to the heat generated in the LED module), or more preferably, 1.0 or larger (in a case where the mount member does not have a sufficient capacity with respect to the heat generated in the LED module).

Furthermore, it is preferable for the contact area fraction S1/S2 to be 1.1 or larger in order to lower the temperature of the LEDs.

Although the contact area fraction S1/S2 is preferably 1.1 or larger, in order to reduce the size of the mount member and the weight of the lighting device itself comprising the LED light bulb, it is preferable for the contact area fraction S1/S2 to be 3.0 or smaller, or more preferably, 2.5 or smaller. In order to achieve further weight reduction, the contact area fraction S1/S2 is preferably 2.2 or smaller.

Second Embodiment

In First Embodiment, the heat generated in the LED module 3 is conducted from the mount member 5 to the case 7. The most part of the heat conducted to the case 7 is dissipated to the open air. Part of the heat transferred to the case 7 is conducted to and stored in the air inside the case 7.

An LED light bulb pertaining to Second Embodiment is structured such that the heat conducted from an LED module to the air inside a case via the case is ultimately dissipated to the open air by linking the air inside the case to the outside of the case.

Figure 8:
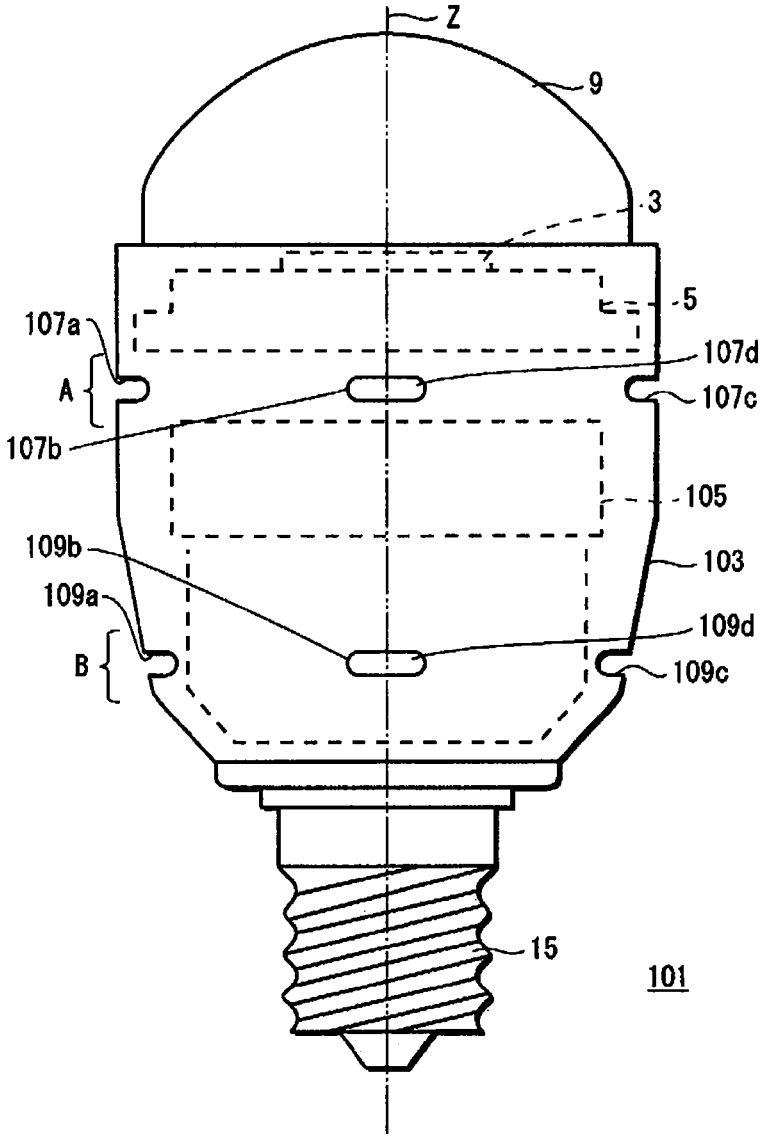
FIG. 8 shows an external appearance of an LED light bulb pertaining to Second Embodiment of the present invention.

FIG. 8 shows an external appearance of the LED light bulb pertaining to Second Embodiment of the present invention.

A case and a circuit holder provided in an LED light bulb 101 pertaining to Second Embodiment are different in structure from the case and the circuit holder provided in the LED light bulb 1 pertaining to First Embodiment. Other parts in the LED light bulb 101 have substantially the same structures as their counterparts in the LED light bulb 1. Hence, the structures of the LED light bulb 101 that are the same as in First Embodiment are assigned the same reference numbers thereas, and are omitted from the following description.

The LED light bulb 101 is composed of an LED module 3, a mount member 5, a case 103, a globe 9, a lighting circuit 11 (not illustrated), a circuit holder 105, and a base member 15. As with First Embodiment, there is clearance (i) between (a) (outer surfaces of) portions of the circuit holder 105 other than a bottom portion and a protruding cylindrical portion of the circuit holder 105 and (b) an inner circumferential surface of the case 7, and (ii) between (a) (the outer surfaces of) the portions of the circuit holder 105 other than the bottom portion and the protruding cylindrical portion of the circuit holder 105 and (b) a back surface of the mount member 5. An air space exists in such clearance.

As shown in FIG. 8, the case 103 has a plurality of vents. Once the heat has been conducted from the case 103 to the air inside the case 103, these vents cause the air inside the case 103, in which the heat is stored, to flow toward the outside of the case 103.

It is therefore preferable that the plurality of vents, for example, (i) be distanced from one another along the direction in which a central axis Z of the case 103 extends (this direction is the same as the direction in which the central axis of the lighting device extends, and hereinafter may be referred to as a central axis direction), and (ii) be formed at equal intervals in the circumferential direction of the case 103.

To be more specific, a total of eight vents are formed in two areas A and B that are distanced from each other along the central axis direction of the case 103. In each of the areas A and B, four vents are formed at equal intervals in the circumferential direction of the case 103. That is, four vents 107*a*, 107*b*, 107*c* and 107*d* are formed in the area A (with 107*d* located on the back side of 107 *b*), and four vents 109*a*, 109*b*, 109*c*, and 109*d* are formed in the area B (with 109*d* located on the back side of 109*b*).

In this case, for example, when the LED light bulb 101 is lit with its central axis Z extending in a vertical direction and the base member 15 located at the upper part of the LED light bulb 101 (i.e., the base is oriented upward), the external air around the LED light bulb 101 flows to the inside of the case 103 via the vents 107*a*, 107*b*, 107*c* and 107*d*, and the air inside the case 103 flows to the outside of the LED light bulb 101 via the vents 109*a*, 109*b*, 109*c* and 109*d*.

On the other hand, when the LED light bulb 101 is lit with its central axis Z extending in a horizontal direction, the external air flows to the inside of the case 103 via one or more of the vents located at the lowest point in each of the areas A and B, whereas the air storing therein the heat conducted from the case flows to the outside of the LED light bulb 101 via one or more of the vents that are located above the vent(s) located at the lowest point in each of the areas A and B.

This way, the air storing therein the heat conducted from the case 103 can efficiently flow to the outside of the LED light bulb 101, which increases the heat dissipation properties of the LED light bulb 101.

It should be noted that forming the vents 107*a*, 109*a*, etc. in the case 103 gives rise to the possibility that the electronic components, the substrate, etc. constituting the lighting circuit 11 may be moisturized. For this reason, the circuit holder 105 is hermetically sealed.

To be more specific, as with First Embodiment, the circuit holder 105 is made up of a holder body and a cap that have been assembled to provide a hermetic seal. For example, a sealing member made of a silicone resin or the like is filled between the through holes provided in the cap and the power supply paths passing through the through holes.

Third Embodiment

The LED light bulb pertaining to Second Embodiment is structured such that the heat conducted from the LED module to the air inside the case via the case is dissipated to the open air by linking the air inside the case to the outside of the case.

In Third Embodiment, a case is anodized to increase the emissivity of the case. This way, the case can be made with a thin wall thickness while maintaining the heat dissipation properties.

1. Structure

Figure 9:
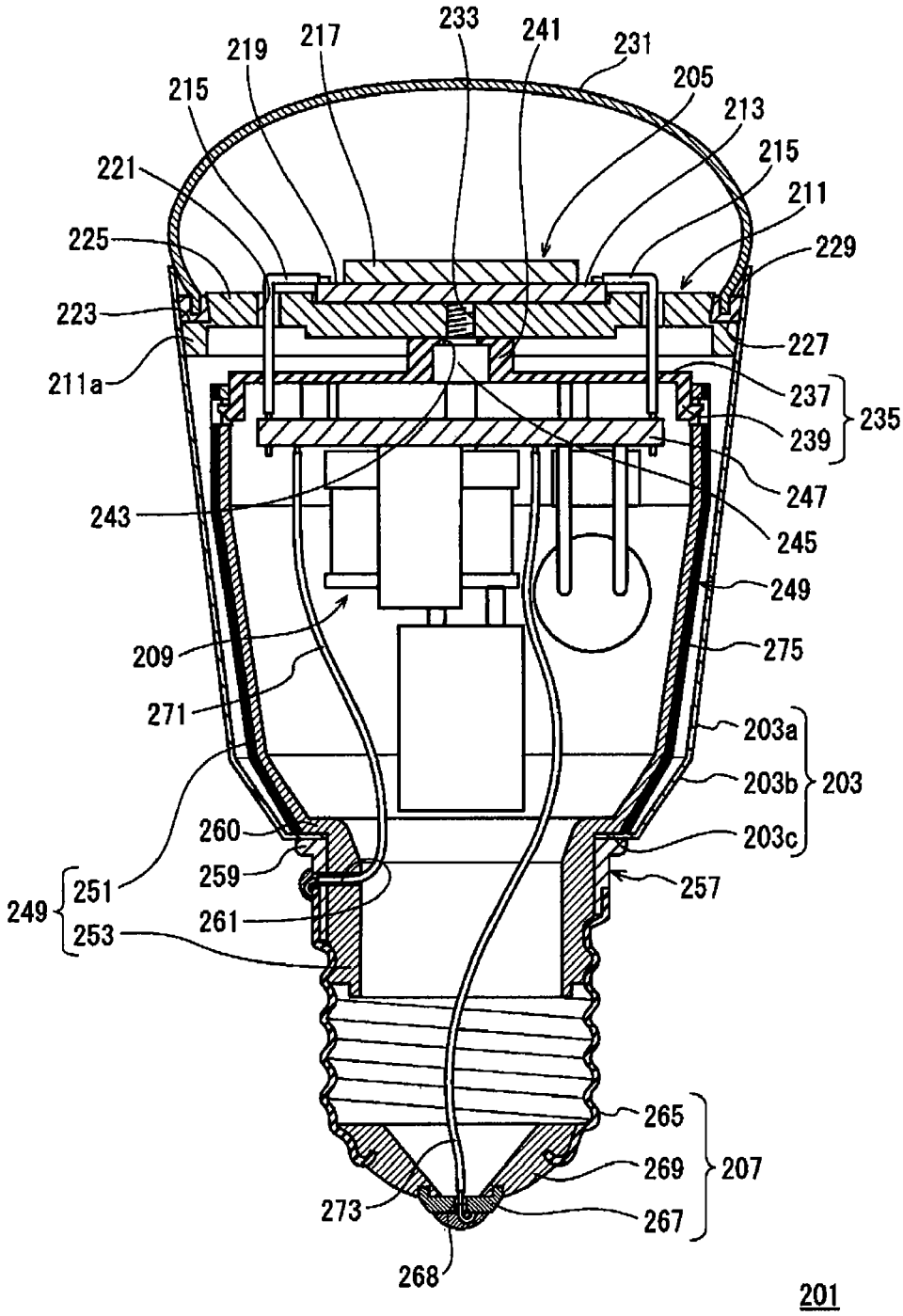
FIG. 9 is a longitudinal cross-sectional view showing a general structure of an LED light bulb pertaining to Third Embodiment of the present invention.

FIG. 9 is a longitudinal cross-sectional view showing a general structure of an LED light bulb 201 pertaining to Third Embodiment of the present invention.

The LED light bulb 201 includes, as major structural components, a case 203, an LED module 205, a base member 207, and a lighting circuit 209. The case 203 has a cylindrical shape. The LED module 205 is attached to a first end portion of the case 203 in a longitudinal direction of the case 203. The base member 207 is attached to a second end portion of the case 203. The lighting circuit 209 is positioned inside the case 203.

The case 203 is made up of a first tapered portion 203*a*, a second tapered portion 203*b* and a bottom portion (bent portion) 203*c*. A diameter of the first tapered portion 203*a* decreases from a first end toward a second end of the case 203. The second tapered portion 203*b* extends from the first tapered portion 203*a*. A diameter of the second tapered portion 203*b* decreases toward the second end of the case 203 at a larger taper angle than the first tapered portion 203*a*. The bottom portion 203*c* is formed by bending the case 203. The bottom portion 203*c* is contiguous with one end of the second tapered portion 203*b* and extends inward (toward the central axis of the case 203). Cross sections of the first tapered portion 203*a* and the second tapered portion 203*b* along a direction perpendicular to the central axis of the case 203 have a circular shape. The bottom portion 203*c* has an annular shape. As will be described later, a material with high thermal conductivity (e.g., aluminum) is used as a base material of the case 203, so that the case 203 functions as a heat dissipation member (heat sink) that allows dissipation of the heat from the LED module 205. In order to reduce the weight of the entirety of the LED light bulb 201, the case 203 is formed in the shape of a cylinder having a thin wall thickness. The specifics of the wall thickness of the case 203 will be described later.

The LED module 205, which has been mounted on the mount member (attachment member) 211, is attached to the case 203 via the mount member 211. The mount member 211 is made of a material with high thermal conductivity, such as aluminum. As will be described later, due to the properties of its material, the mount member 211 also functions as a heat conduction member that allows conduction of heat from the LED module 205 to the case 203.

The LED module 205 comprises a substrate 213 having a quadrilateral shape (in the present example, a square shape). A plurality of LEDs are mounted on the substrate 213. These LEDs are connected in series with one another by a wiring pattern (not illustrated) of the substrate 213. Of all the LEDs that are connected in series with one another, an anode electrode (not illustrated) of an LED located at an end point with high electric potential is electrically connected to one of terminal portions (25*b*, see FIG. 3) of the wiring pattern, and a cathode electrode (not illustrated) of an LED located at another end point with low electric potential is electrically connected to the other one of the terminal portions (25*b*, see FIG. 3). By supplying power from both of the terminal portions, the LEDs emit light. Each power supply path 215 has its one end soldered to a different one of the terminal portions. Power is supplied from the lighting circuit 209 via each power supply path 215.

By way of example, GaN LEDs that emit blue light may be used as the LEDs. The LED module 205 may be composed of only one LED. When the LED module 205 is composed of a plurality of LEDs, the LEDs are not limited to being connected in series with one another as described in the above example. Alternatively, the LEDs may be connected with one another by using a so-called series-parallel connection. In this case, the LEDs are divided into multiple groups so that each group includes a predetermined number of LEDs, with one of the following conditions (i) and (ii) satisfied: (i) the LEDs included in each group are connected in series with one another, and the groups are connected in parallel with one another; and (ii) the LEDs included in each group are connected in parallel with one another, and the groups are connected in series with one another.

The LEDs are sealed by a sealing member 217. The sealing member 217 is made of a translucent material through which light from the LEDs is transmitted. In a case where the wavelength of the light from the LEDs needs to be converted to a predetermined wavelength, the sealing member 217 is made of the translucent material and a conversion material. Resin is used as the translucent material. The resin may be, for example, a silicone resin. By way of example, powders of YAG phosphors ($(Y,Gd)_3Al_5O_{12}:Ce^{3+}$), silicate phosphors ($(Sr,Ba)_2SiO_4:Eu^{2+}$), nitride phosphors ($(Ca,Sr,Ba)AlSiN_3:Eu^{2+}$) or oxinitride phosphors ($Ba_3Si_6O_{12}N_2:Eu^{2+}$) may be used as the conversion material. Consequently, the LED module 205 emits while light.

The mount member 211 has a shape of a circular plate as a whole. The mount member 211 is made of a material with high thermal conductivity, such as aluminum. The mount member 211 also functions as a heat conduction member that allows the heat generated in the LED module 205 while the LED light bulb 201 is being lit to the case 203.

A quadrilateral recess 219, in which the substrate 213 is fit, is formed in the central portion of one of main surfaces of the mount member 211. The LED module 205 is secured with the substrate 213 fit in the recess 219 and the back surface of the substrate 213 tightly in contact with the bottom surface of the recess 219. Here, the LED module 205 is secured by using an adhesive material. Alternatively, the LED module 205 may be secured by using a screw. In this case, a through hole is provided at a suitable position in the substrate 213 to allow the screw to penetrate through the through hole and be fastened into the mount member 211.

Insertion holes 221 are provided in the mount member 211. The power supply paths 215 pass through the insertion holes 221.

The mount member 211 is made up of a circular plate portion 225 and an annular portion 223 that is formed along the entire circumference of the circular plate portion 225. An upper surface of the annular portion 223 is closer to the base member 207 than an upper surface of the circular plate portion 225 (the main surface of the mount member 21) is. The annular portion 223 has a tapered outer circumferential surface 211*a*, which is equivalent to part of a surface of a cone and has substantially the same taper angle as the inner circumferential surface of the first tapered portion 203*a* of the case 203. The mount member 211 is secured to the case 203 with the tapered outer circumferential surface 211*a* of the annular portion 223 in tight contact with the inner circumferential surface of the first tapered portion 203*a*. The mount member 211 is secured to the case 203 by an adhesive material 229 filled in an annular groove 227, which is formed by the inner circumferential surface of the first end portion of the case 203, the outer circumferential surface of the circular plate portion 225, and the upper surface of the annular portion 223.

A tip of a globe 231 at an opening of the globe 231 is inserted in the annular groove 227. The globe 231 has a shape of a dome and covers the LED module 205. The globe 231 is secured to the case 203 and the mount member 211 by the adhesive material 229.

An internal thread 233 is formed in the center of the circular plate portion 225 of the mount member 211. The internal thread 233 is used to secure a cap 235, which holds the lighting circuit 209, to the mount member 211.

The cap 235 has a shape of a circular dish, and is made up of a circular bottom portion 237 and a circumferential wall portion 239 that vertically extends from a circumferential rim of the circular bottom portion 237. A boss 241 is formed in the center of the circular bottom portion 237, in such a manner that the boss 241 protrudes from the circular bottom portion 237 along the thickness direction of the circular bottom portion 237. A through hole 243 is provided in the bottom of the boss 241.

A screw with an external thread is inserted through the through hole 243 and screwed along the internal thread 233. The screw and the internal thread 233 that have mated with each other are collectively referred to as a connector member 245. The cap 235 is secured to the mount member 211 by the connector member 245.

The lighting circuit 209 is composed of a substrate 247 and a plurality of electronic components 249 mounted on the substrate 247. The lighting circuit 209 is held by the cap 235 with the substrate 247 secured to the cap 235.

The lighting circuit 209 is held by the cap 235 according to the structure that will be described later with reference to FIG. 15.

For the purpose of weight reduction, it is preferable that the cap 235 be made of a material with low relative density, such as a synthetic resin. In the present example, the cap 235 is made of polybutylene terephthalate (PBT).

The cap 235 is attached to a cylindrical body 249 that encloses the lighting circuit 209 and is connected to the base member 207. It should be noted that the cap 235 and the cylindrical body 249 together constitute the "circuit holder member" of the present invention, and the cylindrical body 249 is equivalent to the "holder body" pertaining to First Embodiment. For the reason stated above, it is preferable that the cylindrical body 249 be made of a material similar to the material of the cap 235. In the present example, the cylindrical body 249 is made of polybutylene terephthalate (PBT).

Broadly speaking, the cylindrical body 249 is made up of a lighting circuit cover portion 251 and a protruding cylindrical portion (base attachment portion) 253. The lighting circuit cover portion 251 encloses the lighting circuit 209. The protruding cylindrical portion 253 extends from the lighting circuit cover portion 251 and has a smaller diameter than the lighting circuit cover portion 251. The lighting circuit cover portion 251 is equivalent to the "large diameter cylindrical portion" pertaining to First Embodiment. The cylindrical body 249 is attached to the cap 235 in the same manner as described later with reference to FIG. 15.

The following describes how the cylindrical body 249 is secured to the case 203, and how the base member 207 is attached to the protruding cylindrical portion 253 of the cylindrical body 249.

The cylindrical body 249 is secured to the case 203 by using a flanged bushing 257. The flanged bushing 257 has an inner diameter, due to which it can be smoothly fit around the outer circumferential surface of the protruding cylindrical portion 253 without jouncing.

The flanged bushing 257 is fit around and attached to the protruding cylindrical portion 253 with the bottom portion 203*c* of the case 203 held between a shoulder portion 260 of the cylindrical body 249 and a flange portion 259 of the flanged bushing 257, the shoulder portion 260 connecting between the lighting circuit cover portion 251 and the protruding cylindrical portion 253.

Note that the shoulder portion 260 is equivalent to the "bottom portion" pertaining to First Embodiment. Insertion holes 261, through which a first power supply wire 271 (described later) is inserted, are respectively provided in the protruding cylindrical portion 253 and the flanged bushing 257. The position of the flanged bushing 257 is determined in accordance with the position of the protruding cylindrical portion 253 so that the insertion holes 261 are contiguous with each other.

The base member 207 is in compliance with, for example, the standards of an Edison screw specified by Japanese Industrial Standards (JIS). The base member 207 is used while being attached to a socket (not illustrated) for a general incandescent light bulb. To be more specific, an E26 base is used as the base member 207 when the LED light bulb 201 is the equivalent of a 60-watt incandescent light bulb, and an E17 base is used as the base member 207 when the LED light bulb 201 is the equivalent of a 40-watt incandescent light bulb. Hereinafter, an LED light bulb equivalent to the 60-watt incandescent light bulb may be referred to as a "60-watt equivalent", and an LED light bulb equivalent to the 40-watt incandescent light bulb may be referred to as a "40-watt equivalent".

The base member 207 includes a shell 265, which is also referred to as a cylindrical body portion, and an electrical contact (eyelet) 267 having a shape of a circular dish. The shell 265 and the electrical contact 267 are formed as a single integrated component, with an insulator 269 made of a glass material positioned therebetween.

An external thread has been formed on the outer circumferential surface of the protruding cylindrical portion 253. The base member 207 is attached to the protruding cylindrical portion 253 due to this external thread being screwed and fit into the shell 265.

Once the base member 207 has been attached to the protruding cylindrical portion 253, one end portion of the shell 265 and one end portion of the flanged bushing 257 overlap each other. More specifically, the one end portion of the flanged bushing 257 has a smaller wall thickness than any other portion of the flanged bushing 257. Put another way, the one end portion of the flanged bushing 257 has been recessed. The one end portion of the shell 265 is fit around the one end portion of the flanged bushing 257 having a thin wall thickness. As a result of screwing and fitting the shell 265 around the aforementioned external thread, the one end portion of the shell 265 presses the one end portion (recessed portion) of the flanged bushing 257. This way, the bottom portion 203*c* of the case 203 is securely held between the flange portion 259 and the shoulder portion 260.

Once the shell 265 has been tightly fit around the aforementioned external thread, the one end portion of the shell 265 is crimped into engagement with the flanged bushing 257. The crimping is performed by denting multiple areas in the one end portion of the shell 265 toward the flanged bushing 257 with the use of a crimper or the like.

The first power supply wire 271 that supplies power to the lighting circuit 209 is pulled outside the protruding cylindrical portion 253 via the insertion holes 261. An end of the first power supply wire 271 located outside the protruding cylindrical portion 253 is soldered to and therefore electrically connected to the shell 265.

A through hole 268 is provided in the central portion of the electrical contact 267. A conductor of a second power supply wire 273, which supplies power to the lighting circuit 209, is pulled through the through hole 268 toward the outside of the base member 207 and is connected to the outer surface of the electrical contact 267 by soldering.

When the LED light bulb 201 having the above-described structures is lit while being attached to a socket (not illustrated) of a lighting fixture, the white light emitted from the LED module 205 travels through the globe 231 toward the outside of the LED light bulb 201. The heat generated in the LED module 205 is conducted to the case 203 that functions as a heat dissipation member, via the mount member 211 that functions as a heat conduction member. The heat conducted to the case 203 is dissipated to the atmosphere surrounding the case 203. Consequently, overheating of the LED module 205 can be prevented.

2. Wall Thickness of Case

Incidentally, as has been described above, the case 203 is formed in the shape of a cylinder having a thin wall thickness so as to reduce the weight of the LED light bulb 201 as a whole. This is due to the precondition that the LED light bulb

201, which is designed to replace an incandescent light bulb, will be attached to a lighting fixture adapted for the incandescent light bulb that is relatively lightweight.

The thinner the case (housing) is, the more contribution the case makes to weight reduction. However, the thinner the case is, the lower stiffness the case has, and the more susceptible the case is to deformation. Therefore, when the case is made with a thin wall thickness, handleability of the case is reduced during shipping and assembly thereof in the manufacturing process. This poses a detrimental effect on the productivity of the LED light bulb 201.

In view of the above concerns, the inventors of the present application aim to make a case with an appropriate wall thickness that not only contributes to weight reduction, but also causes as less harm as possible to handleability of the case during the manufacturing process.

The following describes a wall thickness of a case and the like based on specific embodiment examples. It should be mentioned that the structural components (e.g., the case) of an LED light bulb that is equivalent to a 40-watt incandescent light bulb have different sizes, etc. from those of an LED light bulb that is equivalent to a 60-watt incandescent light bulb. Therefore, different descriptions will be given below for the former LED light bulb and the latter LED light bulb, respectively.

(1) LED Module 205

(a) 40-Watt Equivalent

The substrate 213 has a thickness of 1 [mm]. Each side of the substrate 213 has a length of 21 [mm].

There are a total of 48 LEDs (not illustrated) used, which are divided into two groups that each include 24 LEDs. In each group, the 24 LEDs are connected in series with one another. The two groups are connected in parallel with each other.

(b) 60-Watt Equivalent

The substrate 213 has a thickness of 1 [mm]. Each side of the substrate 213 has a length of 26 [mm].

There are a total of 96 LEDs (not illustrated) used, which are divided into four groups that each include 24 LEDs. In each group, the 24 LEDs are connected in series with one another. The four groups are connected in parallel with one another.

(2) Mount Member 211

(a) 40-Watt Equivalent

The circular plate portion 225 and the annular portion 223 each have a thickness of 3 [mm]. The annular portion 223 has an outer diameter of 37 [mm].

(b) 60-Watt Equivalent

The circular plate portion 225 and the annular portion 223 each have a thickness of 3 [mm]. The annular portion 223 has an outer diameter of 52 [mm].

(3) Case 203

Figures 10A, 10B, 10C:
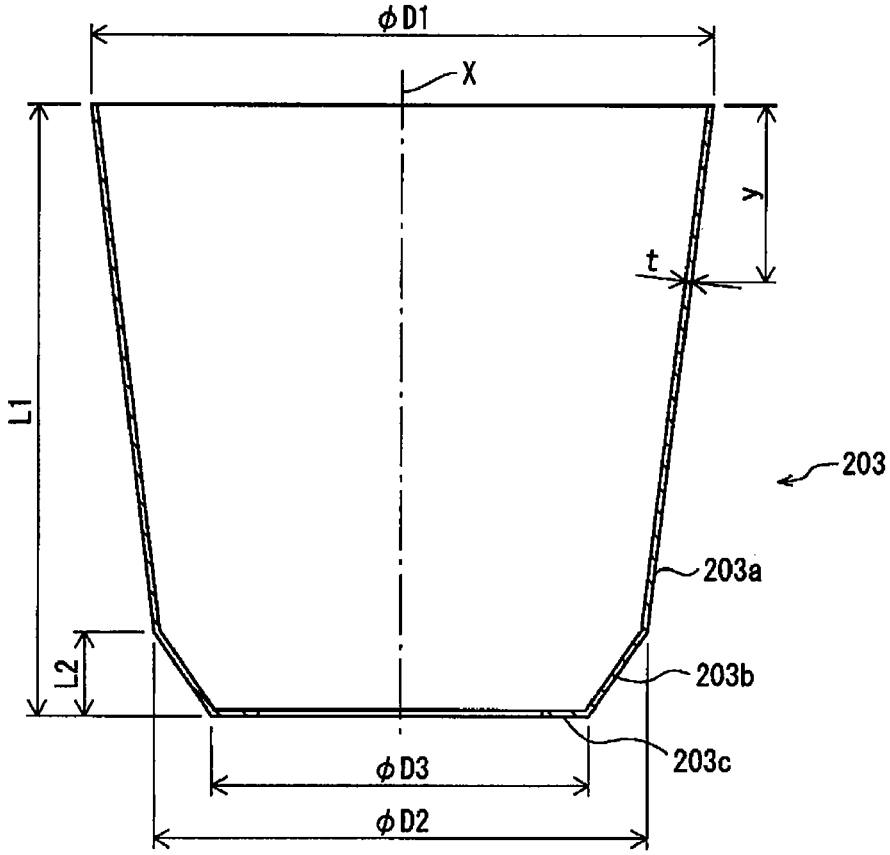
FIGS. 10A, 10B and 10C illustrate the sizes of various portions of the case.

The size of each portion of the case 203 is shown in FIGS. 10A and 10B. Values of the actual sizes of the case 203, which are indicated in FIG. 10A using alphabetical letters, are shown in FIG. 10B. Note that the sizes shown in FIGS. 10A and 10B are of a case where the case 203 is made of aluminum. The case 203 does not have a uniform wall thickness. Different portions of the case 203 have different wall thicknesses, which are determined in consideration of the following factors. In FIG. 10A, the central axis of the first tapered portion 203*a* (and the second tapered portion 203*b*) is labeled "X", and a distance measured in parallel with the central axis X from a large diameter end of the first tapered portion 203*a*, which is one end of the first tapered portion 203*a* having the largest diameter (an uppermost end of the first tapered portion 203*a* in FIG. 10A), is labeled "y". A wall thickness of a portion of the case 203 that falls within the distance y is labeled "t".

First of all, for the purpose of weight reduction, it is preferable for any portion of the case 203 to have a wall thickness of 500 [μm] or less.

Secondly, a part of the first tapered portion 203*a* that satisfies the relationship y=0 [mm] to 5 [mm] (i.e., a large diameter end part of the first tapered portion 203*a*) needs to have sufficient stiffness to avoid problematic deformation, because this part is most likely to deform due to an external force acting in the diameter direction of the first tapered portion 203*a*. In order to have such stiffness, the large diameter end part of the first tapered portion 203*a* needs to have a wall thickness of 300 [μm] or more.

If the large diameter end part of the first tapered portion 203*a* has a wall thickness of 300 [μm] or more, then the wall thickness of a portion of the case 203 that satisfies the relationship y>5 [mm] may decrease as y increases in order to achieve further weight reduction. However, the wall thickness of the case 203 must not be smaller than 200 [μm] (put another way, the smallest wall thickness of the case 203 needs to be 200 [μm] or more). This is because the LED light bulb 201 is ordinarily attached to a socket of a lighting fixture while the first tapered portion 203*a* is being held by a human hand. Accordingly, it is necessary for the case 203 to have sufficient stiffness to resist such a force applied by the human hand without being deformed.

Due to the difference in taper angles of the first tapered portion 203*a* and the second tapered portion 203*b*, the first tapered portion 203*a* and the second tapered portion 203*b* form an obtuse angle in a border area of the case 203, which is an area of the case 203 around the border between the first tapered portion 203*a* and the second tapered portion 203*b*. Due to the so-called arch effect, the border area of the case 203 has high stiffness to resist an external force acting in the diameter direction of the case 203. Therefore, in terms of stiffness, it is possible to make the border area of the case 203 with a smaller wall thickness than any other area of the case 203. However, in a case where the case 203 is manufactured through deep drawing processing, if the wall thickness of the border area is too thin, the material (an aluminum plate) of the case 203 is ripped during the processing. This results in an extreme decrease in yield.

For this reason, in a case where the wall thickness of the case 203 decreases from the large diameter end of the first tapered portion 203*a* as y increases, it is preferable that a portion of the case 203 having the smallest wall thickness be located (i) in proximity to the border and (ii) between the large diameter end of the first tapered portion 203*a* and the border. In terms of yield, it is preferable for the border area, which includes part of the second tapered portion 203*b*, to have a wall thickness of 250 [μm] or more.

To summarize the above, in order to reduce weight of the LED light bulb 201 and secure stiffness of the case 203, it is preferable for the case 203 to have a wall thickness in a range of 200 [μmm] to 500 [μm] inclusive. In order to achieve further weight reduction, it is preferable for the case 203 to include at least one portion that decreases in wall thickness from the large diameter end of the first tapered portion 203*a* toward the bottom portion 203*c*, in an area that is closer to the border area than the large diameter end part (where y=0 [mm] to 5 [mm]) is.

In terms of stiffness, it is preferable for the large diameter end part (where y=0 [mm] to 5 [mm]) to have a wall thickness in a range of 300 [mm] to 500 [μm] inclusive.

FIG. 10C shows wall thicknesses of cases 203 (samples) that were exemplarily made in consideration of the above-described factors. It should be noted that each case (sample) shown in FIG. 10C was designed for an LED light bulb equivalent to a 40-watt incandescent light bulb.

Although not shown in FIG. 10C, a portion of Sample 1 satisfying the relationship y=0 [mm] to 5 [mm] had a wall thicknesses in a range of 0.335 [mm] to 0.350 [mm] inclusive, and a portion of Sample 2 satisfying the relationship y=0 [mm] to 5 [mm] had a wall thicknesses in a range of 0.340 [mm] to 0.350 [mm] inclusive. That is, these portions of Samples 1 and 2 both had a wall thickness of 300 [μm] or more.

A portion of Sample 1 satisfying the relationship y=5 [mm] to 25 [mm], and a portion of Sample 2 satisfying the relationship y=5 [mm] to 20 [mm], gradually decreased in wall thickness as y increased—i.e., from the large diameter end of the first tapered portion 203*a* toward the bottom portion 203*c*.

A part of the first tapered portion 203*a* having the smallest wall thickness (i) was located closer to a small diameter end of the first tapered portion 203*a* (the border between the first tapered portion 203*a* and the second tapered portion 203*b*) than a central area between the large diameter end and the small diameter end of the first tapered portion 203*a* is, and (ii) satisfied the relationship y=20 [mm] to 25 [mm] inclusive. Provided that a reference position of y is 0 and a total length of the case 203 is L1, a ratio of the length of the part of the first tapered portion 203*a* having the smallest thickness to the total length L1 of the case 203 is in a range of 0.52 to 0.65.

Each of Samples 1 and 2 (cases) had a wall thickness in a range of 0.3 [mm] to 0.35 [mm] inclusive as a whole.

(4) Surface Processing for Case 203

As has been described above, in Third Embodiment, the heat generated in the LED module 205 is conducted to the case 203 via the mount member 211 that functions as a heat conduction member. The heat can be efficiently dissipated with the presence of the case 203 that functions as a heat dissipation member.

Because emphasis is placed on reduction in weight and size of the LED light bulb 201, the following problem occurs. The case 203, which is formed in the shape of a cylinder having a thin wall thickness, has low heat capacity compared to a case formed in the shape of a cylinder having a thick wall thickness. As a result, the temperature of the case 203 can easily be raised. To address this problem, it is necessary to improve the heat dissipation properties of the case 203. One possible way to improve the heat dissipation properties of the case 203 is, for example, to anodize the entire surface of the case 203, which is made of aluminum.

However, simply improving the heat dissipation properties would result in a situation where a large part of the heat conducted to the case 203 is dissipated to the space inside the case 203 in which the lighting circuit 209 is disposed. Consequently, the electronic components of the lighting circuit 209 are overheated.

In view of the above, the inventors of the present invention have anodized only the outer circumferential surface of the case so as to (i) improve the heat dissipation properties of the case and (ii) make it as hard as possible for the heat to be trapped inside the case (in the space where the lighting circuit is disposed). More specifically, the case has a double-layer structure composed of an inner layer that is made of aluminum, and an outer layer that is formed on the outer circumferential surface of the inner layer and is made of an anodic film (anodic oxide film).

The inner circumferential surface of the case that is not anodized has an emissivity of 0.05. In contrast, the outer circumferential surface of the case that is, for example, white anodized (coated with a white anodic film) has an emissivity of 0.8. That is, the emissivity of the inner circumferential surface and the emissivity of the outer circumferential surface are different from each other by a decimal order.

Part of the heat conducted to the case is dissipated by radiation. When the outer circumferential surface of the case has higher emissivity than the inner circumferential surface of the case as described above, radiation of heat from the outer circumferential surface of the case is fostered, whereas radiation of heat from the inner circumferential surface of the case is suppressed. This makes it hard for the heat to be trapped inside the case 203. Note that the outer circumferential surface of the case is not limited to being coated with the white anodic film, but may be coated with a black anodic film (with an emissivity of 0.95).

The emissivity of the inner circumferential surface of the case 203 (the first tapered portion 203*a* and the second tapered portion 203*b*) may be lowered to increase the difference between itself and the emissivity of the outer circumferential surface of the case 203. This way, radiation of heat from the outer circumferential surface is further fostered, and radiation of heat from the inner circumferential surface is further suppressed. To be more specific, a silver film (with an emissivity of 0.02) may be formed on the inner circumferential surface of the aluminum base material. Put another way, in this case, the case 203 (the first tapered portion 203*a* and the second tapered portion 203*b*) has a triple-layer structure composed of (i) an intermediate layer made of aluminum, (ii) an outer layer that is formed on the outer circumferential surface of the intermediate layer and made of an anodic film, and (iii) an inner layer that is formed on the inner circumferential surface of the intermediate layer and made of a silver film. The silver film may be applied to the inner circumferential surface of the aluminum base material by silver-plating the inner circumferential surface of the aluminum base material, or vapor-depositing silver on the inner circumferential surface of the aluminum base material.

Furthermore, the outer layer is not limited to being made of the anodic film, but may be made of one or more of the following materials.

(a) Carbon graphite (with an emissivity of 0.7 to 0.9)
(b) Ceramic (with an emissivity of 0.8 to 0.95)
(c) Silicon carbide (with an emissivity of 0.9)
(d) Cloth (with an emissivity of 0.95)
(e) Rubber (with an emissivity of 0.9 to 0.95)
(f) Synthetic resin (with an emissivity of 0.9 to 0.95)
(g) Iron oxide (with an emissivity of 0.5 to 0.9)
(h) Titanium oxide (with an emissivity of 0.6 to 0.8)
(i) Wood (with an emissivity of 0.9 to 0.95)
(j) Black coating (with an emissivity of 1.0)

What matters is that the case 203 should have a layered structure in which multiple layers are disposed on one another in the thickness direction of the case 203, so that in the first tapered portion 203*a* and the second tapered portion 203*b*, the outer circumferential surface of the case 203 has higher emissivity than the inner circumferential surface of the case 203. The layered structure is not limited to the aforementioned double-layer structure and the triple-layer structure, but may be a quadruple-layer structure or a layered structure composed of more than four layers. No matter which one of the above layered structures is employed, the surface of the outer (most) layer should have higher emissivity than the surface of the inner(most) layer.

The outer circumferential surface of the case (the first and second tapered portions) has an emissivity of 0.5 or higher, and the inner circumferential surface of the case has an emissivity lower than 0.5. This is in order to suppress radiation of heat from the LED module to the inside of the case as much as possible, and to improve the effect of dissipation of the heat to the outside of the case. It is desirable that the outer circumferential surface of the case have an emissivity of 0.7 or higher, or more preferably, 0.9 or higher. It is desirable that the inner circumferential surface of the case have an emissivity of 0.3 or lower, or more preferably, 0.1 or lower.

For example, in a case where the case 203 (the first tapered portion 203*a* and the second tapered portion 203*b*) is embedded in the lighting fixture and is therefore invisible from outside after the LED light bulb is attached to the lighting fixture, it is preferable to select the black coating that has the highest emissivity of all the above-listed materials (a) to (j)—i.e., it is preferable to apply the black coating to the outer circumferential surface of the aluminum base material and thereby configure the outer layer as a black coating layer.

(5) Cylindrical Body 249

The lighting circuit cover portion 251 of the cylindrical body 249 protects the lighting circuit 209 from unforeseeable deformation of the case 203. However, the existence of the lighting circuit cover portion 251 increases the tendency of heat generated by the lighting circuit 209 to stay around the lighting circuit 209.

In order to cause the heat inside the lighting circuit cover portion 251 to be dissipated to the outside of the lighting circuit cover portion 251 as much as possible by radiation, the black coating is applied to the outer circumferential surface of the lighting circuit cover portion 251 to form a black coating film 275, which functions as an emissivity improvement material. Note that the thickness of the black coating film 275 is emphasized in FIG. 9 to facilitate visualization.

The inner circumferential surface of the lighting circuit cover portion 251 (polybutylene terephthalate), on which the black coating film 275 is not formed, has an emissivity of 0.9. On the other hand, the surface of the black coating film 275 has an emissivity of 1.0.

This way, compared to when the black coating film 275 is not formed at all, the heat inside the lighting circuit cover portion 251 is rapidly dissipated to the outside of the lighting circuit cover portion 251 when the black coating film 275 is formed. This produces the effect of lowering the temperature inside the lighting circuit cover portion 251.

A combination of the material of the lighting circuit cover portion 251 and the emissivity improvement material formed on the outer circumferential surface of the lighting circuit cover portion 251 is not limited to the one described above. For example, when the lighting circuit cover portion 251 is made of aluminum (with an emissivity of 0.05), a nonwoven fabric (with an emissivity of 0.9) may be secured to the outer circumferential surface of the lighting circuit cover portion 251 as the emissivity improvement material.

What matters is that a material having higher emissivity than the inner circumferential surface of the lighting circuit cover portion 251 must be brought in tight contact with and cover the outer circumferential surface of the lighting circuit cover portion 251.

3 Heat Dissipation Properties

An LED light bulb pertaining to the above embodiments and the like (e.g., the LED light bulb 1 pertaining to First Embodiment) has a structure in which the LED module 3 is mounted on the mount member 5, and the mount member 5 is attached to and thermally connected to the case 7.

The above structure allows the heat generated while the lamp (when the LEDs emit light) is being lit to be conducted from the LED module 3 to the mount member 5, and from the mount member 5 to the case 7. Furthermore, during such heat conduction, the above structure also allows dissipation of the heat through radiation, heat transfer, convection, etc.

Throughout studies, the inventors have found that increasing the adhesion between the LED module 3, the mount member 5, the case 7 and the base member 15 allows the heat to be effectively conducted from the LED module 3 to the other components up to the base material 15, with the result that an increase in the temperature of the LEDs can be prevented.

The following describes temperature distribution in the LED light bulb (and its components) in a case where adhesion between (thermal conductivities of) the components is improved.

(1) LED Light Bulb

The LED light bulbs used in the test are the same as the LED light bulbs explained in Third Embodiment. To be more specific, Sample 1 is the LED light bulb 201 explained in Third Embodiment. Sample 2 is the LED light bulb explained in Third Embodiment wherein thermal grease is applied between the LED module and the mount member. Sample 3 is the LED light bulb explained in the Third Embodiment wherein thermal grease is applied between the LED module and the mount member, and a silicone resin 280 is filled inside the circuit holder (cylindrical body) and the base member (see FIG. 11).

Figure 11:
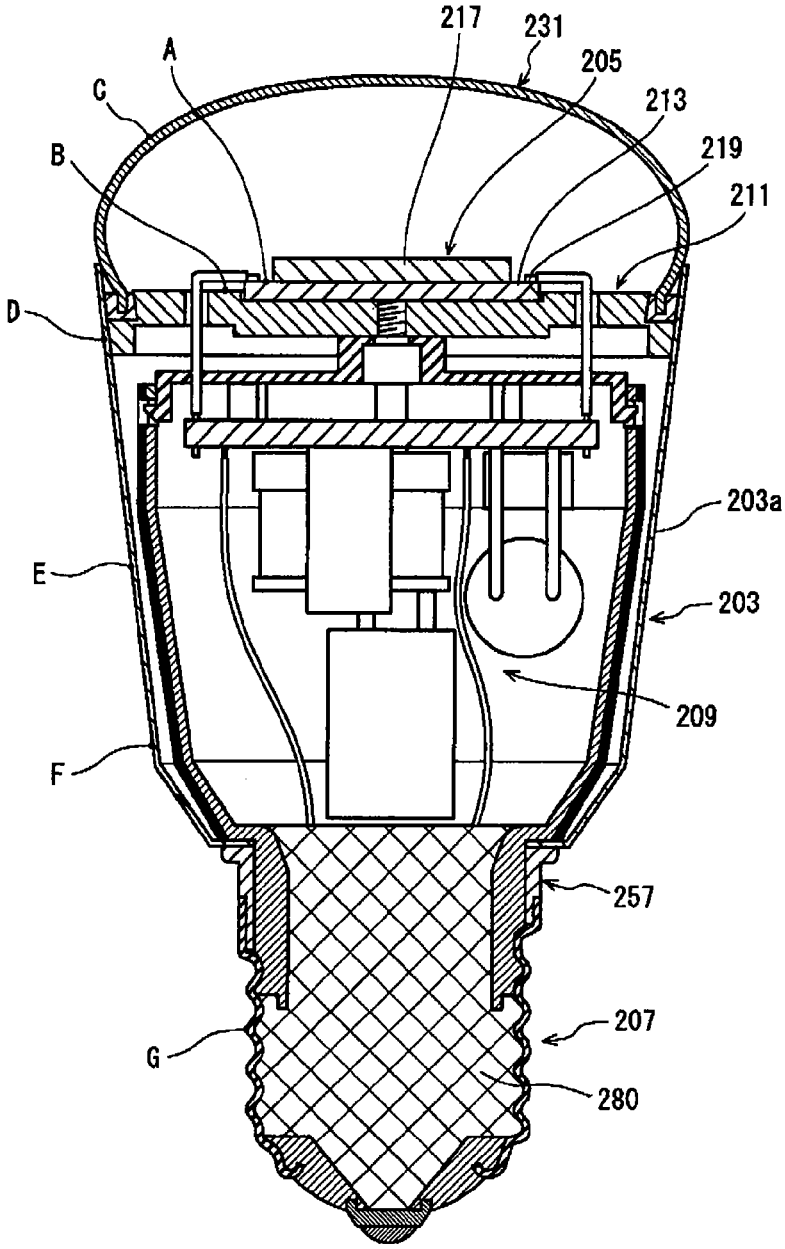
FIG. 11 shows locations of the LED light bulb at which the temperatures were respectively measured while the LED light bulb was being lit.

FIG. 11 shows locations of the LED light bulb at which the temperatures were respectively measured while the LED light bulb was being lit (these locations may be referred to as "measured locations").

Note that the LED light bulb shown in FIG. 11 is Sample 3.

The measured location A is a part of the main surface of the substrate 213 of the LED module 205 where the sealing member 217 is not formed. The measured location B is a part of the front surface of the mount member 211 around the recess 219 in which the LED module is mounted. The measured location C is on the surface of the globe 231.

The measured location D is on the outer circumferential surface of a part of the first tapered portion 203*a*. The mount member 211 is attached to the inner circumferential surface of this part of the first tapered portion 203*a*. The measured location E is on the outer circumferential surface of the first tapered portion 203*a* and is located at the center of the case 203 in the central axis direction of the case 203. The measured location F is on the outer circumferential surface of the first tapered portion 203*a* and is located closer to the base member 207 than the measured location E is in the central axis direction of the case 203. The measured location G is on the outer circumferential surface of the base member 207.

The temperatures were measured by using a thermocouple while Sample 3 was being constantly lit (approximately 30 minutes after lighting of Sample 3 was started).

(2) Temperature Distribution

Figures 12A, 12B:
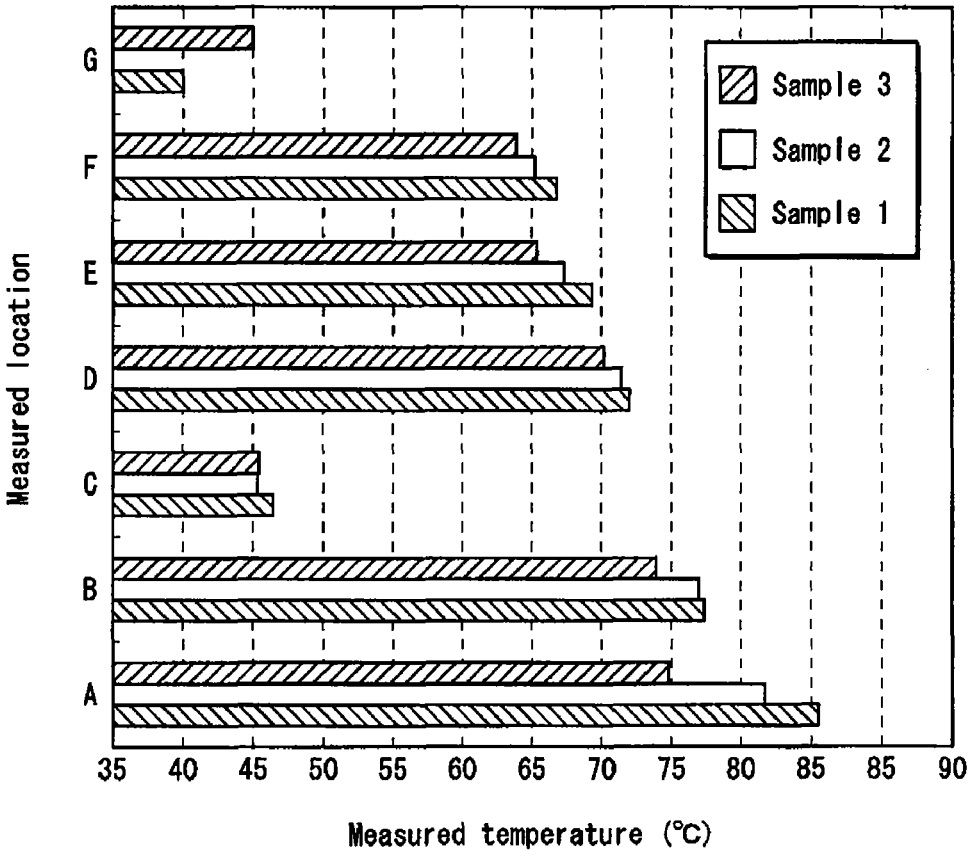
FIGS. 12A and 12B show results of measuring the temperatures while Samples were being lit.

FIGS. 12A, 12B and 12C show results of measuring the temperatures while Samples were being lit. FIG. 12A shows data of the measured temperatures, and FIG. 12B is a bar graph showing measurement results. FIG. 12A also shows estimated junction temperatures of the LEDs (in the row titled "Tj (estimated)" in FIG. 12A).

In each of Samples 1 to 3, the measured location A, which is closer to the LEDs than any other measured locations are, has the highest temperature among all the measured locations. The farther the components are from the LED module 205, the lower the temperatures of the components are, except for the globe 231. The largest difference in the temperatures of the measured locations (excluding the measured location G) is the difference between the temperature of the measured location A, which is closest to the LED module 205, and the temperature of the measured location F, which is farthest from the LED module 205. The values of such a difference are 18.7 [° C.], 16.5 [° C.] and 10.9 [° C.] in Samples 1, 2 and 3, respectively.

The values of such a difference in Samples 1, 2 and 3 descend in this order. This is presumably because efficiency of conduction of the heat, which was generated in the LEDs while the LEDs were emitting light, from the LED module to the other components descends in the order of Samples 1, 2 and 3. Regarding Sample 2, it is considered that as the thermal grease was applied between the LED module 205 and the mount member 211, a larger amount of heat was conducted from the LED module 205 to the mount member 211, thus lowering the temperature of the LED module 205 (measured location A).

Similarly to the case of Sample 2, it is considered that in Sample 3, the heat was conducted from the LED module 205 to the mount member 211 via the thermal grease, from the case 203 to the cylindrical body 249 (circuit holder), and from the cylindrical body 249 to the base member 207 via the silicone resin 280, thus lowering the temperatures of the LED module 205 (measured location A), the case 203, and the base member 207.

As set forth above, it is considered that as a result of increasing thermal conductivity of each component, the heat was uniformly conducted from the heat source (LED module) to other components such as the case and the base member, and the temperature of the LED light bulb was reduced as a whole. It is also considered that due to the heat of the LED module being conducted to the entirety of the LED light bulb, the heat was not trapped (stored) in the mount member and the junction temperature of the LEDs was lowered.

(3) High Thermal Conductivity

In view of thermal conductivity, it is preferable to configure an LED light bulb using materials having high thermal conductivity. However, there is a case where the use of such materials having high thermal conductivity makes it difficult to secure lightweight properties and insulation properties of the LED light bulb. In such a case, two components should be connected to each other by using a material having high thermal conductivity. Examples of such a material include thermal grease and a resin material that includes a filler having high thermal conductivity. Examples of such a filler include: silicon oxide; metal oxide such as titanium oxide and copper oxide; silicon carbide; diamond; diamond-like carbon; carbide such as boron nitride; and nitride.

Modification Examples

The present invention has been explained above based on the embodiments. However, it goes without saying that the present invention is not limited to the specific examples described in the above embodiments. For example, the following modification examples are possible.

1. Mount Member (1) Positioning

First Embodiment has described that when attaching the mount member to the case, the position of the mount member is determined by the stoppers provided on the inner circumferential surface of the case. However, the position of the mount member may be determined based on a different method.

Figure 13A:
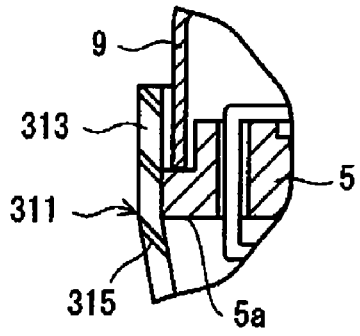
FIGS. 13A, 13B and 13C show modification examples of a method for positioning the mount member.
Figure 13B:
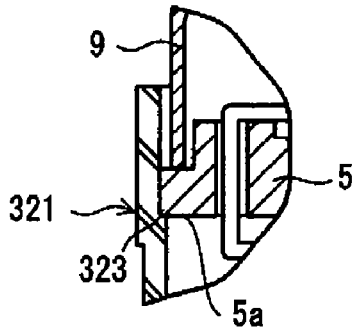
Figure 13C:
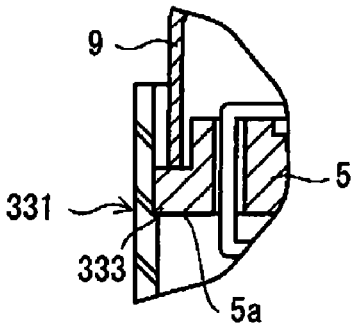

FIGS. 13A, 13B and 13C show modification examples of a method for positioning the mount member.

Below, the structures that are the same as those of the LED light bulb 1 pertaining to First Embodiment are assigned the same reference numbers thereas, and the descriptions thereof are omitted.

In the example shown in FIG. 13A, a case 311 has a straight portion 313 and a tapered portion 315 at a first end portion of the case 311 through which the mount member 5 is inserted.

When attaching the mount member 5 to the case 311, the mount member 5 is pressed into the case 311. Once a rim 5*a* of the mount member 5 that is positioned closer to the tapered portion 315 has reached an end point of the straight portion 313, i.e., a start point of the tapered portion 315, the mount member 5 stops proceeding. This way, the mount member 5 is positioned at a predetermined position within the case 311.

In the examples shown in FIGS. 13B and 13C, cases 321 and 331 respectively include step portions 323 and 333 in proximity to first ends (openings) thereof, through which the mount member 5 is inserted. The step portion 323 (333) separates between a first portion and a second portion of the case 321 (331). The first portion is closer to the first end of the case 321 (331) and has a large inner diameter. The second portion is closer to the center of the case 321 (331) in the central axis direction (than the first end of the case 321 is) and has a small inner diameter.

In these examples also, after the mount member 5 is pressed into the case 321 (331), once the rim 5*a* of the mount member 5 that is positioned closer to the second portion of the case 321 (331) has reached the step portion 323 (333), the mount member 5 stops proceeding. This way, the mount member 5 is positioned at a predetermined position within the case 321 (331).

The step portion 323 of the case 321 is formed so that the circumferential wall of the case 321 has a uniform wall thickness, except in the step portion 323 (that is, the circumferential walls of the first and second portions of the case 321 have the same wall thickness). On the other hand, the step portion 333 of the case 331 is formed so that only the circumferential wall of the first portion of the case 331, through which the mount member 5 is inserted, has a small thickness (that is, the circumferential wall of the first portion of the case 331 has a smaller thickness than the circumferential wall of any other portion of the case 331).

By way of example, the step portions 323 and 333 may be formed by molding and grinding processing, respectively.

(2) Anti-Fall Mechanism

Figure 14A:
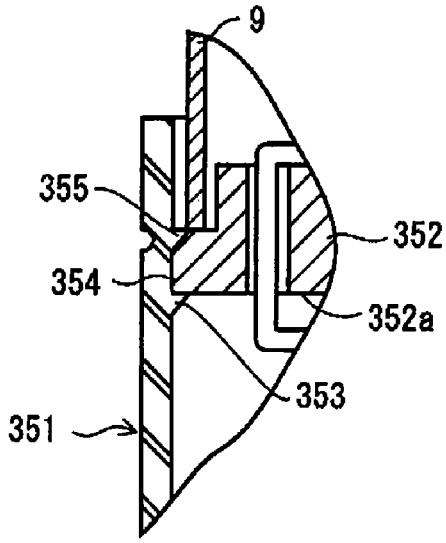
FIGS. 14A and 14B show modification examples of a mount member with an anti-fall mechanism.
Figure 14B:
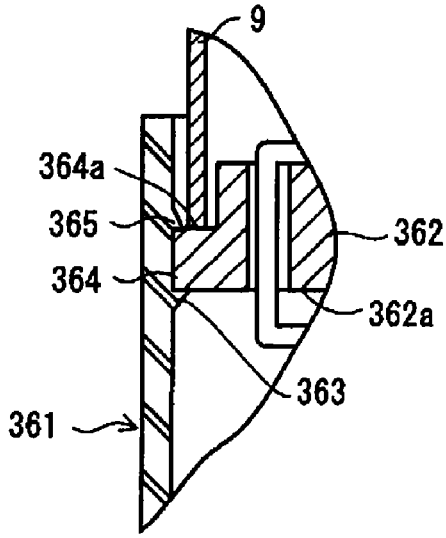

FIGS. 14A and 14B show modification examples of a mount member with an anti-fall mechanism.

Below, the structures that are the same as those of the LED light bulb 1 pertaining to First Embodiment are assigned the same reference numbers thereas, and the descriptions thereof are omitted.

Each of LED light bulbs pertaining to the modification examples shown in FIGS. 14A and 14B is the LED light bulb 1 pertaining to First Embodiment with an anti-fall mechanism for preventing the mount member 5 from falling off (detaching from) the case 7.

In the example shown in FIG. 14A, a case 351 includes stoppers 353 and protrusions 335. The stoppers 353 come in contact with a back surface 352*a* of a mount member 352. The protrusions 335 protrude toward the side surface of a large diameter portion 354 of the mount member 352. A plurality of (e.g., three) stoppers 353 and protrusions 355 are formed at equal intervals in the circumferential direction of the case 351.

Part of the side surface of the large diameter portion 354 closer to the globe 9 is tapered so that its shape conforms to the shape of the protrusions 355. To be more specific, in this tapered side surface, the large diameter portion 354 becomes closer to the central axis of the mount member 352 as it becomes farther from the base member 15 and closer to the globe 9 (as it becomes farther from the lower side and closer to the upper side of FIG. 14A).

By way of example, the protrusions 355 are formed by denting areas of the outer circumferential surface of the case 351, in which the protrusions 355 are to be positioned, with the use of a punch after inserting the mount member 352 into the case 351 such that the mount member 352 is in contact with the stoppers 353.

In the example shown in FIG. 14B, the case 361 includes backside stoppers 363 and frontside stoppers 365. The backside stoppers 363 come in contact with a back surface (the lower surface in FIG. 14B) of the mount member 362. The frontside stoppers 365 come in contact with the front surface (the upper surface in FIG. 14B) of a large diameter portion 364 of the mount member 362. A plurality of (e.g., three) backside stoppers 363 and frontside stoppers 365 are formed at equal intervals in the circumferential direction of the case 361.

The frontside stoppers 365 are tapered. In the tapered frontside stoppers 365, the inner diameter of the case 361 decreases toward the direction along which the mount member 362 is pressed into the case 361. To be more specific, in the frontside stoppers 365, the case 361 becomes closer to the central axis of the mount member 362 as it becomes farther from the globe 9 and closer to the base member 15 (as it becomes farther from the upper side and closer to the lower side of FIG. 14B).

Figure 15:
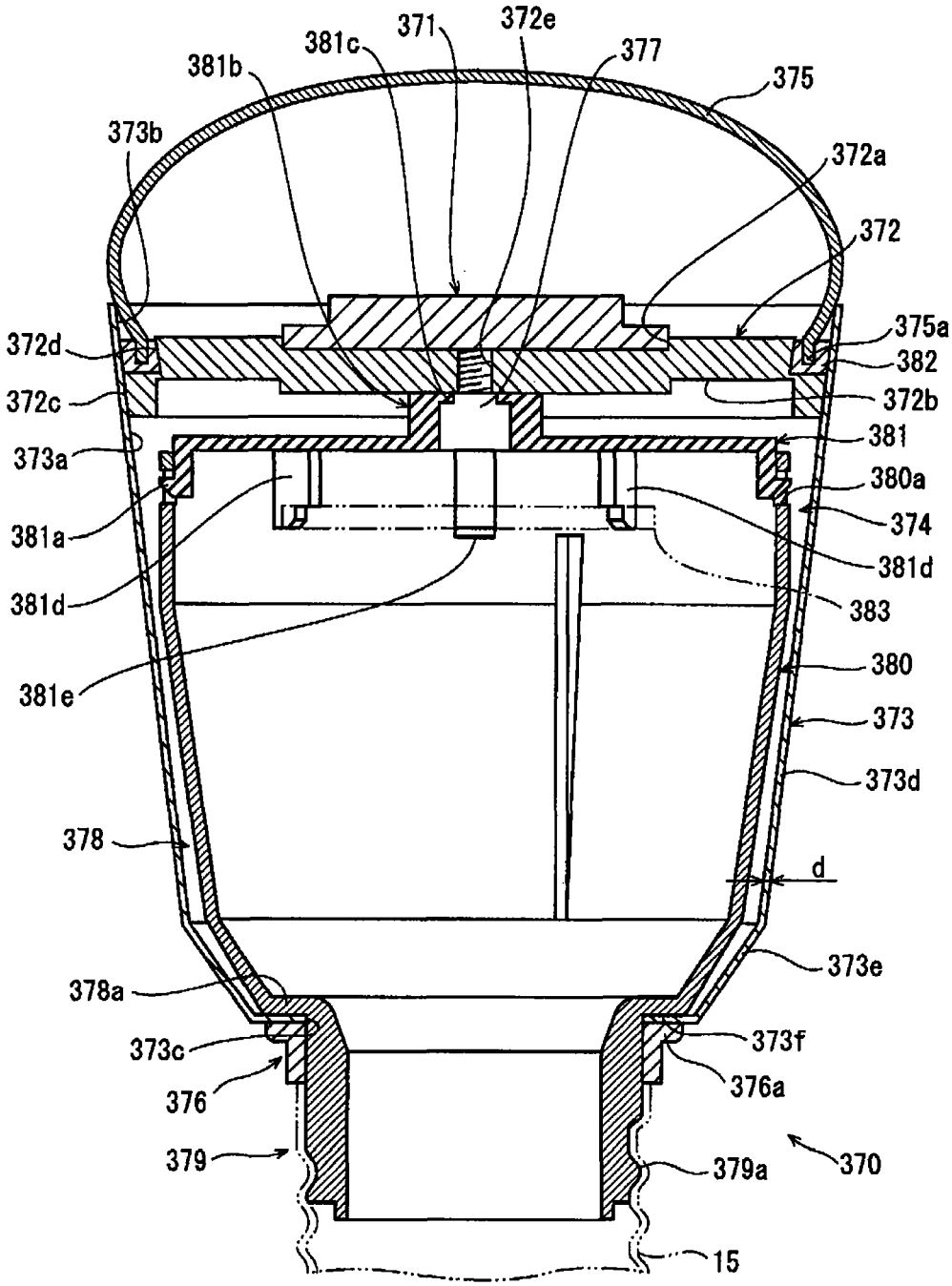
FIG. 15 shows a modification example in which the mount member and the circuit holder are connected to each other.

FIG. 15 shows a modification example in which the mount member and the circuit holder are connected to each other.

It should be noted that FIG. 15 shows characteristic parts of the present modification example. Components of the LED light bulb shown in FIG. 15 that basically have the same structures as those of the LED light bulb 1 pertaining to First Embodiment are omitted from the following description.

An LED light bulb 370 pertaining to the present modification example is different from the LED light bulb 1 pertaining to First Embodiment in that a mount member 372 and a circuit holder 381 are connected to each other.

The LED light bulb 370 is composed of an LED module 371, a mount member 372, a case 373, a lighting circuit (not illustrated), a circuit holder 374, a globe 375, a base 15 (a part of which is illustrated using imaginary lines), an externally fit member 376, and a connector member 377.

As with First Embodiment, the LED module 371 is composed of a substrate, one or more LEDs, a sealing member, etc. In FIG. 15, the LED module 371 is illustrated as a single integrated component using a single type of hatching.

The mount member 372 has a shape of a circular plate. The front surface of the mount member 372 has a recess 372*a*, in which the LED module is mounded. The back surface of the mount member 372 has a recess 372*b* for reducing the weight of the LED light bulb 370. An internal thread portion 372*e* is formed at the center of the mount member 372. The connector member 377, which is a screw having an external thread (described later), is screwed and fit into the internal thread portion 372*e*.

The internal thread portion 372*e* may or may not penetrate through the mount member 372. When the internal thread portion 372*e* does not penetrate through the mount member 372, it is provided as a recess in the substantially central part of the back surface of the mount member 372.

The mount member 372 has a large diameter portion 372*c* and a small diameter portion 372*d*; that is, the outer circumferential surface of the mount member 372 has a step. The large diameter portion 372*c* comes in contact with an inner circumferential surface 373*a* of the case 373. As with First Embodiment, a tip 375*a* of the globe 375 at an opening of the globe 375 is inserted in a space between the small diameter portion 372*d* and the inner circumferential surface 373*a* of the case 373, and secured in this space by an adhesive material 382 or the like.

The globe 375 has a shape of a dome, or an oval hemisphere, that protrudes from the case 373 (the transverse diameter of the oval hemisphere is equivalent to a diameter of the opening of the case 373). In addition to securing the globe 375 to the case 373, the adhesive material 382 also secures the case 373 to the mount member 372.

The case 373 has a shape of a cylinder having openings at both ends. An opening 373*b* at a first end portion of the case 373 (an end portion closer to the LED module 371) is larger in diameter than an opening 373*c* at a second end portion of the case 373 (an end portion closer to the base 15).

To be more specific, the case 373 has a shape of a cylinder with a bottom. The case 373 has two tapered portions 373*d* and 373*e* and a bottom portion 373*f*. Each of the tapered portions 373*d* and 373*e* decreases in diameter from the first end portion toward the second end portion of the case 373. The bottom portion 373*f* is contiguous with one end of the tapered portion 373*e* and extends inward toward the central axis of the case 373. The central part of the bottom portion 373*f* has an opening, which represents the opening 373*c* at the second end portion of the case 373. The opening 373*c* functions as a through hole. The first end portion and the second end portion of the case 373 are also referred to as a large diameter end portion and a small diameter end portion, respectively. The openings at the large diameter end portion and the small diameter end portion of the case 373 are also referred to as a large diameter opening and a small diameter opening, respectively.

By giving the same angle of inclination to the inner circumferential surface of the tapered portion 373*d* of the case 373 and the side surface of the large diameter portion 372*c* of the mount member 372, it is possible to (i) increase the area of the portion of the mount member 372 that is in contact with the case 373, and (ii) unfailingly bring the mount member 372 into contact with the case 373 with no space therebetween by pressing the mount member 372 into the case 373.

The circuit holder 374 includes a body 378 and a protruding cylindrical portion 379 having a cylindrical shape. The body 378 is positioned inside the case 373. The protruding cylindrical portion 379, which is contiguous with the body 378, penetrates through the small diameter opening 373*c* of the case 373 and protrudes toward the outside of the case 373.

The body 378 is too large in diameter to pass through the small diameter opening 373*c* of the case 373. The body 378 has a contact portion 378*a* that, when the protruding cylindrical portion 379 has completely penetrated through the small diameter opening 373*c* of the case 373, comes in contact with the inner surface of the small diameter end portion (bottom portion 373*f*) of the case 373.

The circuit holder 374 is made up of a cylindrical body 380 and a cap 381. Part of the cylindrical body 380 penetrates through the small diameter opening 373*c* of the case 373 and protrudes toward the outside of the case 373. The remaining part of the cylindrical body 380 is positioned inside the case 373. The cap 381 covers an opening of said remaining part of the cylindrical body 380 that is positioned inside the case 373 (an opening that faces the mount member 372).

In other words, of the circuit holder 374 that is made up of the cylindrical body 380 and the cap 381, the body 378 is part of the circuit holder 374 that is positioned inside the case 273.

The protruding cylindrical portion 379 is part of the cylindrical body 380 that penetrates through the small diameter opening 373*c* of the case 373 and protrudes toward the outside of the case 373. The externally fit member 376 and the base 15 are attached to the outer circumferential surface of the protruding cylindrical portion 379. Thus, a part or an entirety of the outer circumferential surface of the protruding cylindrical portion 379 has an external thread 379*a*.

The cap 381 has a shape of a cylinder with a bottom. A cylindrical portion of the cap 381 is to be inserted into a large diameter end portion of the cylindrical body 380 having a large diameter (it goes without saying that the cylindrical body may instead be inserted into the cap). The cylindrical portion of the cap 381 has a plurality of (in the present example, two) latching pawls 381*a* that latch with a plurality of (in the present example, two) latching holes 380*a* formed in the large diameter end portion of the cylindrical body 380. In the course of inserting the cylindrical portion of the cap 381 into the cylindrical body 380, the latching pawls 381*a* latch with the latching holes 380*a*. This way, the cap 381 is attached to the cylindrical body 380 in a detachable manner. Note that the latching pawls and the latching holes serve their purposes as long as they can latch with each other, and may be provided in a reverse manner—i.e., the latching holes and the latching pawls may be formed in the cylindrical portion of the cap 381 and the cylindrical body 380, respectively. Although the latching holes 380*a* penetrate through the case 380 in FIG. 15, the effect of the latching holes 380*a* can be obtained also when the latching holes 380*a* are replaced with recesses in the case 373.

Each latching hole 380*a* in the cylindrical body 380 is larger in size than each latching pawl 381*a* in the cap 381. To be more specific, each latching hole 380*a* in the cylindrical body 380 is long in a direction along which the cylindrical portion of the cap 381 is inserted into the cylindrical body 380 (i.e., the central axis direction of the cylindrical body 380, which extends vertically in FIG. 15). That is, each latching hole 380*a* has a shape of, for example, a rectangle. This way, the cap 381 is attached to the cylindrical body 380 in such a manner that the cap 381 is movable in the direction along which it is inserted into the cylindrical body 380.

The cap 381 includes a protruding portion 381*b* at its center. The protruding portion 381*b* protrudes toward the mount member 372 and has a shape of a cylinder with a bottom. A bottom 381*c* of the protruding portion 381*b* has a through hole. A tip of the bottom 381*c* of the protruding portion 381*b* is flat and comes in contact with the back surface of the mount member 372 once the cap 381 has been connected to the mount member 372.

A screw with an external thread—or more specifically, the connector member 377 for connecting between the circuit holder 374 and the mount member 372—is inserted into the protruding portion 381*b*. At this time, the head of this screw comes into contact with the bottom 381*c* of the protruding portion 381*b*. This restricts the head of the connector member 377 from entering a space inside the protruding portion 381*b*.

The externally fit member 376 has an annular shape. The inner diameter of the externally fit member 376 fits the outer diameter of the protruding cylindrical portion 379. The externally fit member 376 has a contact portion 376*a* that comes into contact with the outer surface of the bottom portion 373*f* of the case 373 when the externally fit member 376 is attached to (fit around) the protruding cylindrical portion 379.

As with First Embodiment, the base 15 is an Edison screw into which the external thread 379*a* of the protruding cylindrical portion 379 is screwed and fit. As the protruding cylindrical portion 379 is screwed and fit into the base 15 along the external thread 379*a*, an end of the base 15 at an opening of the base 15 pushes the externally fit member 376 toward the bottom portion 373*f* of the case 373.

With the above structure, the bottom portion 373*f* of the case 373 (a portion of the case 373 around the small diameter opening of the case 373) is held between the contact portion 378*a* of the body 378 and the contact portion 376*a* of the externally fit member 376. Consequently, the circuit holder 374 is attached (secured) to the case 373.

A substrate 383, on which the electronic components of the lighting circuit are mounted, is held by a clamp mechanism composed of adjustment arms 381*d* and latching pawls 381*e* formed on the cap 381 (in FIG. 15, the substrate 383 is illustrated using an imaginary line).

As set forth above, the circuit holder 374 is attached to the case 373, and the mount member 372 is connected to the circuit holder 374. This way, the mount member 372 is secured to the case 373, which prevents the mount member 372 from falling off the case 373 in advance.

Furthermore, the cap 381 of the circuit holder 374 is attached to the cylindrical body 380 in such a manner that the cap 381 is movable along the central axis direction of the cylindrical body 380 (this direction is the same as the central axis direction of the case 373 and the direction along which the mount member 372 is inserted into the case 373). Due to such a structure, it is permissible that the position of the mount member 372 within the case 373 varies in different LED light bulbs as a result of variances in the diameter of the large diameter opening of the case 373, the outer diameter of the large diameter portion 372*c* of the mount member 372, the thickness of the mount member 372, etc. in different LED light bulbs.

Furthermore, since the mount member 372, the circuit holder 374 and the case 373 are thermally connected with one another, the heat generated in the LED module 371 can be conducted from the mount member 372 to the case 373 via the circuit holder 374.

The present modification example has described that in the circuit holder 374, the cap 381 is attached to the cylindrical body 380 in such a manner that the cap 381 is movable in the central axis direction of the cylindrical body 380. Alternatively, for example, the mount member 372 may be movably secured to the case 373 by utilizing other components.

One example utilizing other components is to attach the mount member to the circuit holder so that the circuit holder is movable in the central axis direction of the case. This can be achieved by, for example, extending the length of the connector member 377 (i.e., the screw having the external thread) shown in FIG. 15. In this structure, however, the mount member and the circuit holder do not come in contact with each other if the mount member is not inserted deep enough into the case.

The LED light bulb 370 pertaining to the present modification example is assembled as follows. The protruding cylindrical portion 379 of the circuit holder 374 is inserted into the case 373, so that it eventually penetrates through the small diameter opening 373*c* of the case 373 and protrudes toward the outside of the case 373. Then, the mount member 372 is pressed into the case 373 with the circuit holder 374 and the mount member 372 connected to each other by the connector member 377. Subsequently, the externally fit member 376 is fit around the protruding cylindrical portion 379. The circuit holder 374 and the mount member 372 are then attached to the case 373 with the bottom portion 373*f* of the case 373 held between the contact portion 378*a* of the body 378 of the circuit holder 374 and the contact portion 376*a* of the externally fit member 376.

In First Embodiment, the circuit holder 13 is attached to the case 7 as shown in FIG. 5A. The present modification example is different from First Embodiment in that the circuit holder 374, which is connected to the mount member 372, is attached to the case 373.

The circuit holder 374 and the mount member 372 are connected to each other by first connecting the cap 381 of the circuit holder 374 to the mount member 372 by the connector member 377, and then assembling together the cap 381 and the cylindrical body 380 into which the lighting circuit has been disposed.

(3) Shape

According to First Embodiment, the mount member 5 has a shape of a circular plate and includes the small diameter portion 33 and the large diameter portion 35 having different outer diameters. However, the shape of a mount member pertaining to the invention of the present application is not limited to that of the mount member 5 pertaining to First Embodiment.

The following describes modification examples for the mount member.

Figure 16A:
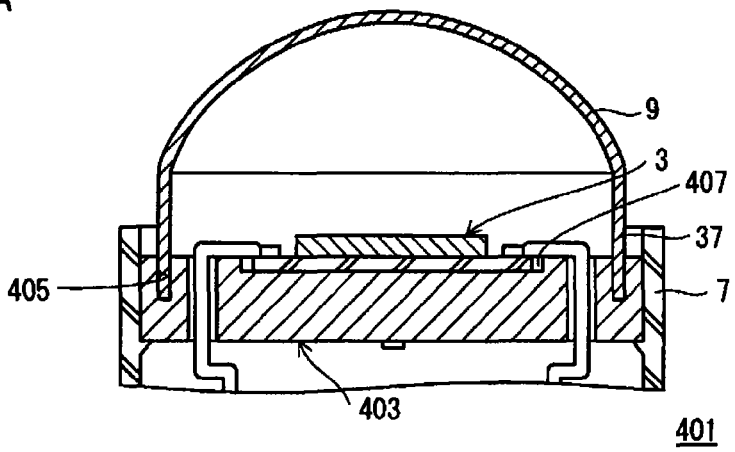
FIGS. 16A, 16B and 16C show modification examples of a mount member having a shape of a circular plate.
Figure 16B:
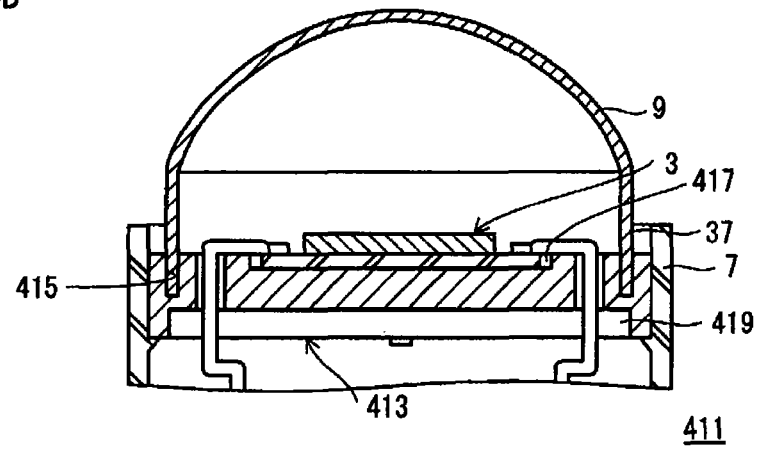
Figure 16C:
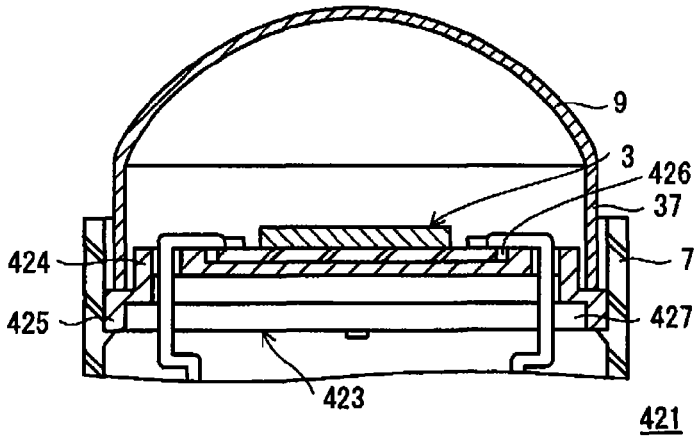

FIGS. 16A, 16B and 16C show modification examples of a mount member having a shape of a circular plate.

Below, the structures that are the same as those of the LED light bulb 1 pertaining to First Embodiment are assigned the same reference numbers thereas, and the descriptions thereof are omitted.

As with First Embodiment, a mount member 403 shown in FIG. 16A has a shape of a circular plate. The mount member 403 of FIG. 16A is different from the mount member 5 pertaining to First Embodiment in that it has a uniform outer diameter—i.e., there is no step in the outer circumferential surface thereof.

A recess 407, in which the LED module 3 is mounted, is formed in a front surface of the mount member 403. The front surface of the mount member 403 also has an attachment groove 405, in which a rim 37 of the globe 9 at an opening of the globe 9 is inserted and attached. An LED light bulb comprising this mount member 403 is illustrated in FIG. 16A with a reference number "401".

Similarly to the above-described mount member 403, a mount member 413 shown in FIG. 16B has a shape of a circular plate, and an attachment groove 415 for a globe 9 and a recess 417 for an LED module 3 are formed in a front surface of the mount member 413. The mount member 413 of the present example is different from the above-described mount member 403 in that a back surface of the mount member 413 is recessed in the thickness direction of the mount member 413 (this recessed portion is referred to as a recess 419) This way, the mount member 413 makes a greater contribution to reduce the weight of the LED light bulb than the above-described mount member 403.

As described above with reference to FIG. 5B, the mount member 413 with the recess 419 and the mount member 403 without the recess 419 equally have the function of allowing conduction of the heat from the LED module 3 to the case 7. An LED light bulb comprising this mount member 413 is illustrated in FIG. 16B with a reference number "411".

Similarly to First Embodiment, a mount member 423 shown in FIG. 16C has a shape of a circular plate by appearance. The mount member 423 has a small diameter portion 424 and a large diameter portion 425. A front surface of the mount member 423 has a recess 426.

As with the above-described mount member 413, the mount member 423 of the present example is different from the mount member 5 of First Embodiment in that a back surface of the mount member 423 is recessed in the thickness direction of the mount member 423 (this recessed area is referred to as a recess 427). This way, the mount member 423 makes a greater contribution to reduce the weight of the LED light bulb than the above-described mount member 403, without lowering its function of allowing conduction of the heat from the LED module 3 to the case 7. An LED light bulb comprising this mount member 423 is illustrated in FIG. 16C with a reference number "421".

Although manufacturing methods and the like for the mount members shown in FIGS. 16A to 16C are not specifically described herein, these mount members may be manufactured using known technology (e.g., by machining a columnar material or by casting). Alternatively, these mount members may be manufactured from a plate-like material.

Figure 17A:
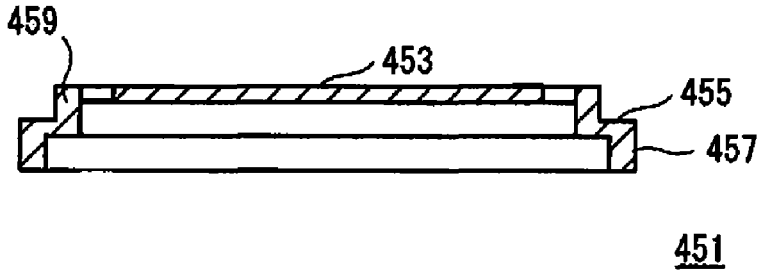
FIGS. 17A and 17B show an example of a mount member manufactured from a plate-like material.
Figure 17B:
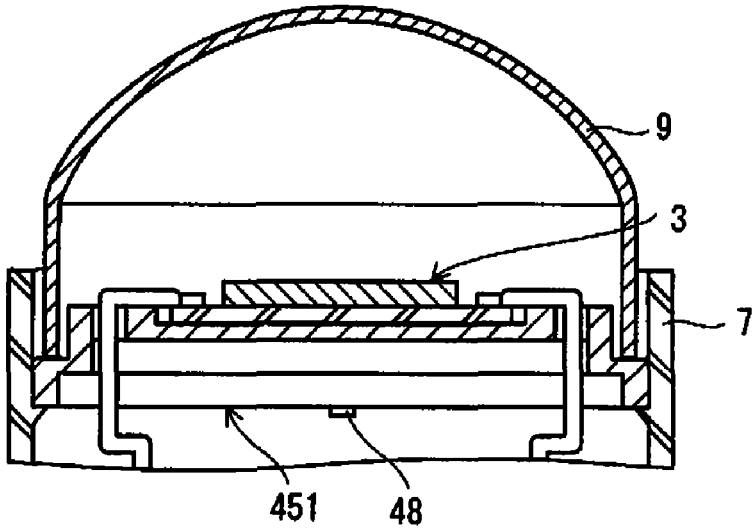

FIGS. 17A and 17B show an example of a mount member manufactured from a plate-like material. FIG. 17A is a cross-sectional view of such a mount member, and FIG. 17B is a cross-sectional view of part of an LED light bulb comprising such a mount member.

Below, the structures that are the same as those of the LED light bulb 1 pertaining to First Embodiment are assigned the same reference numbers thereas, and the descriptions thereof are omitted.

A mount member 451 shown in FIG. 17A is manufactured by, for example, stamping a plate-like material. In this case also, a part or an entirety of an upper surface of the mount member 451 is a mount area 453 on which the LED module (3) is to be mounted.

By appearance, the side surface of the mount member 451 includes a step 455, which is formed by a large diameter subsurface 457 and a small diameter subsurface 459. As shown in FIG. 17B, the large diameter subsurface 457 comes in contact with the case 7, and the globe 9 is attached between the small diameter subsurface 459 and the case 7.

The position of the mount member 451 is determined by stoppers 48 provided on the inner circumferential surface of the case 7.

Figure 18A:
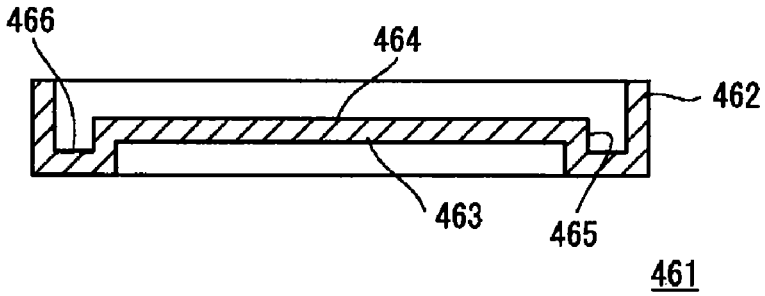
FIGS. 18A and 18B show other examples of a mount member manufactured from a plate-like material.
Figure 18B:
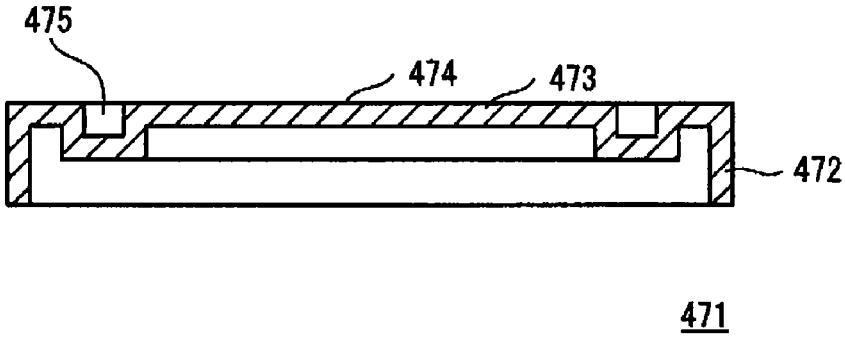

FIGS. 18A and 18B show other examples of a mount member manufactured from a plate-like material.

As shown in FIG. 18A, a mount member 461 includes a cylindrical wall 462 that has a shape of a cylinder and a bottom wall 463 that closes one end of the cylindrical wall 462. A central portion of the bottom wall 463 protrudes toward the other end of the cylindrical wall 462. This protruding central portion of the bottom wall 463 is referred to as a protrusion. A part or an entirety of this protrusion is a mount area 464 on which the LED module (3) is to be mounted.

An attachment groove 466, in which the globe 9 is to be attached, is formed by the following three surfaces: (i) the inner circumferential surface of the cylindrical wall 462; (ii) a surface of a portion of the bottom wall 463 other than the protrusion (the surface being contiguous with the cylindrical wall 462); and (iii) the outer circumferential surface of a portion of the protrusion that faces the cylindrical wall 462. The outer circumferential surface of the cylindrical wall 462 comes in contact with the inner circumferential surface of the case (7).

As shown in FIG. 17B, a mount member 471 includes a cylindrical wall 472 that has a shape of a cylinder, and a bottom wall 473 that closes one end of the cylindrical wall 472. A part or an entirety of a central portion of the bottom wall 473 is a mount area 474 on which the LED module (3) is to be mounted.

An attachment groove 475, in which the globe 9 is to be attached, is contiguously formed on the bottom wall 473 in a circle in proximity to the cylindrical wall 472. The outer circumferential surface of the cylindrical wall 472 comes in contact with the inner circumferential surface of the case (7).

2. Case

First Embodiment has described that a portion of the case 7 into which the mount member 5 is inserted has a straight wall. However, this portion of the case 7 may have a different shape.

FIGS. 19A, 19B, 19C and 19D show modification examples of a case.

As shown in FIGS. 19A, 19B, 19C and 19D, cases 501, 511, 521 and 531 each have a flared opening at an end portion thereof closer to the globe.

To conform to such a shape, the outer diameter of each of the mount members 503 and 513, which are fit inside their respective cases, decreases from one end (the front side) thereof closer to the globe 9 toward the other end (the back side) thereof closer to the lighting circuit.

The inner circumferential surfaces 505, 517 and 525 of the cases 501, 511 and 521 fit the outer circumferential surfaces of the mount members 503 and 513. The mount members 503 and 513 are positioned in an area where the inner diameter of the cases 501, 511 and 521 matches the outer diameter of the mount members 503 and 513.

As with First Embodiment, the mount members 503 and 513 are attached to the cases 501, 511 and 521 using a press-in method.

Figure 19D:
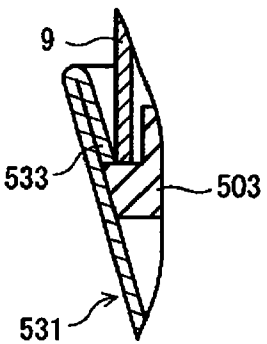
FIGS. 19A, 19B, 19C and 19D show modification examples of a case.
Figure 19C:
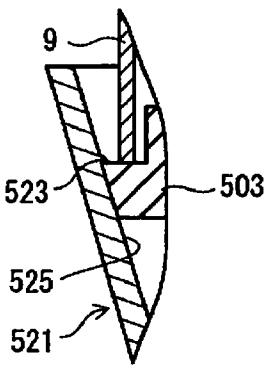
Figure 19B:
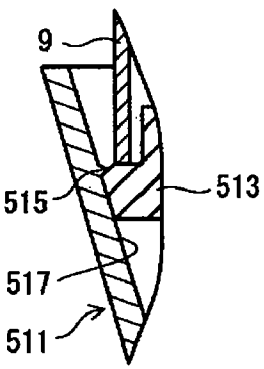
Figure 19A:
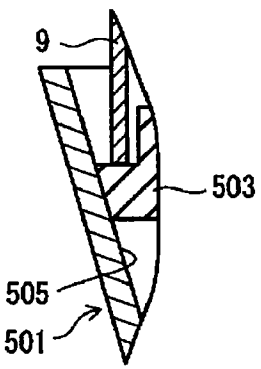

The cases 511 and 521 basically have the same structure as the case 501 shown in FIG. 19A. Additionally, the cases 511 and 521 also include protrusions 515 and frontside stoppers 523, respectively, for preventing the mount members from falling off the cases 511 and 521 as explained above with reference to FIG. 11. The protrusions 515 protrude from the inner circumferential surface 517 of the case 511, and have a shape of an isosceles triangle in cross section. The frontside stoppers 523 protrude from the inner circumferential surface 525 of the case 521, and have a shape of a triangle in cross section with one side of the triangle in contact with an upper surface of the mount member 503.

Especially when a case has a flared opening, the above-described protrusions are preferably formed on a portion of the case that has the substantially largest inner diameter. This is because when the case comes in contact with the mount member in such a portion of the case that has the substantially largest inner diameter, the area of the portion of the mount member that is in contact with the case is substantially maximized. Formation of the protrusions also enlarges the area of the portion of the mount member that is in contact with the case.

The protrusions may be provided either at equal intervals, or at irregular intervals, in the circumferential direction of the case. Furthermore, the protrusions may be provided in a plurality of (e.g., two and three) rows that are distanced from one another in the central axis direction of the case. By forming the protrusions in the above-described manners, the physical connection between the case and the mount member can be enhanced.

Alternatively, the protrusions may be continuously provided in a circle in the circumferential direction of the case. Alternatively, the protrusions may be provided in such a manner that they are aligned in tiers (e.g., in two or three tiers) in the central axis direction of the case. By forming the protrusions in the above manners, the physical connection between the case and the mount member can be further enhanced.

The case 531 of FIG. 19D has a thin wall thickness. A first end portion of the case 531, which is closer to the globe 9, is bent inward. This first end portion in a bent state is referred to as a bent portion 533. Because the tip of the bent portion 533 is positioned on (or above) an upper surface of the mount member 503, the mount member 503 can be prevented from falling off the case 531.

It is preferable for the case 531 to have a wall thickness of 1 [mm] or less. The case 531 serves its purposes as long as it sufficiently functions as a heat sink (i.e., the function of efficiently allowing dissipation of heat conducted from the mount member 503). It is not necessary for the case 531 to store therein the heat conducted from the mount member 503. Therefore, the wall thickness of the case 531 need not be thick.

3. Relationships between Case and Mount Member (1) Attachment (Connection) Method According to First Embodiment, the mount member 5 is attached to the case 7 by pressing the mount member 5 into the case 7. Alternatively, if the shapes of the mount member and the case are changed, the mount member and the case may be connected with each other in a different manner.

Figure 20:
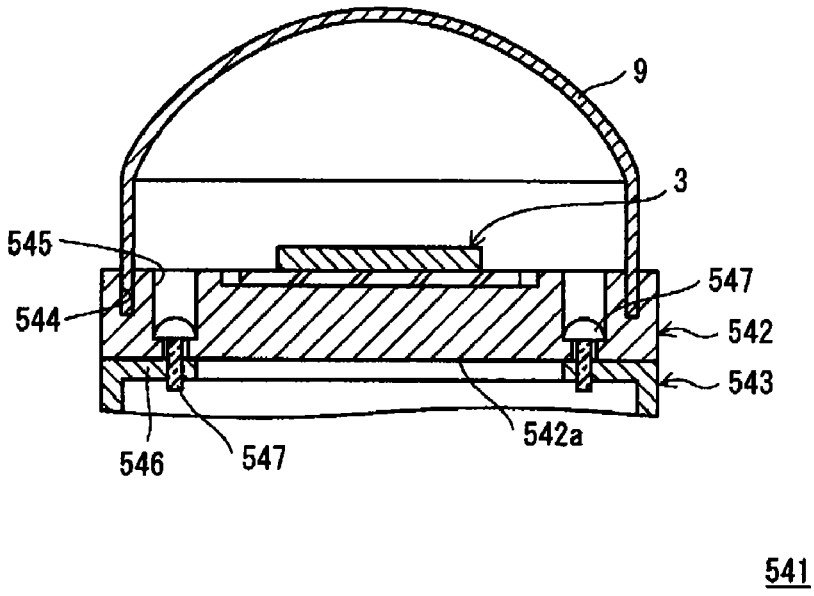
FIG. 20 shows another method for connecting the case to the mount member.

FIG. 20 shows another method for connecting the case to the mount member.

Similarly to First Embodiment, an LED light bulb 541 shown in FIG. 20 is composed of an LED module 3, a mount member 542, a case 543, a globe 9, a lighting circuit (11), a circuit holder (13), and a base member (15).

The mount member 542 has an attachment groove 544 in which the globe 9 is attached, and screw holes 545 using which the mount member 542 is attached to the case 543. The case 543 has a shape of a cylinder. The case 543 has a flange portion 546 that extends from a first end of the case 543 to which the base member 15 is not attached, toward the central axis of the case 543.

The mount member 542 is attached to the case 543 by securing the mount member 542 to the case 543 with screws 547 (by screwing the screws 547 into the mount member 542 and the case 543), with a back surface of the mount member 542 in contact with the flange portion 546 of the case 543.

In this case also, given that an area of a portion of the mount member 542 that is in contact with the case 543 is S1, and that an area of a portion of the mount member 542 that is in contact with the LED module 3 is S2, the contact area fraction S1/S2 satisfies the following relationship, as described earlier.

$$0.5 \leqq S1/S2$$

Figure 21:
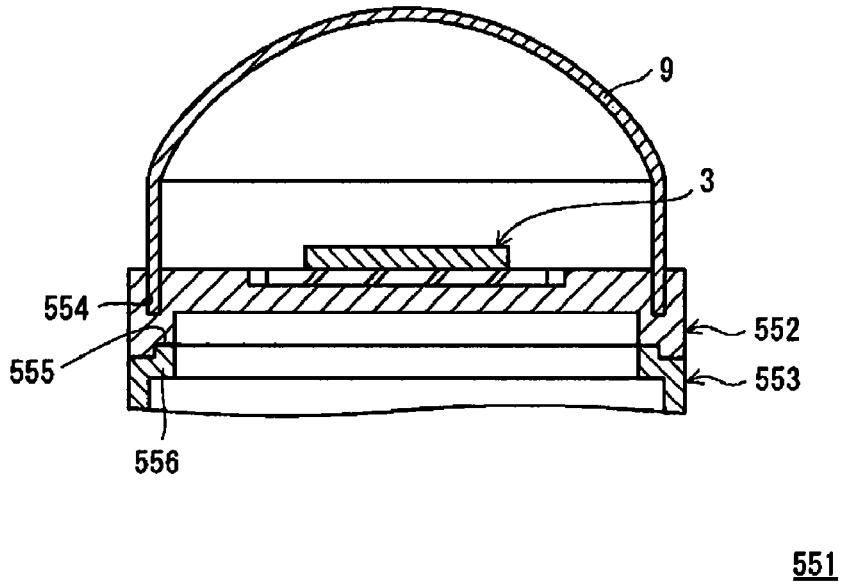
FIG. 21 shows yet another method for connecting the case to the mount member.

FIG. 21 shows yet another method for connecting the case to the mount member.

Similarly to First Embodiment, an LED light bulb 551 shown in FIG. 21 is composed of an LED module 3, a mount member 552, a case 553, a globe 9, a lighting circuit (11), a circuit holder (13), and a base member (15).

The mount member 552 has an attachment groove 554 in which the globe 9 is attached, and a step portion 555 at which the mount member 552 is attached to the case 553. The case 553 has a cylindrical shape. The case 553 has a fitting portion 556 in a first end thereof to which the base member 15 is not attached. The fitting portion 556 fits into the step portion 555 of the mount member 552.

The mount member 552 is attached to the case 553 by making use of the fitting portion 556 of the case 553 fitting into the step portion 555 of the mount member 552.

(2) Thickness

The above embodiments have not provided specific descriptions about the relationship between the thicknesses of a mount member and the wall thickness of a case. However, it is preferable that the thickness of the portion of the mount member on which the LED module is mounted be greater than the wall thickness of the case. This is due to a difference between the function of the portion of the mount member on which the LED module is mounted and the function of the case.

To be more specific, the portion of the mount member on which the LED module is mounted needs to store heat from the LED module, at least temporarily, and therefore to have both (i) the function of storing the heat and (ii) the function of allowing conduction of the heat. In contrast, the case does not need to have the function of storing the heat, because once the heat generated in the LEDs has been conducted from the mount member to the case, the heat is dissipated from the case to the open air.

Therefore, although it is not necessary to make the case with a thick wall thickness, it is necessary for the thickness of the portion of the mount member on which the LED module is mounted and which needs to have the function of storing the heat to be greater than the wall thickness of the case. In other words, the wall thickness of the case can be smaller than the thickness of the mount member. This way, the weight of the LED light bulb can be reduced.

It is preferable that the thickness of a portion of the mount member that is in contact with the LED module (to be exact, the substrate) be (i) greater than or equal to the thickness of the substrate of the LED module, and (ii) smaller than or equal to a thickness that is three times the thickness of the substrate of the LED module, for the following reasons. In a case where a total length of the LED light bulb is predetermined, if the thickness of the portion of the mount member that is in contact with the LED module is greater than a thickness that is three times the thickness of the substrate, then sufficient clearance cannot be provided between the lighting circuit (circuit holder) and the mount member. This increases the possibility that the heat poses a detrimental effect on the electronic components of the lighting circuit. On the other hand, if the thickness of the portion of the mount member that is in contact with the LED module is smaller than the thickness of the substrate, then the mount member will not have sufficient mechanical properties to allow the LED module to be mounted thereon.

(3) Misalignment of Optical Axes

Third Embodiment has described that, in order to secure both the heat dissipation properties and the light-weight properties of the LED light bulb, it is preferable for the wall thickness of the case 203 to satisfy the following relationship: 200 [μm]≦the wall thickness of the case 203≦500 [μm]. Given the above relationship is satisfied, if a surface of a portion of the mount member 211 that is in contact with the case 203 is tapered (inclined) as shown in FIG. 11, then it is more likely that the mount member 211 is tilted with respect to the central axis of the case 203 when inserting the mount member 211 into the case 203. If the mount member 211 is tilted, then the optical axis of the LED light bulb 201 will also be tilted with respect to the lamp axis.

By way of example, the tilt of the mount member can be fixed by bringing the surface of the portion of the mount member that is in contact with the case in parallel with the direction along which the mount member is inserted into the case.

Figure 22:
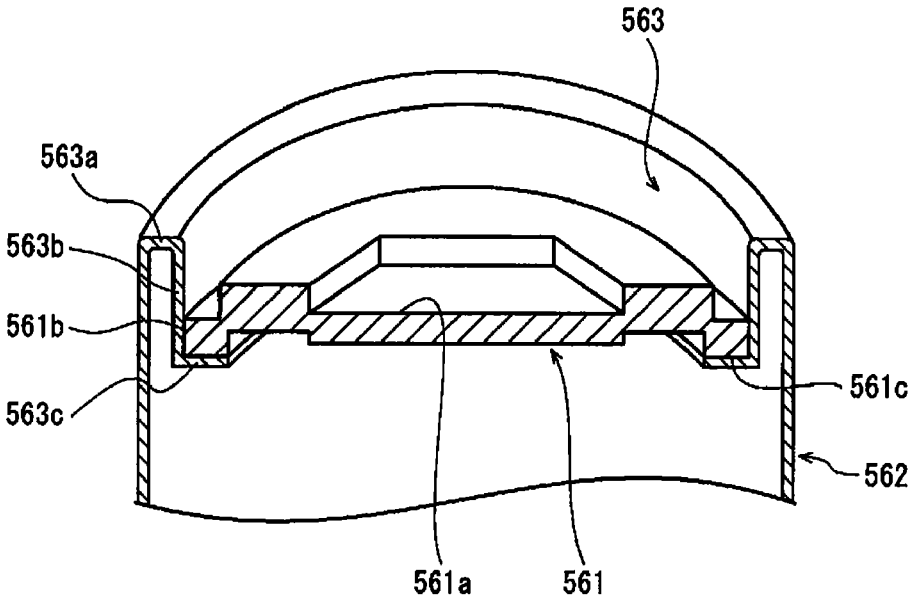
FIG. 22 illustrates a first example in which a surface of a portion of the mount member that is in contact with the case has been made parallel with the direction along which the mount member is inserted into the case.

FIG. 22 illustrates a first example in which the surface of the portion of the mount member that is in contact with the case has been made parallel with the direction along which the mount member is inserted into the case.

As with each of the above embodiments, a mount member 561 is attached to a case 562 by inserting the mount member 561 into an opening of the case 562. For example, one end portion of the case 562, which originally had a shape of a cylinder with a constant diameter, is bent inward as shown in FIG. 22. This end portion is referred to as a bent portion 563.

The bent portion 563 includes (i) an inward bent section 563, which has been bent inward, (ii) a reverse section 563*b*, which has been bent to extend in the central axis direction of the case 562, and (iii) an extended section 563*c*, which has been bent to extend from one end of the reverse section 563*b* (opposite from the other end that is contiguous with the inward bent section 563*a*) toward the central axis of the case 562. The extended section 563*c* has a support function for supporting the mount member 571.

The mount member 561 has a shape of a circular plate. The central portion of the mount member 561 has a recess 561*a*, in which the LED module is mounted. The outer circumferential surface of the mount member 561 has a step so as to form a groove together with the case 562. The globe is inserted in this groove formed by the outer circumferential surface of the mount member 561 and the case 562.

The diameter of an outermost circumferential surface 561*b* of the mount member 561 fits the inner diameter of the reverse section 563*b* of the bent portion 563, the reverse section 563*b* having a shape of a circle in a plan view. The outermost circumferential surface 561*b* is also parallel with the central axis of the case 562.

Once the mount member 561 has been attached to the case 562, the outermost circumferential surface 561*b* of the mount member 561 is in contact with the reverse section 563*b* of the case 562, and a circumferential rim portion 561*c* of the back surface of the mount member 561 is in contact with the extended section 563*c* of the case 562.

As set forth above, the outermost circumferential surface 561*b* of the mount member 561 and the reverse section 563*b* of the case 562 are parallel with the central axis of the case 562. Therefore, when inserting the mount member 561 into the case 562, the mount member 561 is not easily tilted, which facilitates trouble-free insertion of the mount member 561. Accordingly, the mount member 561 should be pushed into the case 562 until the entire circumferential rim portion 561*c* of the back surface of the mount member 561 comes in contact with the extended section 563*c* of the bent portion 563.

The bent portion 563 represents the opening of the case 562 through which the mount member 561 is inserted. When inserting the mount member 561, the bent portion 563 undergoes elastic deformation. Therefore, even if the mount member 561 is slightly tilted at the time of the insertion, such a tilt of the mount member 561 will be permissible. When the entire circumferential rim portion 561*b* of the back surface of the mount member 561 has come in contact with the extended section 563*c* of the bent portion 563, the mount member 561 has been attached to the case 562 while being perpendicular to the central axis of the case 562.

Figure 23:
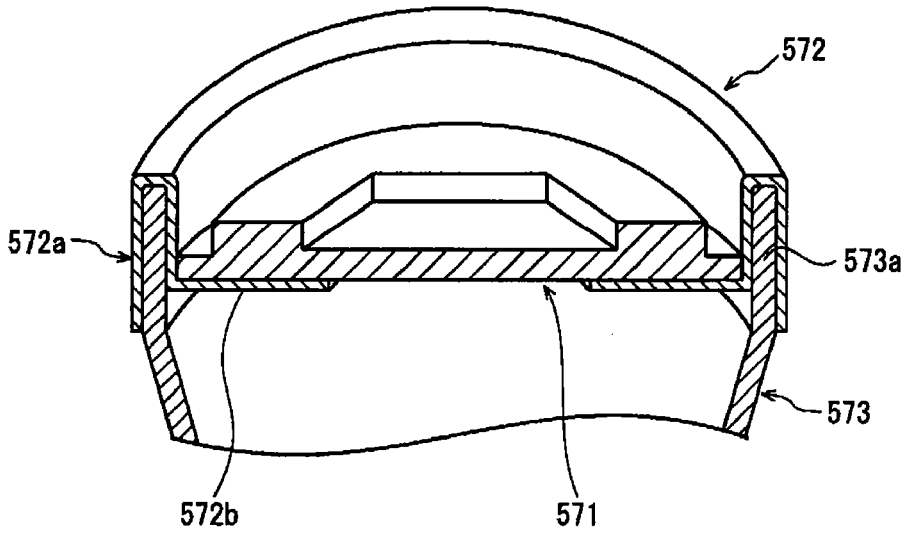
FIG. 23 illustrates a second example in which a surface of a portion of the mount member that is in contact with the case has been made parallel with the direction along which the mount member is inserted into the case.

FIG. 23 illustrates a second example in which the surface of the portion of the mount member that is in contact with the case has been made parallel with the direction along which the mount member is inserted into the case.

In the first example, one end portion of the case 562, which originally had a shape of a cylinder with a constant diameter, has been bent inward. In contrast, in the second example, a portion that corresponds to the bent portion 563 of the case 562 pertaining to the first example is considered as a separate member distinct from the case 562. That is to say, in the second example, the mount member is attached to the case via this separate member.

As with the first example, a mount member 571 pertaining to the second example has a shape of a circular plate, and the outer circumferential surface of the mount member 571 has a step. The mount member 571 is attached to the case 573 via a cap member 572. The cap member 572 closes an opening of the case 573. From its shape, the cap member 572 could also be referred to as a crown member.

The cap member 572 is made up of a clip portion 572*a* and an extended portion 572*b*. The clip portion 572*a* is attached to an end portion 573*a* of the case 573, in such a manner that it clips the end portion 573*a*, covering the outer circumferential surface and the inner circumferential surface of the end portion 573*a*. The extended portion 572*b* extends from an end of the clip portion 572*a* positioned on the inner circumferential surface of the case 573, toward the central axis of the case 573. The extended portion 572*c* also has a support function for supporting the mount member 571.

A part of the clip portion 572 that is positioned inside the case 573 is parallel with the central axis of the case 573.

The case 573 is made of a cylindrical body having a cone-like shape. The end portion 573*a* of the case 573, to which the mount member 571 is attached, has a straight wall extending in parallel with the central axis of the cylindrical body. A portion of the case 573 other than the end portion 573*a* has a shape of a cone—i.e., decreases in diameter from one end thereof that is contiguous with the end portion 573*a* toward the other end thereof (an end of the case 573 opposite from the end portion 573*a*).

The mount member 571 is attached to the case 573 as follows. First, the mount member 571 is inserted (fit) into the cap member 572. Here, the inner circumferential surface of the cap member 572 and the outer circumferential surface of the mount member 571 are parallel with the central axis of the case 573, as stated above. Therefore, when inserting the mount member 571, the mount member 571 is not easily tilted. This facilitates trouble-free insertion of the mount member 571. Accordingly, the mount member 561 should be pushed into the cap member 572 until the circumferential rim portion of the back surface of the mount member 571 entirety comes in contact with the extended portion 572*b*.

Part of the clip portion 572*a* that actually clips the end portion 573*a* of the case 573 has a shape of a letter "U" in longitudinal cross section. Thus, when inserting the mount member 571, this part of the clip portion 572*a* undergoes elastic deformation. Therefore, for example, even if the mount member 571 is slightly tilted at the time of the insertion, such a tilt of the mount member 571 will be permissible.

The cap member 572 is attached to the case 573 in the following manner. After covering the end portion 573*a* of the case 573 with the clip portion 572*a* of the cap member 572, part of the clip portion 572*a* that is positioned on the outer circumferential surface of the case 573 is pressed (crimped). Consequently, the surfaces of the clip portion 572*a* covering the outer and inner circumferential surfaces of the end portion 573*a* of the case 573 hold the end portion 573*a* of the case 573 therebetween. This way, the cap member 572, on which the mount member 571 has been mounted, is attached to the case 573.

4. Positional Relationship between LED Module and Case

First Embodiment has described that the LED-mounted surface of the substrate 17 of the LED module 3 is positioned more inward (closer to the base member 15) than the edge surface of the first end portion of the case 7 is, as exemplarily shown in FIG. 1.

However, the present invention is not limited to the above case in which, as in First Embodiment, the LED-mounted surface of the substrate is positioned more inward than the edge surface of the first end portion of the case 7 is. Alternatively, for example, the LED-mounted surface of the substrate may be positioned more outward (farther from the base member) than the edge surface of the first end portion of the case is. Alternatively, the LED-mounted surface of the substrate and the edge surface of the first end portion of the case may be flush with each other.

Figure 24:
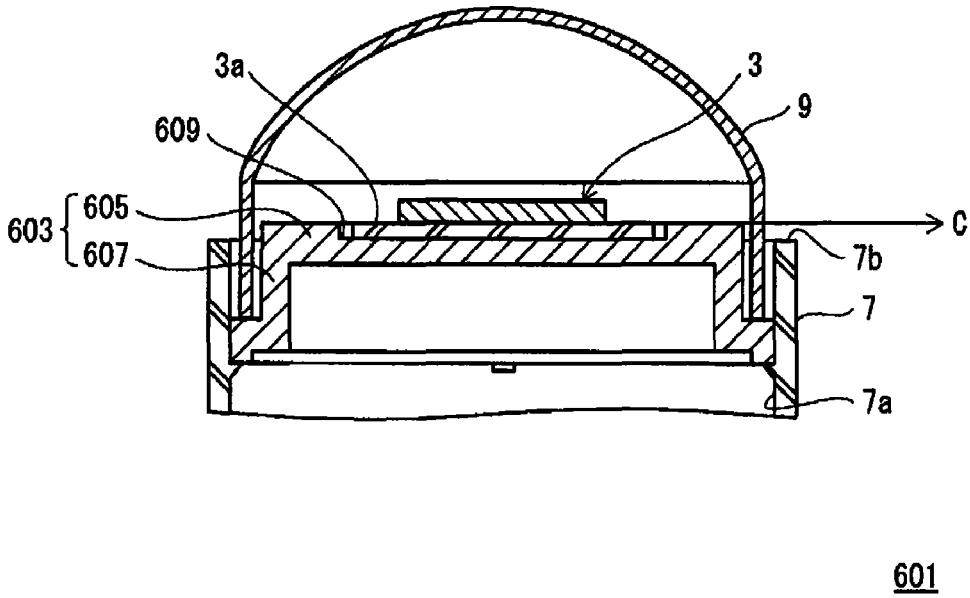
FIG. 24 shows a modification example where an LED-mounted surface of the substrate is positioned more outward than the edge surface of the first end portion of the case is.

FIG. 24 shows a modification example where the LED-mounted surface of the substrate is positioned more outward than the edge surface of the first end portion of the case is.

Similarly to First Embodiment, an LED light bulb 601 shown in FIG. 24 is composed of an LED module 3, a mount member 603, a case 7, a globe 9, a lighting circuit (11), a circuit holder (13), and a base member (15). Note, illustration of the lighting circuit (11), the circuit holder (13) and the base member (15) is omitted from FIG. 24.

The mount member 603 has a shape of a cylinder with a bottom. The mount member 603 is made up of a bottom wall 605 and a circumferential wall 607. A recess 609, in which the LED module is mounted, is formed in the bottom wall 605. The circumferential wall 607 is made up of a large diameter portion and a small diameter portion. The outer circumferential surface of the large diameter portion is in contact with an inner circumferential surface 7*a* of the case 7. A tip of the globe 9 at an opening of the globe 9 is inserted in a space between the inner circumferential surface 7*a* of the case 7 and the small diameter portion of the circumferential wall 607, and secured in this space by an adhesive material or the like.

An LED-mounted surface 3*a* of the LED module 3 is positioned more outward in the direction along which the central axis of the LED light bulb 601 extends (closer to the apex of the globe 9 in FIG. 24) than an edge surface 7*b* of the first end portion of the case 7 is. Due to the above structure, the light emitted sideways (in the direction of arrow C in FIG. 24) from the LED module 3 is output as it is—i.e., sideways—from the LED light bulb 601.

In order for the light emitted sideways from the LED module 3 to be output as it is—i.e., sideways—from the LED light bulb 601, it is preferable that the LED-mounted surface 3*a* be positioned closer to the apex of the globe 9 than the recess 609 of the mount member 607 is (that is, positioned outside the recess 609).

Figure 25:
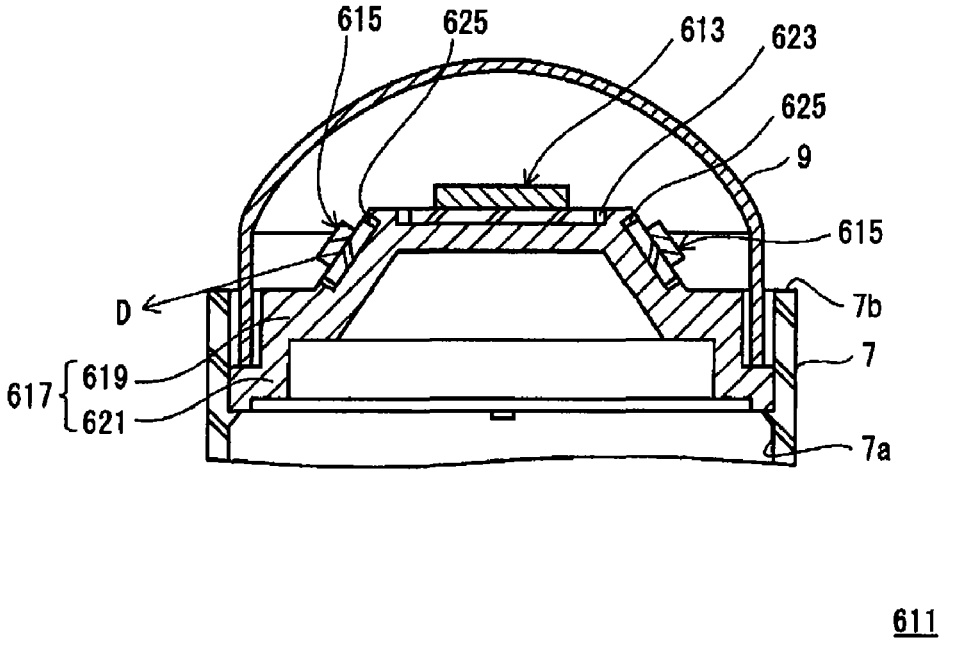
FIG. 25 shows another modification example where an LED-mounted surface of the substrate is positioned more outward than the edge surface of the first end portion of the case is.

FIG. 25 shows another modification example where the LED-mounted surface of the substrate is positioned more outward than the edge surface of the first end of the case is.

An LED light bulb 611 shown in FIG. 25 is composed of LED modules 613 and 615, a mount member 617, a case 7, a globe 9, a lighting circuit (11), a circuit holder (13), and a base member (15). Note, illustration of the lighting circuit (11), the circuit holder (13) and the base member (15) is omitted from FIG. 25 as well.

The mount member 617 has a shape of a cylinder with a bottom. The mount member 617 is made up of a bottom wall 619 and a circumferential wall 621. As shown in FIG. 25, the central portion of the bottom wall 619 protrudes toward the apex of the globe 9. To be more specific, the protruding central portion of the bottom wall 619 has a shape of a truncated pyramid. The top surface of the truncated pyramid has a recess 623, in which the LED module 613 is mounted. The side surfaces of the truncated pyramid have recesses 625, in which the LED modules 615 are mounted, respectively.

The circumferential wall 621 is made up of a large diameter portion and a small diameter portion. The outer circumferential surface of the large diameter portion is in contact with an inner circumferential surface 7*a* of the case 7. A tip of the globe 9 at an opening of the globe 9 is inserted in a space between the inner circumferential surface 7*a* of the case 7 and the small diameter portion of the circumferential wall 621, and secured in this space by an adhesive material or the like.

The LEDs provided in the LED module 613 are larger in number than the LEDs provided in each of the LED modules 615, in order to secure light (luminous flux) that travels along the direction in which the central axis of the LED light bulb 611 extends, and along imaginary arrows starting from the base member to the globe 9 (that is, imaginary arrows starting from the lower side to the upper side of FIG. 25).

The LED-mount surfaces of the LED modules 613 and 615 are positioned more outward (closer to the apex of the globe 9 in FIG. 25) than an edge surface 7*b* of the first end portion of the case 7 is. Due to the above structure, light can be emitted toward the rear side of the LED light bulb 611 (toward the direction of arrow D in FIG. 25) as shown in FIG. 25.

By stating that an LED-mount surface is positioned more outward than the edge surface 7*b* of the first end portion of the case 7 is, it means that, out of areas of the substrate in which the LEDs have been mounted, an area that is closest to the base member is positioned more outward than the edge surface 7*b* of the first end portion of the case 7 is.

5. Light Distribution Characteristics

In the previous section ("4. Positional Relationship between LED Module and Case"), the positional relationship between the LED module (the LED-mounted surfaces) and the case has been described. The beam angle of an LED light bulb can be adjusted by adjusting such a positional relationship.

Figure 26A:
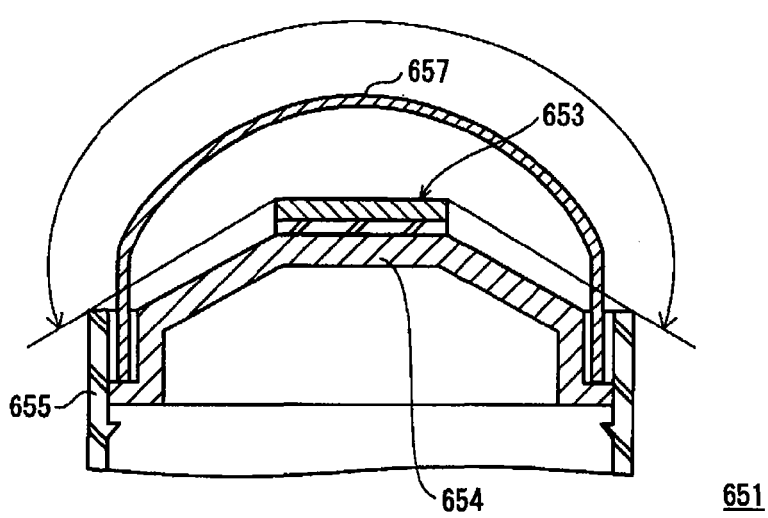
FIGS. 26A, 26B and 26C show modification examples for realizing different beam angles.
Figure 26B:
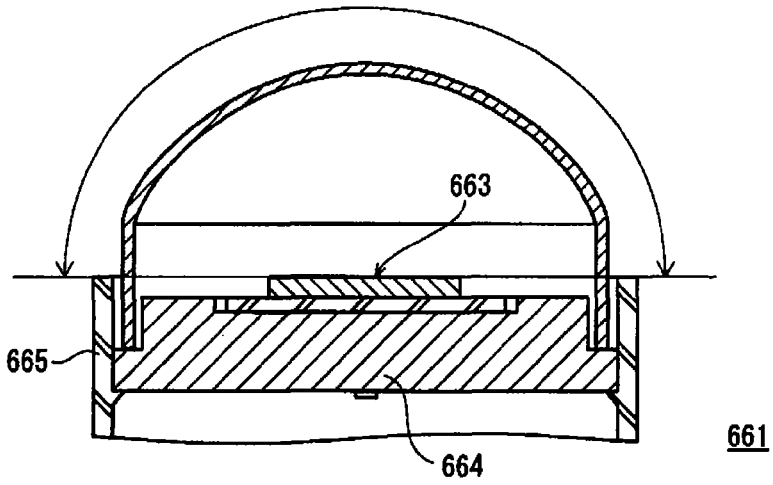
Figure 26C:
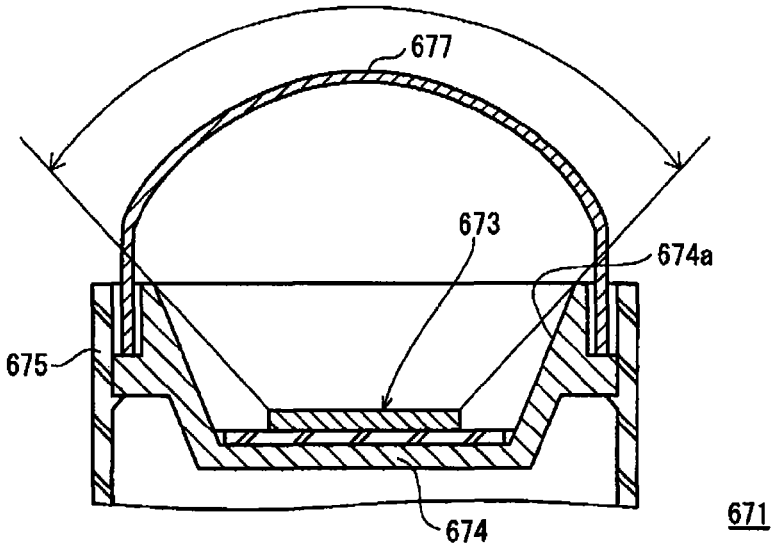

FIGS. 26A, 26B and 26C show modification examples for realizing different beam angles.

FIG. 26A shows an LED light bulb 651 in which an LED-mounted surface of an LED module 653 on a mount member 654 is closer to the apex of a globe 657 than an edge surface of the first end portion of a case 655 is.

In this case, the beam angle of light emitted from the LED module 653 is larger than 180 degrees. Thus, the LED light bulb 651 is suitable for use in a general lighting device as a replacement for an incandescent light bulb.

FIG. 26B shows an LED light bulb 661 in which an LED-mounted surface of an LED module 663 on a mount member 664 is substantially flush with an edge surface of the first end portion of a case 665.

In this case, the beam angle of light emitted from the LED module 663 is approximately 180 degrees, which can improve downward illuminance of light emitted from LED light bulb 661.

FIG. 26C shows an LED light bulb 671 in which an LED-mounted surface of an LED module 673 on a mount member 674 is closer to a base member (farther from the apex of a globe 677) than an edge surface of the first end portion of a case 675 is.

In this case, the beam angle of light emitted from the LED module 673 is smaller than 180 degrees, which can improve illuminance of light that is emitted from the LED light bulb 671 directly toward the front side of the LED light bulb 671. Therefore, the LED light bulb 671 is suitable for use in, for example, an ornamental spotlight device. In FIG. 26C, the mount member 674 has a shape of a cup. The LED module 673 is mounted on the upper side of the bottom surface of the mount member 674, and the beam angle is defined by an edge surface of the mount member 674 at an opening of the mount member 674.

Furthermore, by making an inner circumferential surface 674*a* of the mount member 674 reflective, the LED light bulb 671 can collect light emitted from the LED module 673, and the lamp efficiency of the LED light bulb 671 can be improved. The inner circumferential surface 674*a* can be made reflective by, for example, forming a reflective film on the inner circumferential surface 674*a*, or giving a mirror finish to the inner circumferential surface 674*a*.

As set forth above, the beam angle of an LED light bulb can be adjusted according to the positional relationship between (i) the position in which the LEDs are mounted and (ii) an edge surface of either the first end portion of the case or the mount member (in reality, the size of the substrate also affects the beam angle of the LED light bulb). Various beam angles can be realized by an LED light bulb by changing the shape of the mount member, etc.

6. Base Member

In First Embodiment, the base member 15 includes the base portion 73 which is an Edison screw. Alternatively, the base member 15 may have a base portion of a different type.

Figure 27:
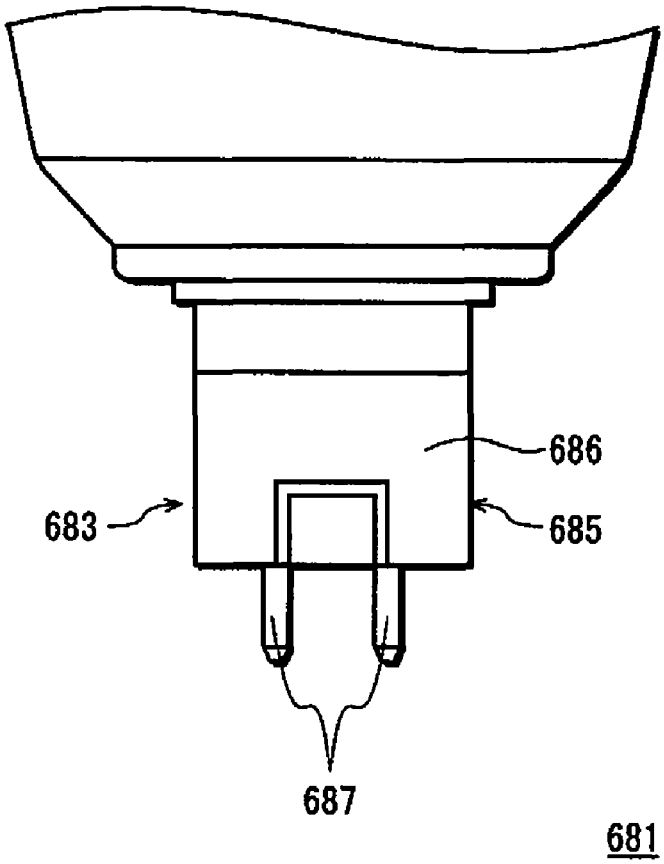
FIG. 27 shows another modification example in which a different base portion is provided.

FIG. 27 shows a modification example in which a different base portion is provided.

FIG. 27 shows an LED light bulb 681 including a GYX-type base member 683. In this LED light bulb 681 also, the base member 683 is attached to a protruding cylindrical portion (not illustrated) of a circuit holder. The GYX-type base portion 685 includes a base body 686 and four base pins 687. As shown in FIG. 27, the four base pins 687 extend downward (in the direction along which the central axis of the LED light bulb extends) from the base body 686.

Figure 28A:
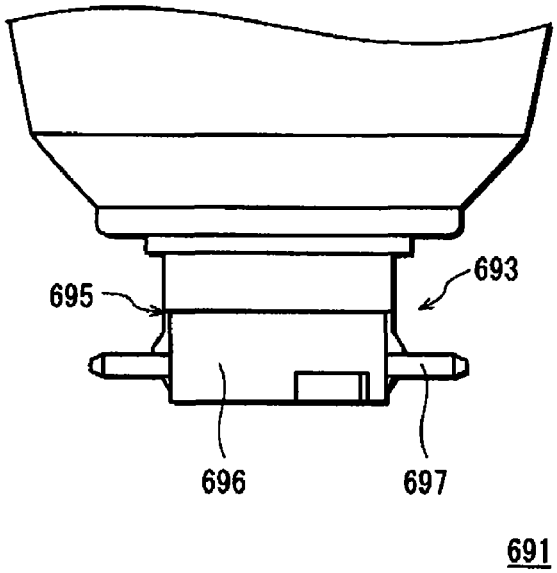
FIGS. 28A and 28B show another modification example in which a different base portion is provided.
Figure 28B:
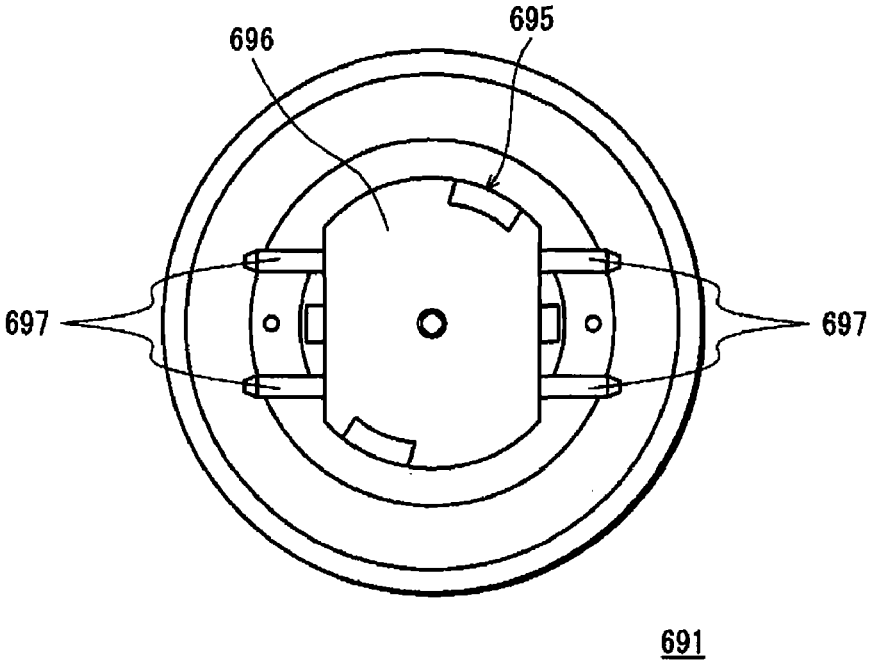

FIGS. 28A and 28B show another modification example in which a different base portion is provided.

FIGS. 28A and 28B show an LED light bulb 691 including a different type of base member 693. In this LED light bulb 691 also, the base member 693 is attached to a protruding cylindrical portion (not illustrated) of a circuit holder.

The base member 693 includes a base body 696 and base pins 697. There are four base pins 697. Here, it is considered that two base pins 697 form a pair—i.e., there are two pairs of base pins 697. As shown in FIGS. 28A and 28B, the two pairs of base pins 697 extend in a direction perpendicular to the central axis of the LED light bulb 691. Furthermore, one pair extends in an opposite direction from the other pair. The base pins 697 in each pair extend parallel to each other.

Figure 29A:
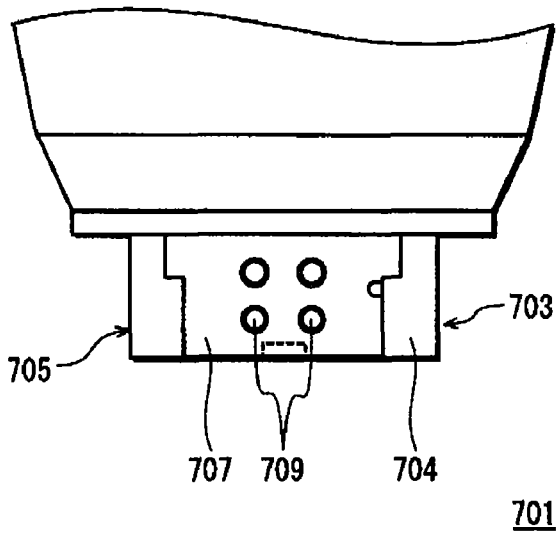
FIGS. 29A and 29B show yet another modification example in which a different base portion is provided.
Figure 29B:
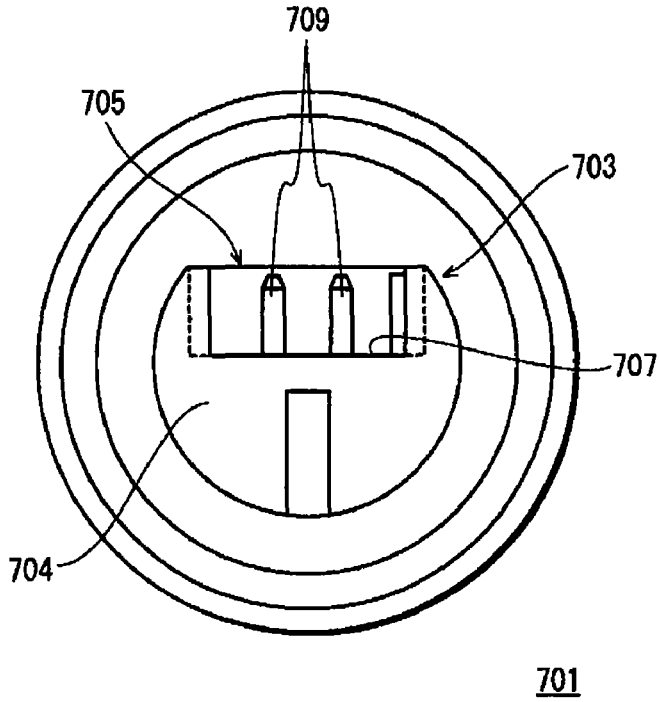

FIGS. 29A and 29B show yet another modification example in which a different base portion is provided.

FIGS. 29A and 29B show an LED light bulb 701 including a GRX-type base member 703. In this LED light bulb 701 also, the base member 703 is attached to a protruding cylindrical portion (not illustrated) of a circuit holder.

A base portion 705 includes a base body 704 and base pins 709.

The base body 704 has a recess 707 that is, when viewed along the direction perpendicular to the central axis of the LED light bulb 701, recessed in the direction perpendicular to the central axis of the LED light bulb 701. Four base pins 709 are provided in the bottom of the recess 707.

With regard to the four base pins 709, it is considered that two base pins 709 form a pair, i.e., there are two pairs of base pins 709. As shown in FIGS. 29A and 29B, all of the base pins 709 extend in the direction perpendicular to the central axis of the LED light bulb 701, parallel with one another.

It goes without saying that an LED bulb may include a base portion of a type different from the above-mentioned types. For example, an LED light bulb may include a base portion of a G type, a P type, an R type, an FC type, or a BY type.

7. Vents

Second Embodiment has described the LED light bulb 101 that has four vents 107 and four vents 109, which are respectively formed in areas A and B of the case 103 at equal intervals in the circumferential direction of the case 103. These vents 107 and 109 allow the air inside the case 103 to flow to the outside the case 103.

Therefore, components other than the case may also have through holes, as long as the through holes allow the air inside the case to flow to the outside the case. For example, through holes may be provided in part of the globe that is covered by the case and in the base member. This way, the air flows through, in addition to the through holes provided in the mount member for the power supply paths, the through holes provided in said part of the globe and the base member.

8. Globe (1) Shape

In the above embodiments etc., each LED light bulb comprises the globe 9 having a hemispherical shape (to be exact, a shape of a combination of a hemisphere and a cylinder). Alternatively, an LED light bulb may comprise a globe having a different shape, or may comprise no globe at all (a so-called D-type LED light bulb).

Figure 30:
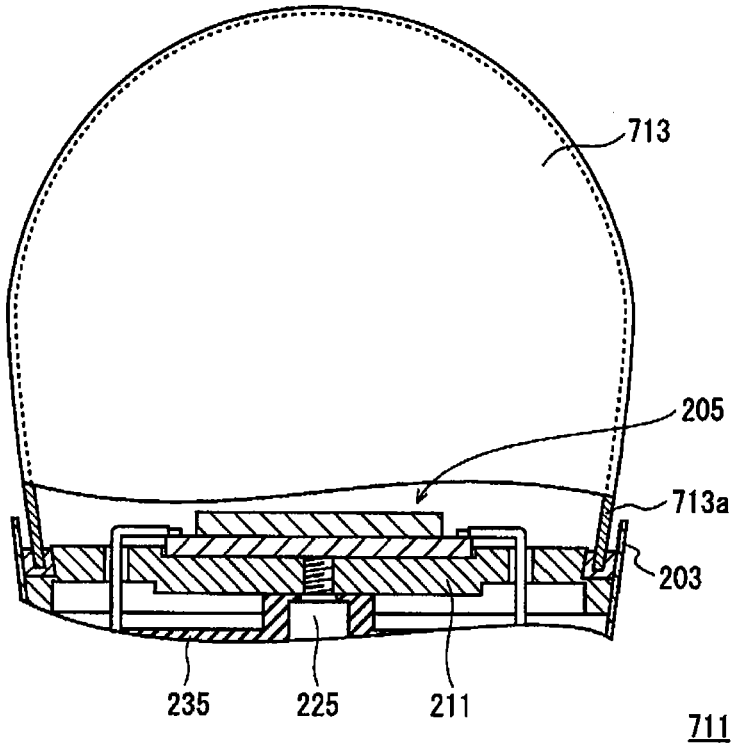
FIG. 30 shows a modification example in which a globe has a different shape.

FIG. 30 shows a modification example in which a globe has a different shape.

An LED light bulb 711 comprising an A-type globe 713 is illustrated in FIG. 30. As with the LED light bulb 201 pertaining to Third Embodiment, the globe 713 is secured by an adhesive material with a tip 713*a* of the globe 713 inserted in a groove that is formed in a mount member 715 in proximity to the outer circumferential surface of the mount member 715. The structures of the LED light bulb 711 that are the same as those of the LED light bulb 201 pertaining to Third Embodiment are assigned the same reference numbers thereas.

Figure 31:
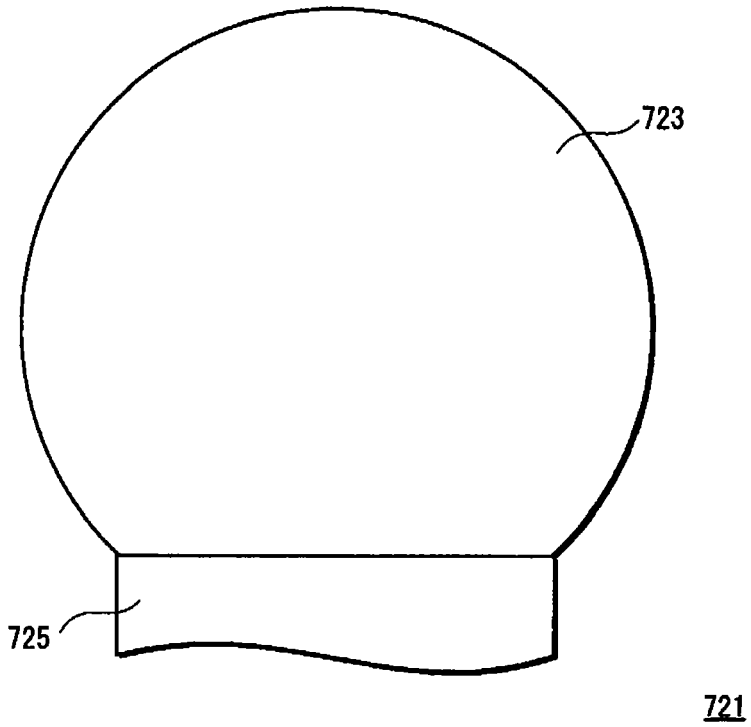
FIG. 31 shows another modification example in which a globe has a different shape.

FIG. 31 shows another modification example in which a globe has a different shape.

An LED light bulb 721 comprising a G-type globe 723 is illustrated in FIG. 31. As with the LED light bulb 201 pertaining to Third Embodiment, the globe 723 is secured to a case 725 and the like.

An LED light bulb may comprise a globe other than the A-type globe and the G-type globe. Furthermore, an LED light bulb may comprise a globe that is completely different in shape from any of the above-mentioned types.

(2) Material

It has been described in the above embodiments etc. that the globe is made of a glass material. Alternatively, the globe may be made of other materials that have translucency (with high transmittance, needless to say) and are hard to discolor. Specific examples of such other materials include a hard silicone resin, a fluorine resin, and a ceramic. By using any of these materials for the globe, the weight of the globe can be reduced. When the globe is made of a ceramic, the thermal conductivity of the globe is improved, thereby increasing the heat dissipation properties of the globe.

9. Bulb-Type Lamp

Each of the above embodiments and modification examples has described the present invention by taking an example of an LED light bulb that can replace an incandescent light bulb. However, the present invention is not limited to being applied to such a case where the LED light bulb is to replace a conventional incandescent light bulb. In a similar manner, the present invention may also be applied to a case where the LED light bulb is to replace other types of light bulbs (e.g., a halogen lamp).

Figure 32:
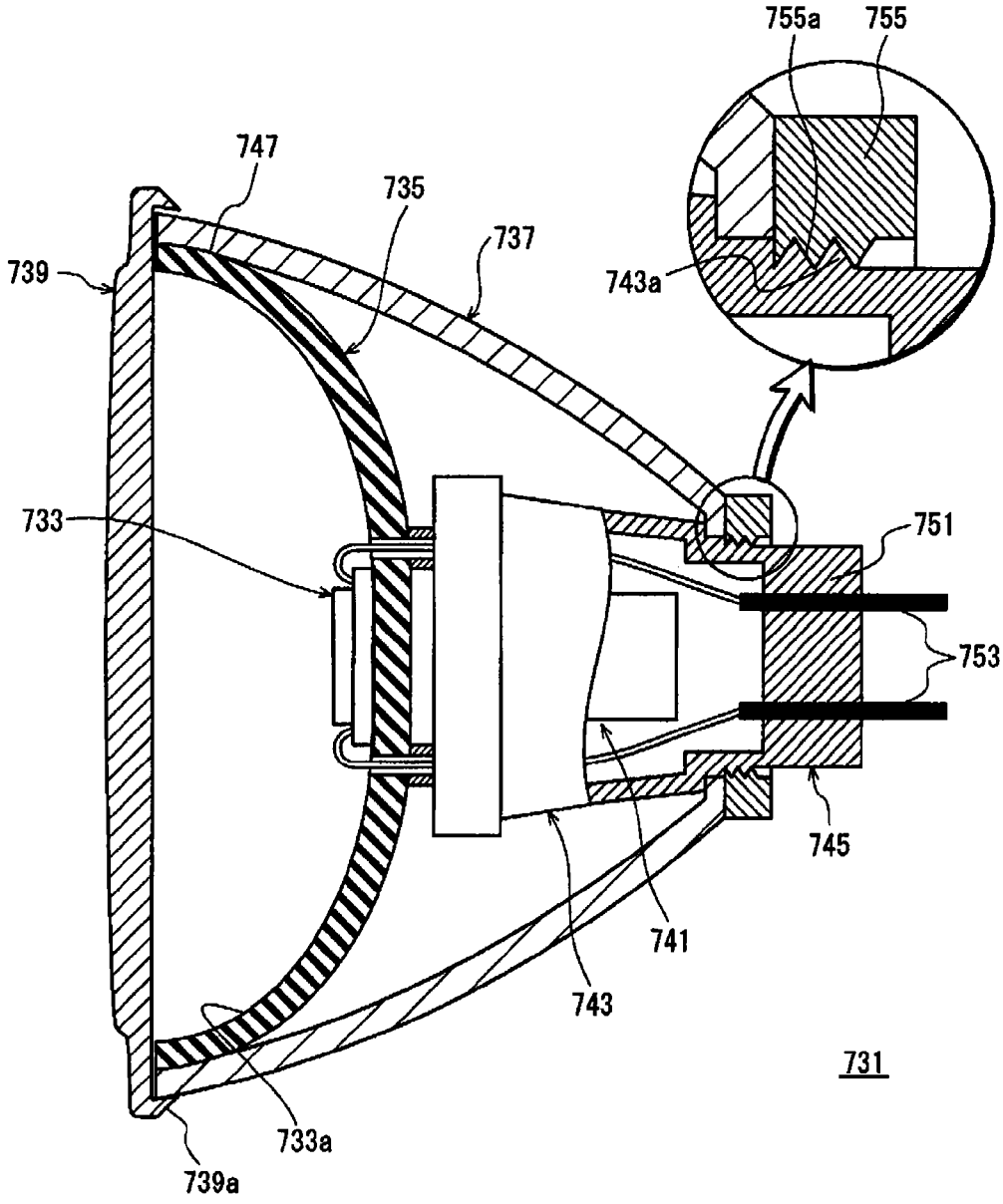
FIG. 32 is a longitudinal cross-sectional view of a halogen lamp pertaining to one embodiment of the present invention.

FIG. 32 is a longitudinal cross-sectional view of a halogen lamp pertaining to one embodiment of the present invention.

A bulb-type lamp 731, which is to replace a halogen lamp (hereinafter referred to as an "LED halogen lamp"), is composed of (i) an LED module 733 including a plurality of LEDs as light sources, (ii) a mount member 735 on which the LED module 733 is mounted, (iii) a case 737, at a first end portion of which the mount member 735 is attached, (iv) a front glass 739 covering the LED module 733, (v) a lighting circuit 741 that lights the LEDs (causes the LEDs to emit light), (vi) a circuit holder 743 positioned inside the case 737, with the lighting circuit 741 disposed inside the circuit holder 743, and (vii) a base member 745 attached to a second end portion of the case 737. Here, the LED module 733, the LEDs, the mount member 735, the case 737, the lighting circuit 741, the circuit holder 743, and the base member 745 correspond to the "light emitting module," "light emitting elements," "heat conduction member," "heat sink," "circuit," "circuit holder member," and "base" of the present invention, respectively.

As shown in FIG. 32, the mount member 735 has a bottom portion that is gently sloped in a shape of a bowl. The LED module 733 is mounted on the bottom portion of the mount member 735. An inner circumferential surface of the mount member 735, namely a surface 733*a* of the mount member 735 on which the LED module 733 is mounted, is a reflective surface (e.g., a dichroic mirror).

The case 737 has a shape of a bowl and is secured by an adhesive material 747 or the like, with the first end portion of the case 737 at an opening of the case 737 in contact with an end portion of the mount member 735 at an opening of the mount member 735.

The front glass 739 has a plurality of (e.g., four) latching portions 739*a* that latches with a tip of the first end portion of the bowl-shaped case 737, the latching portions 739*a* being provided at equal intervals in the circumferential direction of the case 737.

In FIG. 32, the base member 745 includes a GZ4-type base portion. This base portion has a base body 751 and a pair of base pins 753.

In the example shown in FIG. 32, the circuit holder 743 and the base member 745 are altogether formed as a single component. The circuit holder 743 and the base member 745 are attached to the case 737 with the aid of a ring 755, into which the outer circumferential surface of the base member 745 is screwed and fit.

The inner circumferential surface of the ring 755 includes a thread portion 755*a*. A thread portion 751*a*, which is formed on the outer circumferential surface of the base body 751 of the base member 745, is screwed and fit into the thread portion 755*a*. The circuit holder 743 and the ring 755 hold a bottom portion 737*a* of the case 737 therebetween.

10. Additional Remarks

Figure 33:
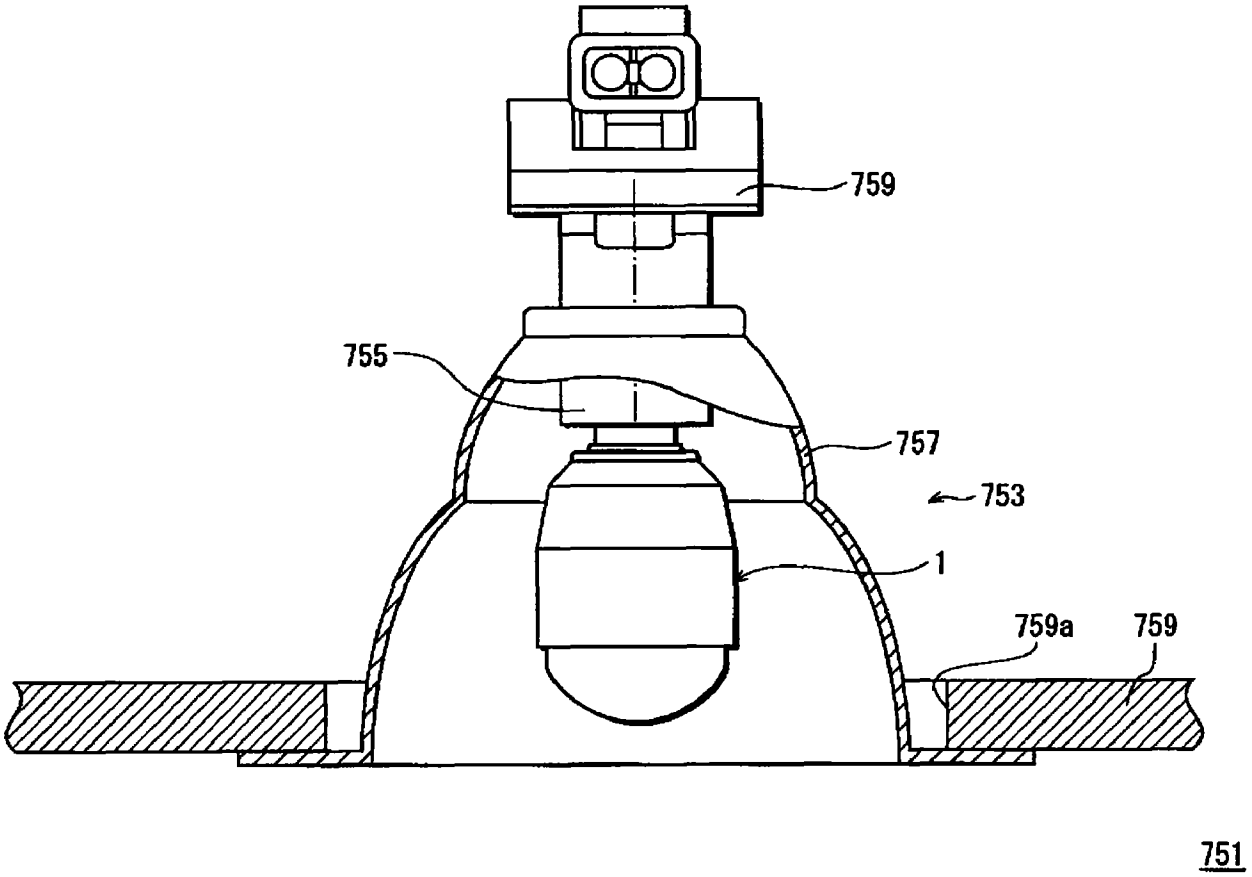
FIG. 33 illustrates a lighting device pertaining to one embodiment of the present invention.

FIG. 33 shows a lighting device comprising one of the above-described LED light bulbs (for example, the LED light bulb 1 pertaining to First Embodiment) as a light source.

A lighting device 750 includes the LED light bulb 1 and a lighting fixture 753. This lighting fixture 753 is a so-called downlight fixture.

The lighting fixture 753 is composed of a socket 755, a reflective plate 757, and a power supply unit 759. The socket 755 is electrically connected to the LED light bulb 1 and holds the LED light bulb 1. The reflective plate 757 reflects the light emitted from the LED light bulb 1 toward a predetermined direction. The power supply unit 759 (i) supplies power to the LED light bulb 1 when a switch (not illustrated) is turned on, and (ii) does not supply power to the LED bulb 1 when the switch is turned off.

Here, the reflective plate 757 is attached to a ceiling 759 so as to allow inserting the socket 755 into the ceiling 759 via an opening 759*a* of the ceiling 759, with the socket 755 positioned deep in the ceiling 759.

It goes without saying that a lighting device pertaining to the present invention is not limited to the above-mentioned lighting device for a downlight.

In conclusion, although the above embodiments and modification examples have separately explained the features of the present invention, the structures explained in the above embodiments and modification examples may be combined with one another.

INDUSTRIAL APPLICABILITY

The present invention can be used to lighten thermal load on a lighting circuit, even when improvement in the heat dissipation properties and reduction in size and weight of a lighting device have been simultaneously achieved.

REFERENCE SIGNS LIST

1 LED light bulb (bulb-type lamp)
3 LED module (light emitting module)
5 mount member (heat conduction member)
7 case (heat sink)
9 globe
11 lighting circuit
13 circuit holder
15 base member (base)
17 substrate
19 LED (light emitting element)
S1 an area of a portion of the mount member that is in contact with the case
S2 an area of a portion of the mount member that is in contact with the substrate of the LED module

The invention claimed is:

1. A bulb-type lamp comprising:
a light emitting module including a substrate on which at least one light emitting element is mounted;
a cylindrically-shaped heat sink that allows dissipation of heat therefrom, the heat being generated by the at least one light emitting element emitting light;
a base member attached to one end portion of the heat sink;
a plate-shaped heat conduction member on a front surface of which the light emitting module is mounted, the heat conduction member closing an opening of the other end portion of the heat sink and allowing conduction of the heat therefrom to the heat sink;
a circuit that, upon receiving power via the base member, causes the at least one light emitting element to emit the light; and
a circuit holder member positioned inside the heat sink, with the circuit disposed inside the circuit holder member, wherein
an air space exists (i) between the circuit holder member and the heat sink, and/or (ii) between the circuit holder member and the heat conduction member, and the circuit is isolated from the air space by the circuit holder member,
a side surface of the heat conduction member and an inner circumferential surface of the heat sink are in contact with each other, and
a fraction S1/S2 satisfies a relationship $0.5 \leqq S1/S2$, where S1 denotes an area of a portion of the heat conduction member that is in contact with the heat sink, and S2 denotes an area of a portion of the heat conduction member that is in contact with the substrate of the light emitting module.

2. The bulb-type lamp of claim 1, wherein
the fraction S1/S2 satisfies a relationship $1.0 \leqq S1/S2 \leqq 2.5$.

3. The bulb-type lamp of claim 1, wherein
the heat conduction member has a recess at the front surface thereof, and the substrate of the light emitting module is mounted in the recess.

4. The bulb-type lamp of claim 1, wherein
the heat conduction member has a shape of a circular plate,
an outer circumferential surface of the heat conduction member and an inner circumferential surface of the heat sink are in contact with each other, and
an entirety of the outer circumferential surface of the heat conduction member is in contact with the inner circumferential surface of the heat sink.

5. The bulb-type lamp of claim 1, wherein
the heat sink has a wall thickness of 1 mm or less.

6. The bulb-type lamp of claim 1, wherein
a thickness of the portion of the heat conduction member that is in contact with the substrate is greater than or equal to a thickness of the substrate, and is smaller than or equal to a thickness that is three times the thickness of the substrate.

7. The bulb-type lamp of claim 1, wherein
a thickness of a portion of the heat conduction member on which the light emitting module is mounted is greater than a wall thickness of the heat sink.

8. The bulb-type lamp of claim 1, wherein
at least one through hole is provided in the heat sink.

9. The bulb-type lamp of claim 1, wherein
a surface of the substrate on which the at least one light emitting element is mounted is positioned farther from the base than a virtual edge surface of the heat sink is, the virtual edge surface of the heat sink being a virtual surface that is flush with a tip of the other end portion of the heat sink.

10. The bulb-type lamp of claim 1, wherein
of all portions of the heat conduction member, at least the front surface thereof on which the light emitting module is mounted is positioned farther from the base than a virtual edge surface of the heat sink is, the virtual edge surface of the heat sink being a virtual surface that is flush with a tip of the other end portion of the heat sink.

11. The bulb-type lamp of claim 1, wherein
a surface of the substrate on which the at least one light emitting element is mounted is positioned closer to the base than a virtual edge surface of the heat sink is, the virtual edge surface of the heat sink being a virtual surface that is flush with a tip of the other end portion of the heat sink.

12. The bulb-type lamp of claim 1, wherein
the heat conduction member has a recess, and the light emitting module is mounted in the recess, and
the front surface of the heat conduction member in the recess, on which the light emitting module is mounted, is positioned closer to the base than a virtual edge surface of the heat sink is, the virtual edge surface of the heat sink being a virtual surface that is flush with a tip of the other end portion of the heat sink.

13. The bulb-type lamp of claim 12, wherein
an inner circumferential surface of the recess is reflective.

14. The bulb-type lamp of claim 1, wherein
the circuit holder member is attached to the heat sink, and
the heat conduction member is connected to the circuit holder member.

15. The bulb-type lamp of claim 14, wherein
the circuit holder member includes:
a holder body that has an opening in at least one end thereof and is attached to the heat sink; and
a cap that closes the opening of the holder body and is connected to the heat conduction member, the heat conduction member is inserted into the heat sink through the other end portion of the heat sink, and the cap is attached to the holder body in such a manner that the cap is movable in a direction along which the heat conduction member is inserted into the heat sink.

16. The bulb-type lamp of claim 1, wherein the heat sink has a multilayer structure composed of at least the following two layers: (i) an outermost layer forming an outer circumferential surface of the heat sink; and (ii) an innermost layer forming the inner circumferential surface of the heat sink, and an outer surface of the outermost layer has higher emissivity than an inner surface of the innermost layer.

17. The bulb-type lamp of claim 1, wherein the heat sink and the base are thermally connected to each other via a filler in the base.

18. The bulb-type lamp is the bulb type lamp of claim 1, wherein outer and inner diameters of the heat sink decrease from a tip of the other end portion toward a tip of the one end portion of the heat sink.

19. The bulb-type lamp of claim 1, wherein the circuit holder member includes a holder body and a cap, the holder body includes:

a protruding cylindrical portion that penetrates through an opening of the one end portion of the heat sink, the one end portion forming a bottom wall of the heat sink, and therefore protrudes from an inside to an outside of the heat sink;

a bottom portion that is in contact with an inner surface of the bottom wall of the heat sink; and a large diameter cylindrical portion that extends from an outer circumferential rim of the bottom portion toward a direction opposite from a direction toward which the protruding cylindrical portion protrudes, the cap closes an opening of the large diameter cylindrical portion, and the base member is fit around the protruding cylindrical portion.

20. The bulb-type lamp of claim 19, wherein an outer circumferential surface of the protruding cylindrical portion has a thread, and the thread is screwed and fit into the base member.

21. A lighting device comprising:

a bulb-type lamp; and a lighting fixture to/from which the bulb-type lamp is attachable/detachable, wherein the bulb-type lamp is the bulb-type lamp of claim 1.

* * * * *